US007267611B2

(12) United States Patent
Slomiany et al.

(10) Patent No.: US 7,267,611 B2
(45) Date of Patent: Sep. 11, 2007

(54) BUNCO GAMING DEVICE, METHOD AND BONUS GAME

(75) Inventors: Scott D. Slomiany, Streamwood, IL (US); Lawrence E. DeMar, Winnetka, IL (US); Duncan F. Brown, Grayslake, IL (US)

(73) Assignee: Case Venture Management, LLC, Wheeling, IL (US)

( * ) Notice: Subject to any disclaimer, the term of this patent is extended or adjusted under 35 U.S.C. 154(b) by 919 days.

(21) Appl. No.: 09/993,359

(22) Filed: Nov. 19, 2001

(65) Prior Publication Data

US 2002/0160827 A1 Oct. 31, 2002

Related U.S. Application Data

(63) Continuation-in-part of application No. 09/709,922, filed on Nov. 10, 2000.

(51) Int. Cl.
*A63F 9/24* (2006.01)

(52) U.S. Cl. ..... 463/16

(58) Field of Classification Search ..... 463/17, 463/22, 16; 273/145 R, 146
See application file for complete search history.

(56) References Cited

U.S. PATENT DOCUMENTS

| | | | | | |
|---|---|---|---|---|---|
| 1,781,983 | A * | 11/1930 | Koch | 273/145 C |
| 1,887,068 | A * | 11/1932 | Renz | 273/145 R |
| 2,125,236 | A * | 7/1938 | Edgeworth | 194/221 |
| 5,263,715 | A * | 11/1993 | Matsumoto et al. | 463/22 |
| 5,647,798 | A * | 7/1997 | Falciglia | 463/19 |
| 5,788,573 | A | 8/1998 | Baerlocher et al. | 463/16 |
| 6,702,668 | B2 * | 3/2004 | Banyai | 463/17 |

OTHER PUBLICATIONS

Steehn Gaming Systems, Inc., SteemRoller Brochure, The Dice Game for the Next Generation, date unknown.
World Bunco Association, Bunco History, http//www.worldbunco.com/history.html, dated May 22, 2000.
Dice Gamers Resources, Bunco Rules, http://www.buncogame.com/brules.shtml, Apr. 18, 2003.

* cited by examiner

*Primary Examiner*—Corbett B. Coburn
(74) *Attorney, Agent, or Firm*—McDonnell Boehnen Hulbert & Berghoff LLP

(57) ABSTRACT

A dice game is comprised of a plurality of stages. Each operation of the game begins with the operation of a first stage. In one embodiment, depending on the outcome of the first stage the game may be over, or there may be an operation of a second stage.

6 Claims, 25 Drawing Sheets

MAIN GAME PLAY SEQUENCE

MAIN GAME PLAY SEQUENCE (cont.)

GAME OVER SEQUENCE

CASINO BUNCO – Flow Chart page 1

GAME START SEQUENCE

CASINO BUNCO – Flow Chart page 3

MAIN GAME PLAY SEQUENCE –
Determine Dice Roll

CASINO BUNCO – Flow Chart page 4

CASINO BUNCO – Flow Chart page 5

GAME OVER SEQUENCE

CASINO BUNCO – Flow Chart page 6

BONUS GAME SEQUENCE

CASINO BUNCO – Flow Chart page 7

DETAILED BONUS GAME SEQUENCE—
This is a detailed explanation of what we do to initialize the various elements that are in use during the Bonus Game The Player Index is a variable that describes where the player is at in the paytable and the item type table.

The Circle Position is a variable that describes where the cursor is on the display.

These two variables are needed because while the player is 'travelling' down a linear paytable of values, these values are being graphically displayed in a circular fashion. So the player can be at any space in the pay table from position 1 to XX, graphically, the cursor, which describes the players position on the screen, can only pointing at any of 1 to 7 positions.

Note that the PositionType and PositionPay arrays each have 7 elements corresponding to the 7 on-screen elements (the cursor location and the 6 possible spaces to move to on the next roll.)

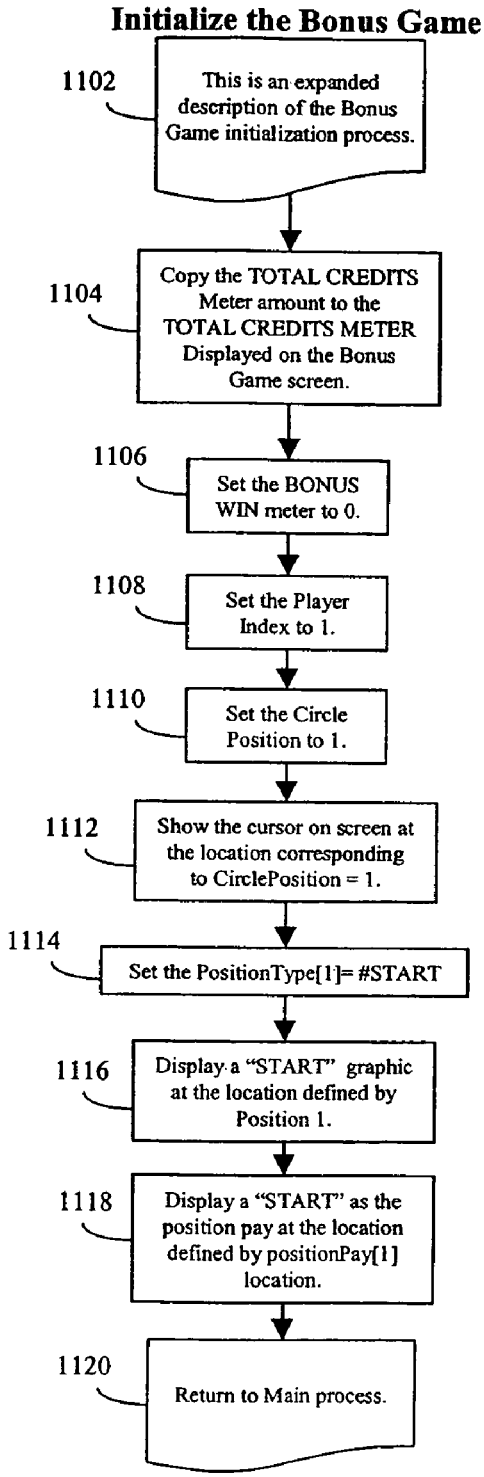

Figure 25

CASINO BUNCO – Flow Chart page 8

DETAILED BONUS GAME SEQUENCE – This is the subroutine that describes in detail the way we update the pay values, graphics, and position types on the circular trail.

Update the graphics on the trail

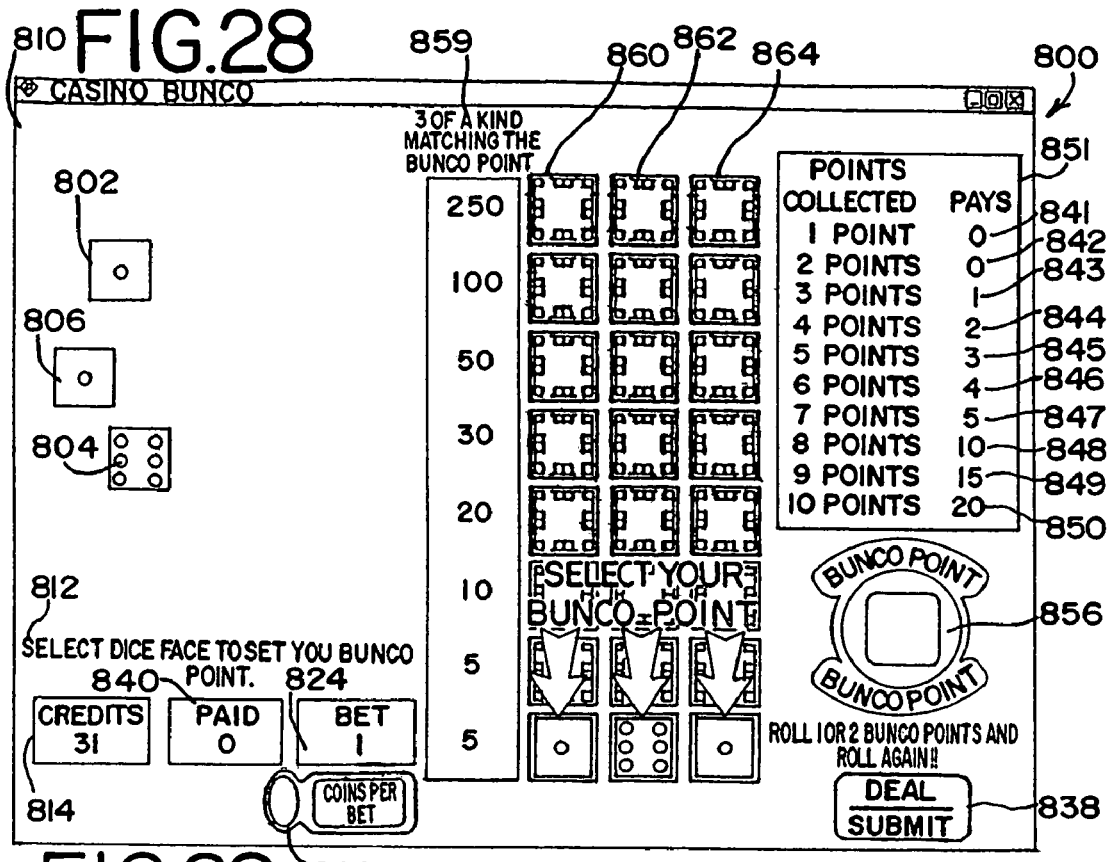
FIG.28
810
CASINO BUNCO
859
860
862
864
800
3 OF A KIND MATCHING THE BUNCO POINT
851
802
806
804
812
SELECT DICE FACE TO SET YOU BUNCO POINT.
840
824
CREDITS 31
PAID 0
BET 1
814
COINS PER BET
820
250
100
50
30
20
10
5
5
SELECT YOUR BUNCO POINT
POINTS COLLECTED PAYS
1 POINT 0
2 POINTS 0
3 POINTS 1
4 POINTS 2
5 POINTS 3
6 POINTS 4
7 POINTS 5
8 POINTS 10
9 POINTS 15
10 POINTS 20
841
842
843
844
845
846
847
848
849
850
BUNCO POINT
856
ROLL 1 OR 2 BUNCO POINTS AND ROLL AGAIN!!
DEAL SUBMIT
838

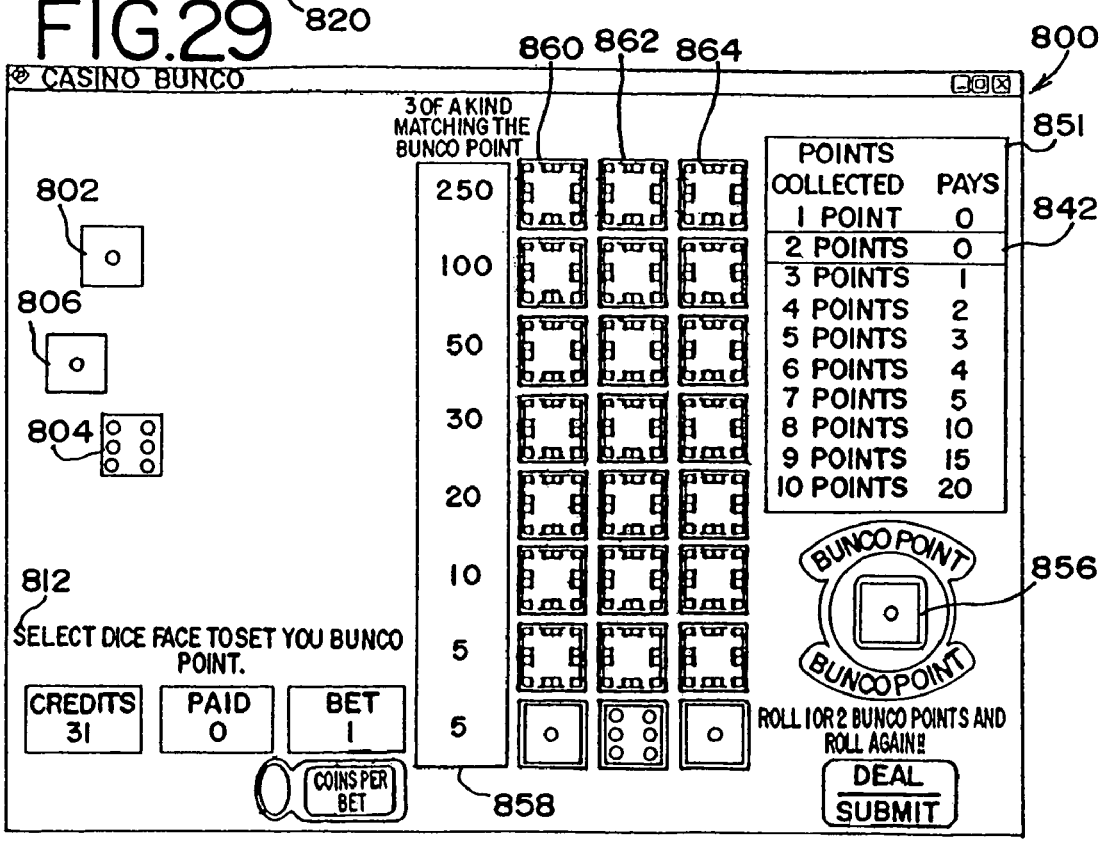
FIG.29
CASINO BUNCO
860
862
864
800
3 OF A KIND MATCHING THE BUNCO POINT
851
802
806
804
812
SELECT DICE FACE TO SET YOU BUNCO POINT.
CREDITS 31
PAID 0
BET 1
COINS PER BET
858
250
100
50
30
20
10
5
5
POINTS COLLECTED PAYS
1 POINT 0
2 POINTS 0
3 POINTS 1
4 POINTS 2
5 POINTS 3
6 POINTS 4
7 POINTS 5
8 POINTS 10
9 POINTS 15
10 POINTS 20
842
BUNCO POINT
856
ROLL 1 OR 2 BUNCO POINTS AND ROLL AGAIN!!
DEAL SUBMIT

BUNCO GAMING DEVICE, METHOD AND BONUS GAME

PRIORITY HISTORY

This application is a continuation-in-part of pending U.S. Ser. No. 09/709,922 filed Nov. 10, 2000, the disclosure of which is hereby incorporated in its entirety herein by reference.

FIELD OF THE INVENTION

This invention relates to games in general, and particularly to gaming machines allowing wagers to be placed on a game, and more particularly to an innovative casino-type Bunco game and gaming machine, including an embodiment which allows wagers on a plurality of game levels.

DISCUSSION OF THE PRIOR ART

There are many ways in which multiple wagers may be placed on different gaming machines. In one of the simplest forms, a player may make a variable wager on a specific bet. On a single line slot machine for example, as the player inputs additional coins into the machine (per play) the payouts for the single payline is multiplied by the number of coins bet. Often the higher awards increase beyond the given multiple, offering a bonus for betting more coins on this single payline. The same type of multiple coin bet is also well known in video poker, where a typical bet is one to five coins on each hand played. In such a video poker game, the paytable is multiplied by the number of coins bet with a substantial bonus being given for a Royal Flush when five coins are bet.

In other gaming machines, there are multiple bets that can be made on different outcomes. In a multiline slot machine for example, a wager can be made on each of a plurality of paylines. Typically, each payline is paid according to a paytable (also referred to as a "payout table") that is similar for each payline. A single spin of the reels yields a result on each payline which is paid if it matches a winning combination on the paytable.

The above two techniques have been combined, providing multiple paylines and multiple coins per payline. The pay for each payline is multiplied by the number of coins bet on that payline with certain bonuses available when a higher number of coins per payline are wagered.

Additionally, there have been games such as Double-Down Stud poker which allow a player to place an additional bet on a game that is already in progress. There have been games such as Play-It-Again poker which allow a player to make a new bet on a re-play of a starting hand.

Thus, it can be appreciated that there have been poker games, for instance, which allow a player to bet on multiple hands where each of the plurality of hands is generated from a single initial deal, followed by independent draws or re-deals for each hand that received a bet. In each case, the bets that are made are considered to be made on a game of chance, and paid if there is a winning result.

There is also a well-known dice game called BUNCO. To Applicants' knowledge, however, no one has ever adapted such a game to a wagering environment, particularly as a gaming machine.

SUMMARY OF THE INVENTION

In broad overview, the present invention in one aspect allows the placing of multiple bets on different stages of a game, and a dice game having attributes of Bunco. The game in one embodiment is comprised of a plurality of stages. Each operation of the game begins with the operation of a first stage. Depending on the outcome of the first stage the game may be over, or there may be an operation of a second stage. The second stage operation may be totally independent of the first stage, or may have dependencies on first stage events or data, e.g., the achievement of a "winning" first stage. As will be understood throughout this invention disclosure, "winning" is just one form of possible advancement to the next level. For example, one aspect of the invention includes a "special" (Free Ride) which permits advancement even if a "losing" condition is presented at a level.

Depending on the outcome of the second stage, the game may be over or there may be an operation of a third stage. This sequence continues until the game ends or until the final ($n^{th}$) stage has been operated, at which time the game ends.

It should be appreciated that not every stage will operate in each game, and that the lowest stages will operate the most often while the highest stages will operate the least often.

As noted above, the present invention furthermore allows the player to place wagers on different stages of the multi-stage game. Each stage of the game may typically have its own paytable or payout scheme, and its own expected return. A bet made on a stage of the game which is not played is lost in one contemplated form of the invention. Thus, at the highest stages the bets made are lost very often, without even playing that stage of the game, because most games will end before getting to the highest stage bet. Due to this architecture, there is much greater opportunity for large wins in games which get to the highest stages. This makes for a more exciting gaming experience, because as the players watch the game successfully continue through the various stages, the expectation of what may be won at each stage usually increases.

Embodiments shown herein are generally constructed such that the player specifies at the outset of the game the number of stages or levels to bet on. For instance, bets are made on a first level, a second level, and up to the number of levels specified by the player. While this is one preferred embodiment which gives the player action at all levels up to the highest level bet, it is envisioned that the player could be allowed to arbitrarily choose which levels to bet without departing from the invention. So too, it is contemplated that the game could allow for a new bet as stages are achieved. An embodiment further contemplates a required opening bet that gives the potential for action at all levels.

Certain contemplated embodiments also have a structure that any "Win" on a given stage advances the game to the next stage. Other contemplated embodiments have different game rules for continuing from stage to stage, and operate under those rules for a given stage.

In one aspect of the invention, it is a principal objective to provide a method of playing a game, where a player is initially provided with a first stage game of chance upon which a first wager is placed by the player, and a second stage game of chance upon which a second wager is placeable. As previously noted, while the game stages can be the same type of game (e.g., slots), or different games (e.g., slots, cards, dice, roulette, etc.), this particular application is primarily directed to a dice game having attributes of BUNCO.

Each stage has a "winning" condition and a "losing" condition. That is, there is an established criterion or criteria whereby the player may advance from one stage to the next, or may not. As used throughout this disclosure, and in the claims, "winning" and "losing" are to be considered synonymous with advancing or terminating, unless otherwise stated.

The first stage game is played, with a determination of whether a winning/advancement or losing/terminating condition is presented. If a winning condition is presented by the first stage game as played, then the player advances to the second stage game, assuming a bet has been previously placed for that stage. If a losing condition is presented by the first stage game as played, however, the game is over and any second wager (or higher) is lost. It will be understood that in some embodiments a loss condition could be presented by simply achieving a condition where only part of a wager placed on a given level may be returned, i.e., a player wagered five credits on a level but only achieved a return of three credits. A win need not necessarily be more than the amount wagered to constitute a winning or advancing condition.

In the event that the first stage presents a winning condition and there is a wager for the second stage, then the second stage game is played. There follows a determination as to which of the winning and losing conditions is presented by the second stage game as played. These steps are repeated for as many stages as are provided by the game if all have been bet upon, or as many stages as have actually been bet upon if fewer than all, again assuming a winning/advancement condition has been met for each preceding stage.

In a preferred form the foregoing method of playing a game includes the step of providing a payout for a winning condition at the second stage, or more preferably providing a payout for a winning condition at each stage. The payout can be based upon the amount of a respective wager at a respective stage, and advantageously includes an increase by a multiplier for a payout at a respective stage, with the multiplier increasing for each successive stage.

In another aspect of the invention, the foregoing method is adapted for operating a processor-controlled gaming machine. In this application of the invention, gameplay elements are provided in a manner that can be visualized by a player, such as on a video display screen, or in some three dimensional format where the gameplay elements can be tracked (such as on a board with an electronic interface), just to name two ways of such visualization. In this form of the invention, a mechanism for a wager input from the player is also provided, along with a mechanism for game operational input from the player, such as to start play.

There is a first stage game of chance upon which a first wager is placed by the player, and at least a second stage game of chance upon which a second wager is placeable. Each stage has a winning/advancement condition and a losing/terminating condition. In the preferred form of the invention, all wagers are placed before play begins at the first stage level.

If not already displayed, and assuming there has been an advancing condition met at the first stage and a bet placed on the second stage, the second stage game of chance is displayed (or, for instance, activated if already displayed). This second stage is played, with a determination of which of the winning and losing conditions is presented by the second stage game as played. If there is a winning condition, this form of the invention provides a payout for the second stage, as well as for any subsequent consecutive stages for which there is a winning condition, and a wager placed thereon.

One embodiment of this method as applied to a gaming machine provides a set of differing gameplay element indicia, such as facets of a die. A subset of at least one match indicia against which a set of dice are to be matched in the course of play is established, such as a random selection of die faces (e.g., three die numbers) against which tossed dice are to be matched. In a preferred form of this dice gaming machine, first, second, third and successive stages up to said nth stages are displayed together as discrete arrays on a visual display.

The dice are initially tossed in one embodiment, and beginning with at least the second stage game, a determination is made as to whether any match is made between the match indicia and the dice tossed. At least one match comprises a winning condition for a stage being played, in this embodiment. If a match is not made, then the unmatched indicium is removed from further play. The game ends when no matches are made at a given level, again assuming that a wager has been made up to and including that level.

Yet another aspect of the invention is providing a feature which is subject to random allocation to a stage in the course of play, with the feature, if allocated, enabling a next stage to be played regardless of whether a winning condition has otherwise been presented. The special feature, referred to herein as a "Free Ride," therefore constitutes or comprises a so-called winning/advancement condition. Of course, a wager still needs to have been placed on the next stage which is subject to being so enabled for play by the Free Ride feature.

Of course, the foregoing invention as described in a video machine embodiment could be readily embodied in a mechanical machine. Likewise, the video dice game is readily adapted to a table-type game format.

In the same vein, a gaming machine coming within the scope of one aspect of the invention broadly comprises a gaming unit having at least first and second stages of play, each stage having an advancement condition and a non-advancement condition. Some kind of interface mechanism with the gaming unit allows gameplay input from a player, with the gameplay input including wagering input allowing the player to register a bet upon one or more stages of play.

An operational device operates the gaming unit, upon player input including an operational command. The operational device determines which of the conditions is presented by a first stage as played, and if an advancement condition is presented, then advancing the gaming unit to the second stage, but if a non-advancement condition is presented, the game is over and at least a portion, and preferably all, of any second stage bet registered is lost. Play continues for a successive stage up to a predetermined nth stage if an advancement condition is determined for that next stage to be reached, and a bet has been previously registered for that successive stage. Again, the stages of play can be games which are of the same type of game, or different types of games. These can also be games that have not yet been invented.

In another expression of the invention of the instant application, a video dice game is disclosed comprising a video display device, a cpu having a program operating a dice game and a wager input mechanism which registers a wager placed by a player. A set of differing gameplay element indicia in the form of dice are used, and a subset is established of at least one match indicium (match point) against which representations of dice are to be matched in the course of play.

In some versions, just one match point is established. In others, a plurality of match points may be established. The match point(s) can be preset, or may be selected at random. In some instances, the player may select a match point from a plurality available. It should be also noted that where a plurality of match points are provided at random, some or all of them may have the same indicium, i.e., two or more may have the same number of dots, yielding match points which are duplicates, triplicates etc. The gameplay award can accommodate such replication with an increase (e.g., multiplier) in the award for subsequent matches.

Continuing with the embodiment now being described, the program establishes a first stage dice toss. In many preferred embodiments, this first stage toss also constitutes the subset of match points. In one form of the invention as a multilevel game, the program establishes further stage tosses if a predetermined sufficient wager has been registered for each further stage dice toss. A payout is based upon the wager and a predetermined value for a winning condition presented by a stage toss according to a preset table.

One method for playing a Bunco-type dice game of the present invention uses dice elements having a plurality of differing indicia thereon (e.g., dots). A plurality of match points are provided at the start of the game. Dice are tossed, such as three dice, with a random selection of an indicium for each die element tossed. A determination is made for each die element tossed whether its randomly selected indicium matches a match indicium of said match points. An award according to a predetermined paytable for each match on a toss is provided, but any match point which is not matched on a toss is eliminated from play. One form of this game ends the game if no match is made.

Another form has a paytable which yields an award of increasing value with every toss that has a match of a match point. A preferred version has all available levels (stages) of play made available upon placing a wager at the beginning of the game. A variation has the amount of the wager as establishing the number of dice element tosses as stages to be played, i.e., more wagered provides more stages.

An option for these dice games is a bonus awarded if all three dice elements on a toss have the same randomly selected indicium which also matches a match indicium; this is a "Bunco." In many preferred embodiments, a "Bunco" is the only way to achieve an award on the first level, where that level also is used to establish the match points for the game. Certain embodiments also use a "Bunco" (second) paytable which increases in value with subsequent levels.

One form of the invention as a dice wagering game and machine does not include a game-ending condition if a match is not made at a level, instead having a preset number of levels available for play upon entry of a wager. The award is a function of the additive number of matches achieved. The foregoing second "Bunco" paytable can be advantageously provided for a bonus award, and increasing in bonus award value with each successive stage of play. This form of the invention can have a single match point (selected by the player or assigned by the gameplay), or a plurality of match points determined at the start of the game. Where the match points are randomly established, some or all of the match indicia can possibly be the same in view of random allocation of the match indicia to each match point.

A "Free Ride" feature is also disclosed for use in desired embodiments. The game in this version of the inventive concept provides for a randomly allocated free advancement feature. This can be the appearance of some special indicium on all dice tossed, a toss that has all of the same die indicium presented which do not, however, match the match indicium, or some other triggering mechanism. Where the gameplay includes the eliminating from play any match point which is not matched on a toss, or no match resulting in a game ending condition, the free advancement feature would constitute an exception when it has been allocated (achieved), allowing play to continue with a toss on a subsequent stage of play A bonus game is also disclosed as another aspect of the invention. It has a dice-based theme, although it is readily adaptable to other themes. The bonus game involves a path along which the player progresses. Awards are available to the player when the player "lands" on a particular stopping point. The player has the option of taking that award, or going on, with ever-increasing values to the awards if the player chooses to go on. However, a game-ending feature is introduced, such as after the first award is determined. The game-ending feature when landed-upon in one embodiment results in no award to the player in the bonus round. A consolation price is nonetheless provided in a preferred embodiment.

These aspects of the invention, along with other aspects, advantages, objectives and accomplishments of the invention, will be further understood and appreciated upon consideration of the following detailed description of certain present embodiments of the invention, taken in conjunction with the accompanying drawings, in which:

BRIEF DESCRIPTION OF THE DRAWINGS

FIGS. 18 through 27 are diagrammatic flowcharts of the embodiments depicted in FIGS. 8 through 17;

FIGS. 28 through 31 show various views of game displays of one embodiment of the invention.

DETAILED DESCRIPTION OF PREFERRED EMBODIMENTS

Figure 1:
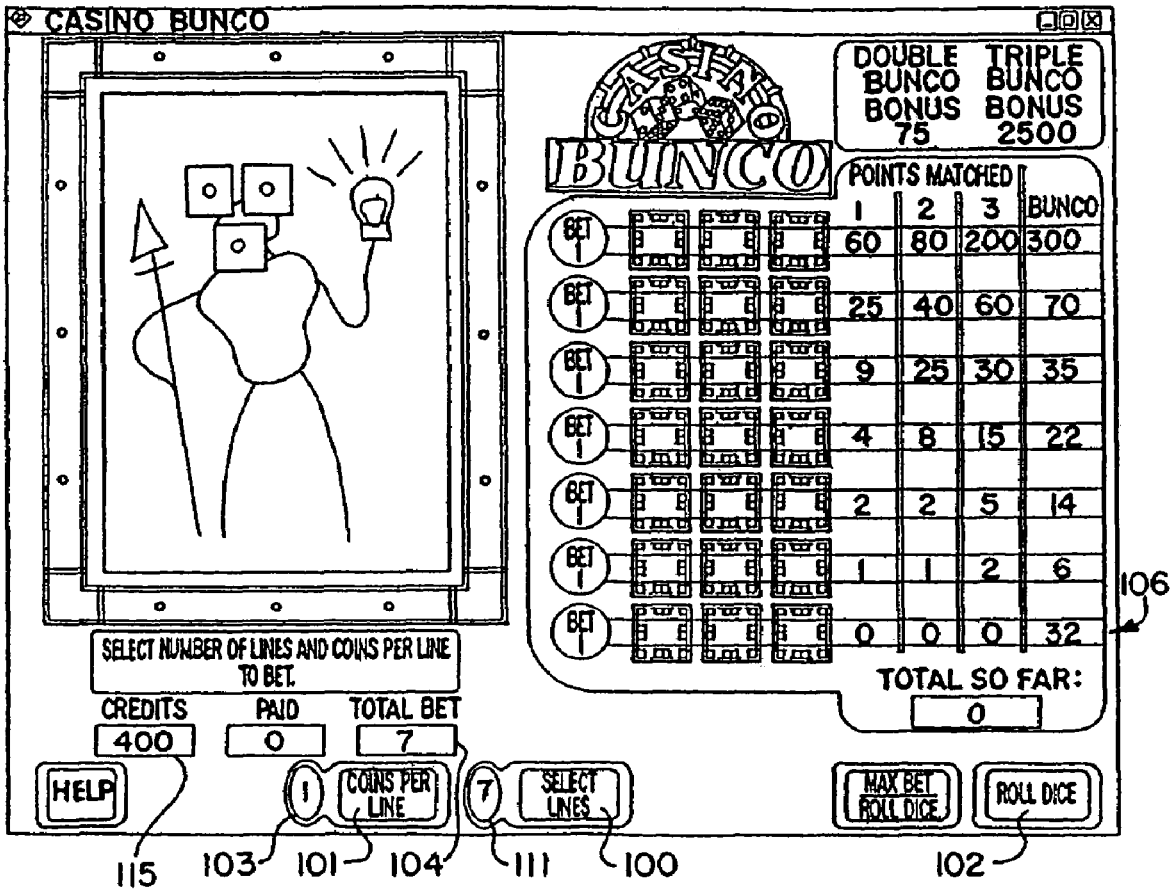
FIG. 1 is a video screen representation of a multi-stage video dice gaming machine embodiment of the present invention.

As disclosed in the parent case U.S. Ser. No. 09/709,922, four different embodiments of the present invention are described therein, with some noted variations in certain cases. The first embodiment is a three stage, multi-line, multi-coin video slot machine. The same game format (slots) with the same paytable is operated on three stages, with increasing payout multipliers at each stage providing an increasing amount to win at the higher stages. The "spin" at each stage is independent of the previous stages.

The second embodiment is a multi-stage Five-Card Stud poker game. Each stage is again independent of the previous stage. However, a separate paytable is used for each stage in this embodiment. A variation of this game is also shown which uses the same paytable on each stage, but combined with a mechanism to increase the "hit" rate.

The third embodiment is a Draw poker game that combines the concepts shown in the Stud poker game with the decisions and optimal play analysis that are integral to Draw poker.

The fourth embodiment is a dice game which has been adapted to provide a high dependency between the first stage and the next stages. The present application adds to this fourth embodiment.

While each of these embodiments uses a single game format, or type, to play from stage to stage, as noted above, it is clearly anticipated that the invention may be used with a first game type as a first stage, with a subsequent stage or stages being of a different game type, e.g., a single line slot stage, then a multi-line slot stage, then a Stud poker stage, then a Bunco dice game, etc. Thus, it should be appreciated that similar or different games of chance may be staged together, and the invention is not limited to the types of games shown here, and would encompass any conceivable other game, such as roulette, craps, baccarat, keno, and so on. It will also be apparent to one of skill in the art how to use the invention in live games with dealers (i.e., table games), notwithstanding the particular embodiments described herein relating to gaming machines.

Bunco

Bunco, sometimes called Bunko, Bonko or Bonco, is a dice game that dates back to the mid 1800's in the United States. While there are many variations that are currently played, what follows are what appear to be very popular rules of the game.

Bunco is typically played in groups of eight to twenty players, usually women and occasionally couples as a social event. A group typically meets once a month, and plays at multiple tables of four players. Players seated across from each other are partners although it is typical to change partners for each game played. Each table has three dice that are passed around from player to player.

The game is played in "rounds". The first round starts with all tables rolling for a "point" of one. The dice move clockwise to each person at the table who gets to roll the dice. A team scores one point for each die that matches the current point (one in this case). Each time one or more dice match the current point, the player's team scores and the player continues to roll. If the player gets all three dice to match on a number other than the current point then that team scores five points and the player continues to roll. If the player gets all three dice to match the current point they yell out "Bunco" and the team is awarded twenty-one points.

Once a player rolls the dice showing no points, the turn ends. Each round continues with the dice going from player to player around the table. The game ends when a player at the first or head table reaches twenty-one points, which is usually indicated by ringing a hand-bell to signal all the tables that the round is over. At this point the players change partners and rotate through the tables based on the winners and losers, and the next game would play with a "point" of two.

This first embodiment of the current invention of this application consists of a dice game that is loosely based on an individual player's turn during a round of Bunco. While this game may be played in a casino with live dealers (as is done with the casino game of Craps) or on a gaming machine that propels real physical dice, the preferred embodiment is on a video gaming machine.

Unlike the version of Bunco described above, in this embodiment there may be up to three points which the player is trying to roll. Instead of being a single number, any number that has been rolled on every stage of the current game is an active point. On the first roll, each number that appears on a die becomes a point, for a possible total of three points if all three dice are different (that is, all six possible numbers are points for the first roll). On the second roll, the player must roll one or more points matching the first roll to keep the game going. Any numbers that were rolled on both the first and second rolls remain points for the third roll. The player continues to roll until no dice match a number found in all previous rolls, or until the highest stage upon which a bet has been placed is rolled.

FIG. 1 shows a display of this embodiment. A maximum of seven stages or rolls of the dice per game is provided. The game may allow more or fewer stages without departing from the invention. Each stage (level) of the game represents a roll of the dice as described above. The player may place a bet on from one to seven stages or lines. The player may bet from one to five coins per stage in this version. Of course, it is anticipated that different numbers of coins per stage could be allowed. Also, the player could be allowed to place bets on different stages at random, rather than from the bottom up. For that matter, the player could be allowed to make different size wagers on different stages at will, without departing from the invention.

Referring to FIG. 1, the "Select Lines" button 100 is pressed to select from one to seven stages to bet on. The "Coins per Line" button 101 is pressed to indicate the number of coins to bet on each line. The player then presses the "Roll Dice" button 102 to roll the dice for the first stage.

Figure 2:
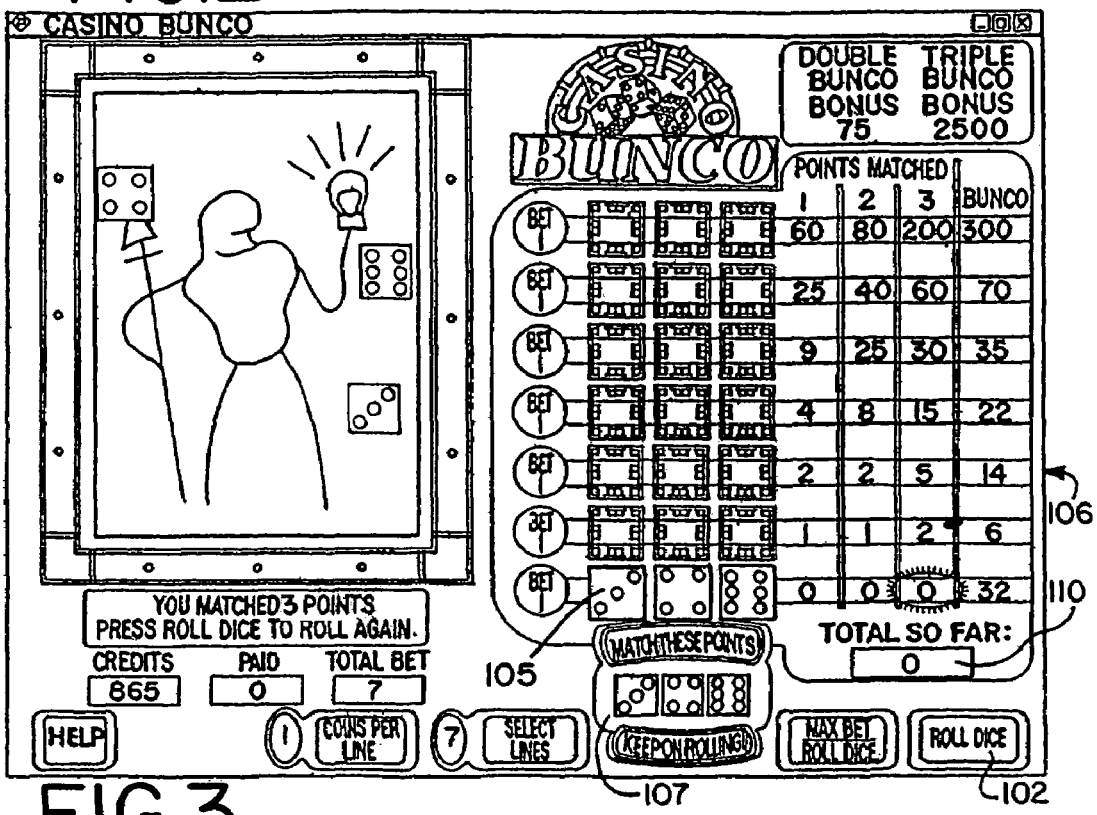
FIG. 2 is a video screen representation highlighting a first stage or roll of the dice of the dice gaming machine embodiment of FIG. 1.

FIG. 2 shows a game in progress after the first roll. This roll of 3-4-6 is placed in the first stage area 105 next to the applicable line of the paytable 106 for that stage (0,0,0,32). For each stage there are four paytable values. These values are for rolling one, two or three points or for rolling "Bunco," which is achieved when all three dice match one number which is an active point. Only the highest value is paid at each stage, so a "Bunco" does not also pay for three points matched. For the first roll (with all six numbers active) any combination of three matching dice is a "Bunco." Scoring a "Bunco" is the only way to win the first level bet, although in this game the player automatically advances to the second stage. It is envisioned that other embodiments could set the active points (selected by either the cpu or the player) in advance of the first roll which would then require a match on the first roll to continue. A first stage "Bunco" awards thirty-two coins. The machine highlights the appropriate paytable value in the "3 points matched" column for this roll and shows the remaining points under the first stage line (107).

Figure 3:
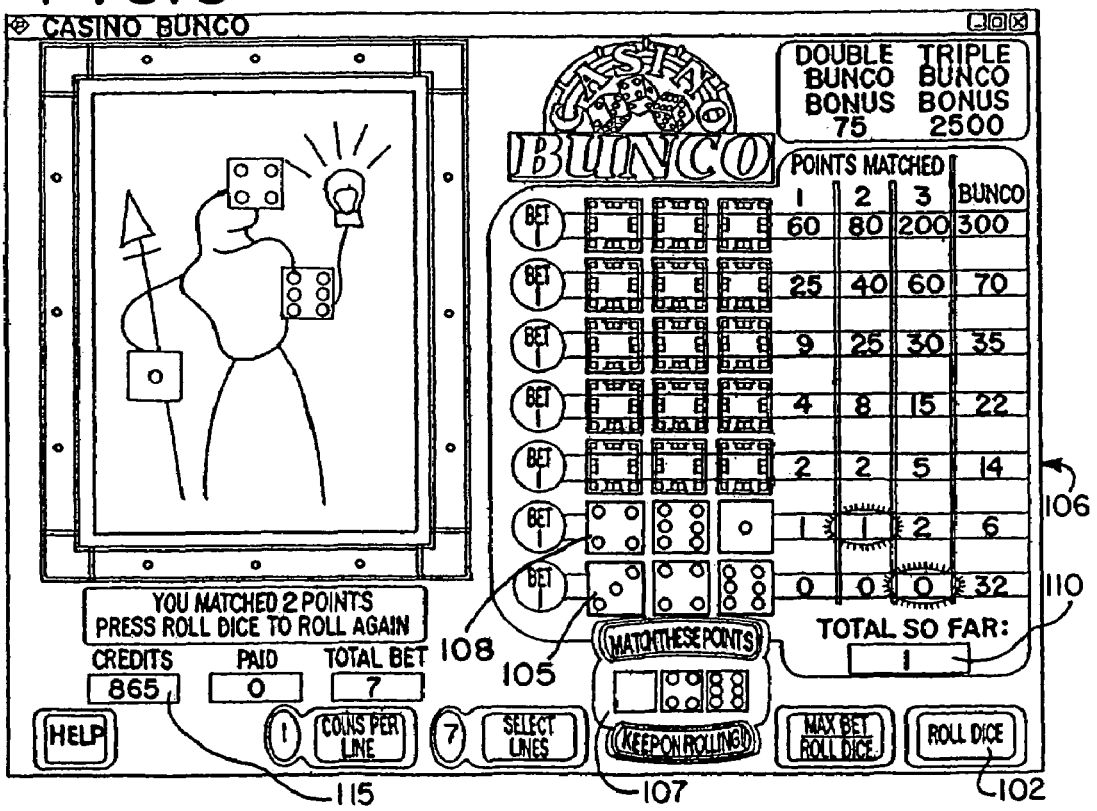
FIG. 3 is a video screen representation of a second stage of the play of the dice gaming machine embodiments of FIG. 1.

The player presses the "Roll Dice" button 102 for the second stage, and a possible result is shown in FIG. 3. The roll of 1-4-6 matches two of the three points that were established in the first roll. Thus, the points "4" and "6" remain "alive," i.e., in play (107). The point of "3" from the first roll is no longer alive because it does not appear in the second roll. The three dice are placed on the second stage line 108 next to the applicable paytable 106 values for that stage. The game highlights the "2 points matched" value in the paytable indicating that one coin is awarded for matching two points on the second stage. The "Total So Far" meter 110 is updated to show the total of one coin won at this point (zero coins on the first stage and one coin on the second stage). The window 107 under the first stage now shows that only the "4" and the "6" remain as active points.

Figure 4:
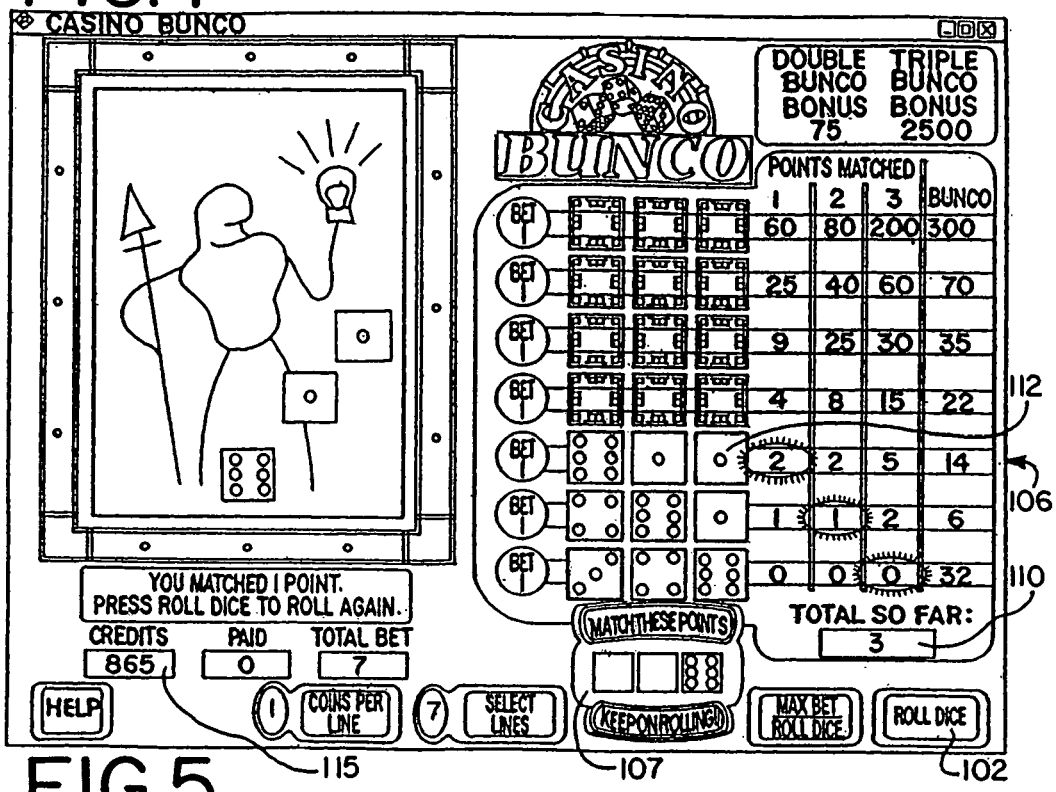
FIG. 4 is a video screen representation of a third stage of the play of the dice gaming machine embodiment of FIG. 1.

The player presses the "Roll Dice" button 102 for the third stage and a possible result is shown in FIG. 4. The roll of 1-1-6 matches one of the two points that were alive after the second roll. Thus, only the point "6" remains alive (107). The point of "4" from the first two rolls is no longer alive because it does not appear in the third roll. The three dice are placed on the third stage line 112 next to the paytable values for that stage. The game highlights the "1 point matched" value in the paytable indicating that two coins are awarded for matching one point on the third stage. The "Total So Far" meter 110 is updated to show the total of three coins won at this point (zero coins on the first stage, one coin on the second stage and two coins on the third stage). The window 107 under the first stage now shows that only the "6" remains as an active point.

Figure 5:
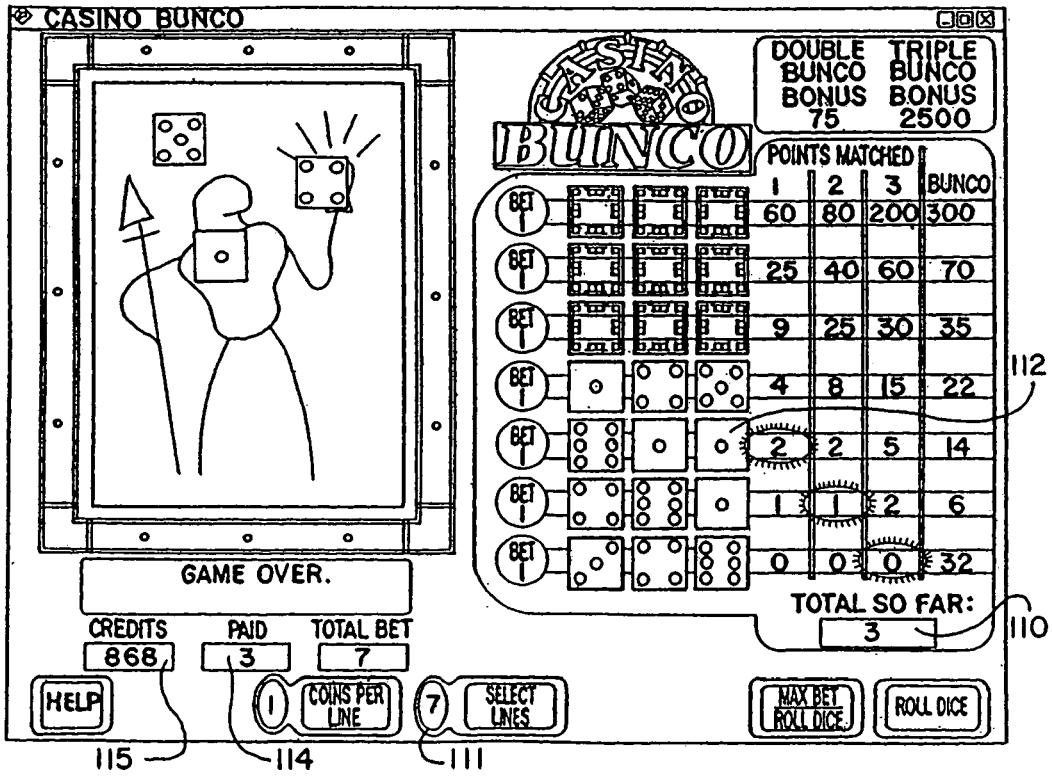
FIG. 5 is a video screen representation of a fourth stage of the play of the dice gaming machine embodiment of FIG. 1.

The player presses the "Roll Dice" button 102 for the fourth stage and a possible result is shown in FIG. 5. The roll of 1-4-5 does not match the point of "6," which was the only point left alive. While "4" was an active point after the first two rolls, the absence of a "4" on the third roll took it out of play as a point, and thus was of no value in the fourth roll. As a result of matching no points the game is over. The "Total So Far" meter 110 value of three coins is copied to the "Paid" window 114, and this is added to the credits counter 115 taking it from an arbitrary "865" to "868" credits.

It should be noted that in the example shown, the bets for levels above the fourth level were lost without those levels being played. As is intuitive and will be shown in the following analysis, the higher the level, the less often it will be played. This is offset by offering the player very large awards for very modest events on these higher levels when they are played.

This Bunco embodiment is an ongoing game with stages that, as a result of the nature of the game, also involve multi-stage betting working with an evolving game. This game is not limited to advancing to the next stage only with a win, since the game will always play the second stage if two or more stages have been bet upon, even though, except for a first stage "Bunco", the player will not win on the first stage.

Figure 6:
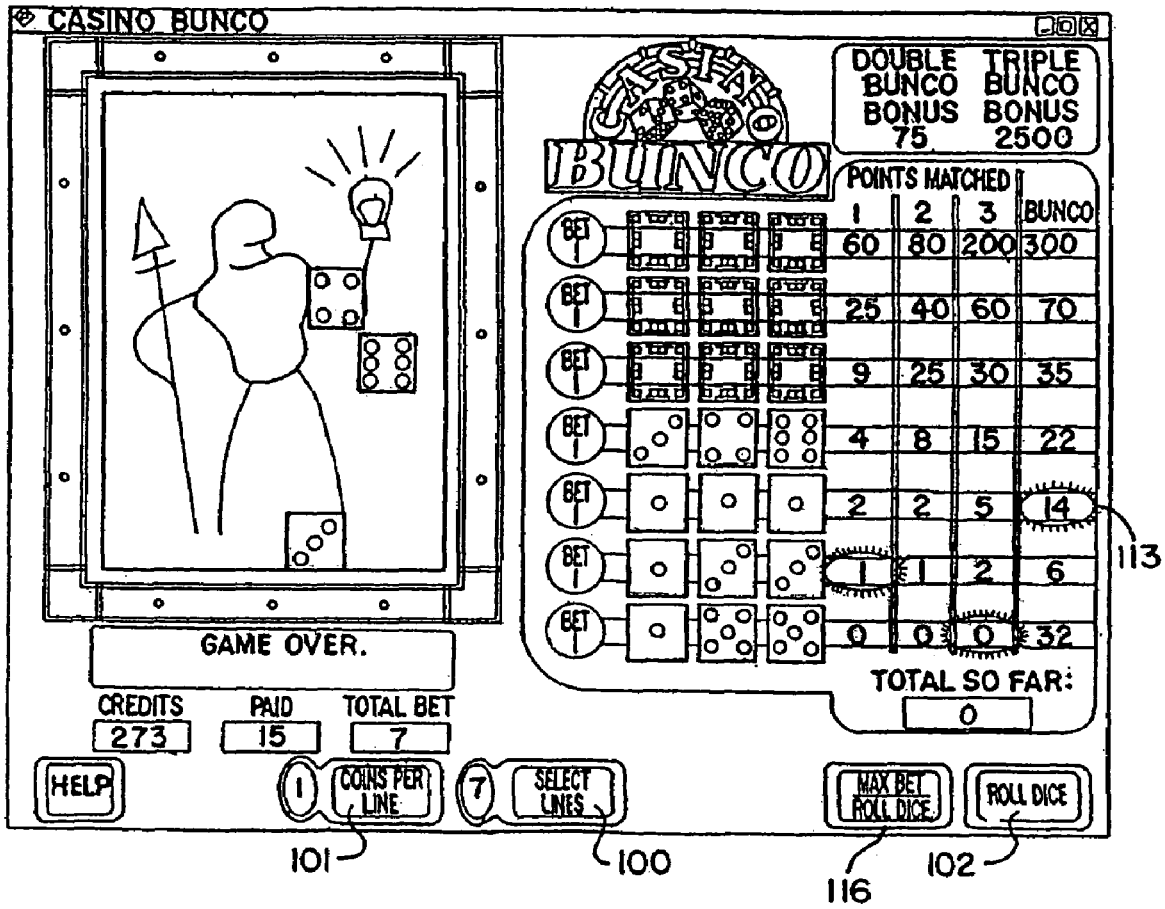
FIG. 6 is another video screen representation of the dice gaming machine embodiment of FIG. 1.

FIG. 6 shows another Bunco game at its conclusion. The first roll of 1-5-5 established only two points as a result of the duplicate 5's. The second roll of 1-3-3 kept only the point of "1" alive. The third roll of 1-1-1 is "Bunco" scoring fourteen coins. The fourth roll of 3-4-6 does not match the point of "1", and thus ends the game. A total of fifteen coins were won on this game (one for matching one point on the second stage and fourteen for "Bunco" on the third stage).

Looking at FIG. 6, the "Max Bet/Roll Dice" button 116 is also seen. This button 116 establishes the maximum bet, which in this embodiment is thirty-five coins, (seven stages times five coins per stage) and then rolls the dice for the first stage. Pressing this button 116 is the same as pressing the "Select Lines" button 100 until seven lines are selected, and then pressing the "Coins per Line" button 101 until five coins per line are selected, and then finally pressing the "Roll Dice" button 102 to roll the dice for the first stage.

Shown in the upper right section of FIG. 6 are the bonuses for games that achieve two "Buncos" and three "Buncos": "75" coins and "2500" coins respectively. These bonuses add excitement to the game, as well as the opportunity to win a more sizable award than is available from the seven stages of the game.

Figure 7A:
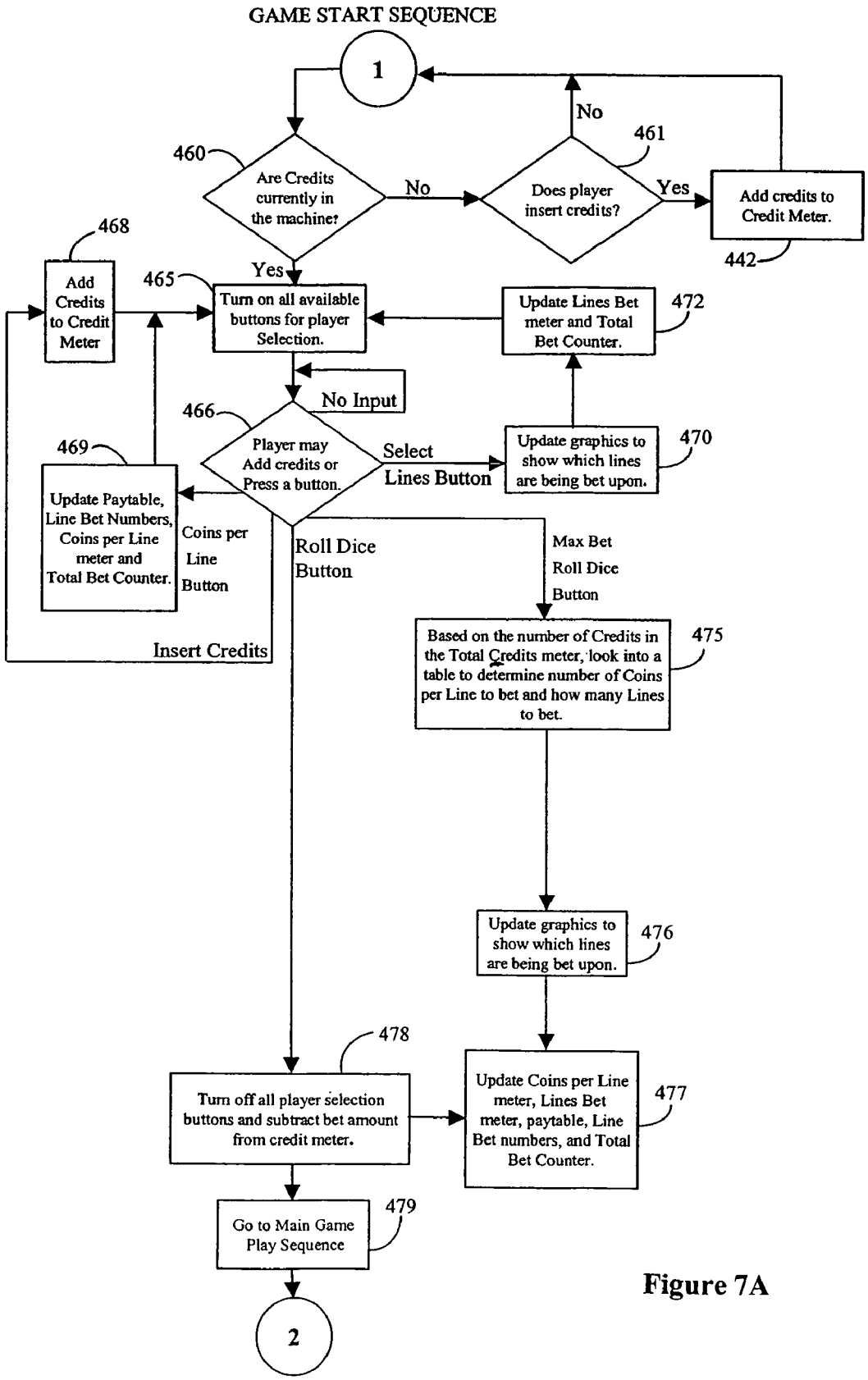
FIGS. 7A-7D present flow charts for a method of operating a video dice gaming machine of the embodiment of FIG. 1.

The foregoing Bunco gaming machine is operationally summarized in the flow charts of FIGS. 7A through 7D. FIG. 7A generally describes the start-up of the Multi-Strike BUNCO game embodiment. First, an assessment of whether credit(s) are present is undertaken beginning at step 460. If none is present, then a check is made as to whether the player has inserted the relevant coin, credit card, etc., for the necessary credit(s) at step 461. If so, then at step 462 the credit(s) are registered and displayed at the "Credits" meter 115 (e.g., FIG. 1). All available player buttons are then activated for initiation of play at 465.

At this stage, the player enters a set-up loop where the player may choose to add more credits or proceed with play at step 466. If credits are added, these are registered on the meter display (115) at step 468. The program loops back to step 465.

The "Coins Per Line" button 101 can alternatively be engaged from step 466, causing the coins-per-line setting to be modified (as indicated at meter 103, FIG. 1), as well as updating the value of the "Total Bet" window 104, and the paytable information window 106, all as indicated at step 469. Once again, the program loops back to step 465.

Back at step 466, the player can choose the "Select Lines" button 100 to input this aspect of his or her wager. Graphics are updated at step 470 to highlight the lines which are now "active" (i.e., potentially playable). This likewise causes the lines bet meter 111 and "Total Bet" 104 to be so modified, all as indicated at step 472. The program once again loops back to step 465.

Once the player has input the parameters of the wager, then the "Roll Dice" button 102 is engaged. It should be noted that the foregoing selection sequence as to coins and lines to bet need not follow the order indicated.

The player has the option of skipping all of the lines and coins-per-line selections, through resort to the "Max Bet Roll Dice" button 116 (FIG. 6). A subroutine will then execute at step 475 to assess the total credits the player has provided, and determine the maximum number of coins per line and the maximum number of lines (per an embedded look-up table) which can be played for that credit quantity, up to a fixed maximum for the game. The graphics are updated accordingly at steps 476 and 477 to show the lines being bet, coins-per-lines and total bet (as at steps 469, 470 and 472). Either out of step 477 or after actuation of the "Roll Dice" button 102, the player selection buttons are deactivated (step 478), the sum of the wager is subtracted from the "Credits" meter 115 and the new amount is displayed. The game then progresses to a main play sequence (step 479).

Figure 7B:
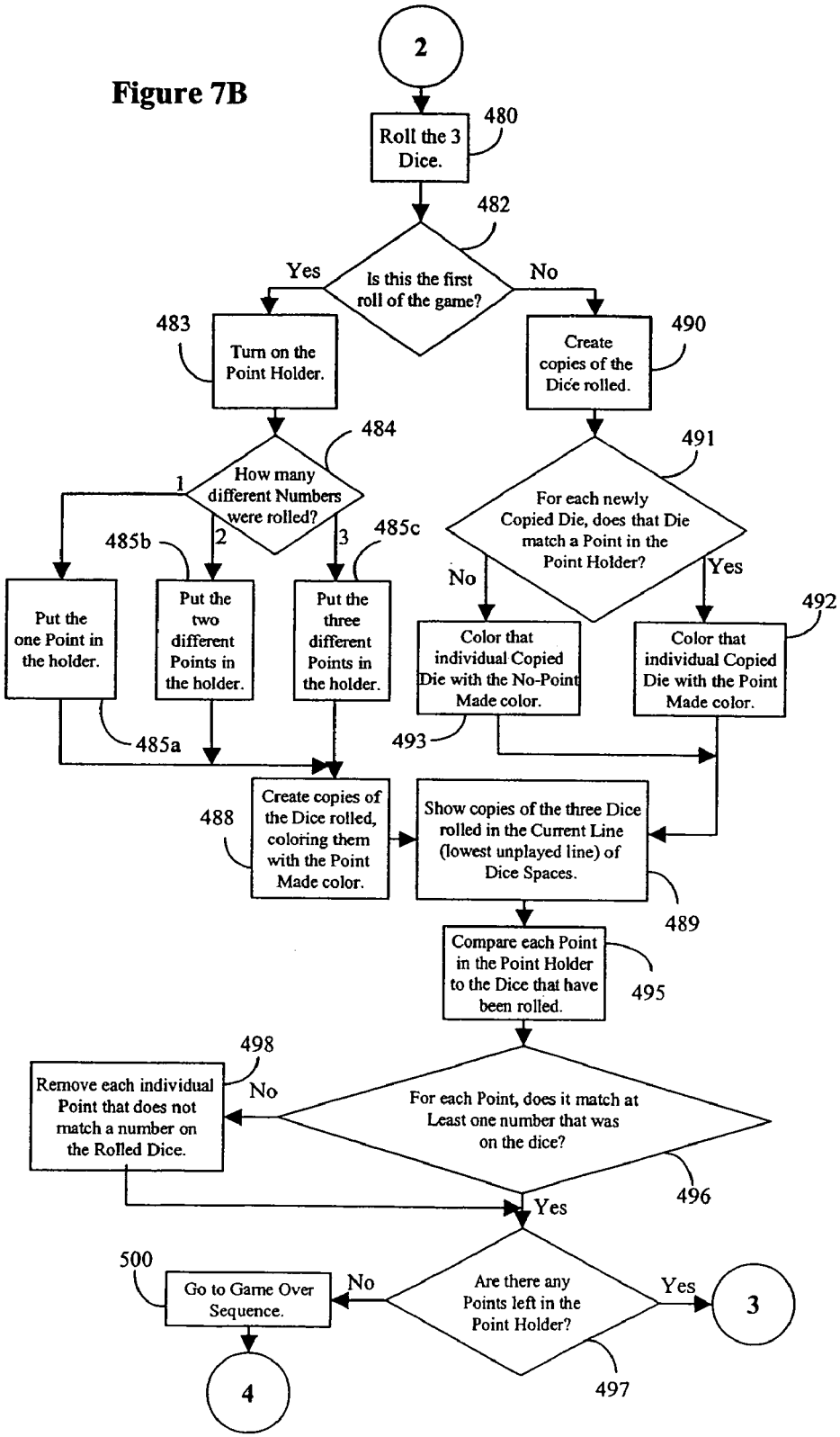

The dice are rolled at step 480, as shown in FIG. 7B. The program assesses whether this is the first roll of the game (step 482). If it is the first roll, then "Match These POINTS"

window 107 (e.g., see FIG. 2) is activated at step 483, and a determination is made as to how many different numbers are presented by the rolled dice (step 484). The different "Points" are then displayed in the window 107, depending on whether there are one, two or three different numbers (steps 485*a* through 485*c*). The graphics of the program generates copies of the dice rolled, with a color hue to indicate a "Point Made" at step 488, and the dice are displayed in the current stage/level/roll (step 489), which here is the first level 105.

If this is not the first roll of the game (step 482), then copies of the dice just rolled are generated at step 490. The program executes a comparison of the numbers (dice) in the window 107 (which are the Points to match), with the dice just rolled at step 491. If there is a match, the graphics of the program colors a copy (or copies) of the matching die rolled with a hue to indicate a "Point Made" at step 492. For each match not made, the die (dice) is colored with a hue to indicate that no match/Point was made (step 493), and the dice are displayed as so hued in the current stage/level/roll (step 489).

From step 489, another comparison is then made at step 495 between the current roll and the Point(s) to be matched/made. Each Point in the window 107 is assessed as to a match on a die (number) of the current roll at step 496. If at step 496 there is no match for a Point, it is removed from the game and the graphics of window 107 are updated accordingly, at step 498. The program then assesses whether there is any Point remaining (step 497), and the game proceeds to a "Bunco" determination if the answer to the foregoing is positive. If there are no Points remaining (window 107), the player is passed to a "Game Over" sequence at step 500.

Figure 7C:
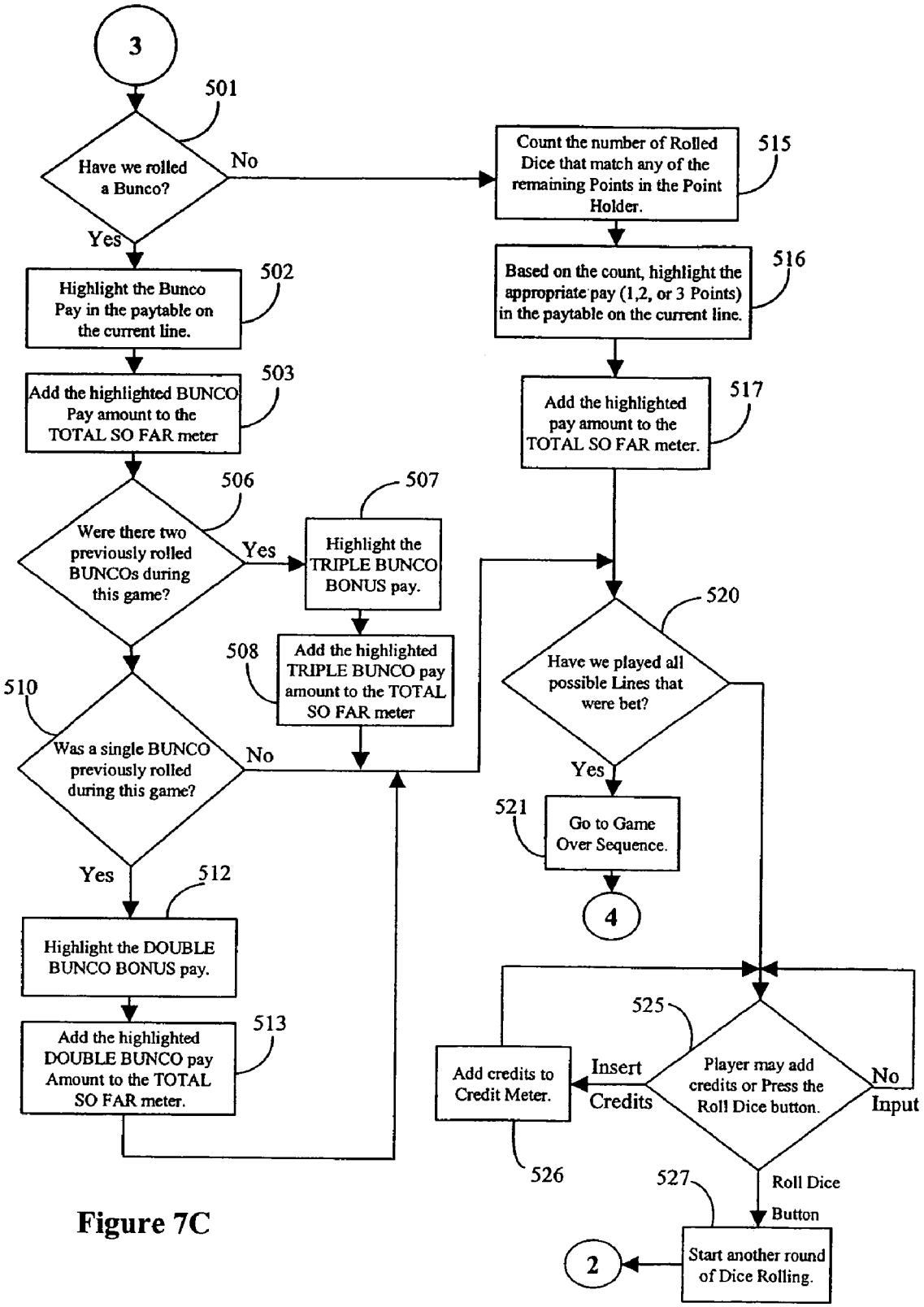

The "Bunco" assessment is set forth in FIG. 7C. The program first assesses whether a "Bunco" has been rolled at step 501. If the evaluation is positive, then the graphics highlight the "BUNCO" pay (see, e.g., 113 in FIG. 6) for the current level (step 502). That "BUNCO" pay amount is added to the "Total So Far" meter 110 at step 503.

The program then determines whether two "Bunco's" had previously been rolled in the same game at step 506. If "yes," then the "Triple BUNCO BONUS" is highlighted on the screen (step 507), and the predetermined amount for that bonus is added to the "Total So Far" meter 110 at step 508.

If two "Bunco's" have not been registered at step 506, the program makes a determination as to whether one "Bunco" had previously been scored at step 510. If "yes," then the "Double BUNCO BONUS" is highlighted on the screen (step 512), and the predetermined amount for that bonus is added to the "Total So Far" meter 110 at step 513.

Back at step 501, if a "Bunco" has not been rolled, then a count is made of the number of rolled dice that match any of the remaining Points in the window 107 (step 515). That count is used to highlight the appropriate pay for that level for that number of points in the paytable information window as indicated at step 516. That amount is added to the meter 110 at step 517.

Out of either step 508, 510, 513 or 517, the player then advances to step 520, which is a program assessment as to whether all lines that have been bet on have been played. If all have been played, then the game is over and the "Game Over" sequence is engaged out of step 521.

If all possible lines have not been played, then the player is given the option of adding more credits and/or continuing through actuation of the "Roll Dice" button 102 at step 525. If the choice is to add credits, then the "Credits" meter is so updated at step 526, and the player is looped back to step 525. If the choice is to roll, then another round is started (step 527) upon actuation of the button 102, whereupon the sequence of events beginning at step 480 recommences.

Figure 7D:
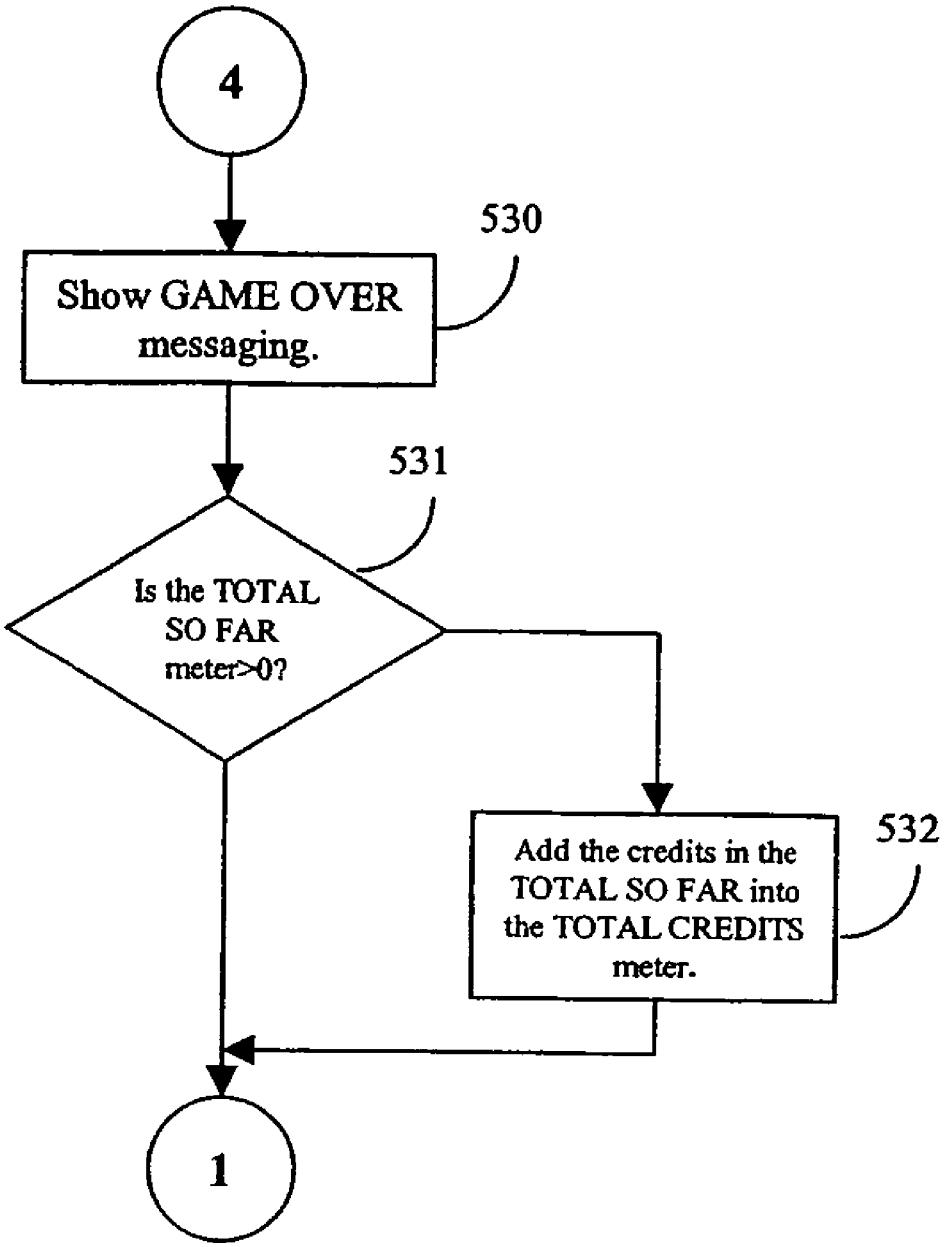

Once all lines have been played or there are no Points left in the window 107 (i.e., no match at a level), then the "Game Over" sequence of FIG. 7D is engaged. A "GAME OVER" message is displayed at step 530, and a determination is made as to whether the "Total So Far" meter 110 shows any credits (i.e., any winnings for the game) at step 531. Any winnings as shown in meter 110 are then added to the total "Credits" meter 115 (step 532), and the player and the program are returned to the game start sequence at step 460.

Analysis of Certain Architecture of the Bunco Embodiment

The mathematical payout percentage of this embodiment is determined by breaking down the different possible combinations for each of the seven stages. This will be done for one coin per line only, as it is well known by those skilled in the art how to expand this result for multiple coins per line, as well as the inclusion of bonus values, if desired. The first stage is fairly easy to analyze. There are three possible types of outcome of the first roll: "Bunco" (equivalent to one point established), two points established or three points established. There are two hundred and sixteen possible combinations of three dice computed by multiplying the possible combinations of each die: 6×6×6=216. The number of occurrences of "Bunco" or three dice that match are six. This is computed as 6×1×1 because the first die can take any of the six numbers, then the second die must match that number and the third die must also match that number. Three points are established when all three of the dice have a different number showing, and is computed by 6×5×4=120 because the first die can take on any value while the second die can take on any of the five remaining values that don't match the first die, and the third die can then take on any of the remaining values that don't match the first two dice.

This leaves ninety occurrences of a combination that results in two points (216−6−120=90). The ninety occurrences of two points can also be computed directly as follows: There are three forms that a roll resulting in two points may take: XYX, XXY or YXX. The combinations for these are as follows:

| | |
|---|---|
| XYX = 6 × 5 × 1 = 30 | First can be any, second must not match first, third must match first. |
| XXY = 6 × 1 × 5 = 30 | First can be any, second must match first, third must not match first. |
| YXX = 5 × 6 × 1 = 30 | First can be any but X, second can be any, third must match second. |

Table 1 organizes the data described above. The first column indicates the number of points established by the first roll. The second column shows the value paid for that result. The third column shows the "Occurrences" of that result which was determined above. The fourth column is the probability of that result, which is the occurrence count divided by 216, the number of possible outcomes. The fifth column is the Expected Value component from each pay, which is the product of the paytable value times the probability of receiving that value. The sum of all EV components is the expected return of the stage, which is 88.89%. If only stage one was played, then the expected return to the player would be 88.89%. The payout percentage may be modified by making a change to the second column "Pay" value, which would also change in the paytable. For example, changing the pay for "Bunco" (one point established) from "32" to "33" would result in a 91.67% expected return. Unlike the slot machine example of U.S. patent application Ser. No. 09/709,922, the "Occurrence" data is locked into the rules of the game, and any change to the payout will be apparent to the player. It must be done by modifying the paytable as described above, or by changing the rules of the game.

TABLE 1

| Number of Points | Pay | Occurrences | Probability | EV |
|---|---|---|---|---|
| 1 | 32 | 6 | 0.027777778 | 0.888889 |
| 2 | 0 | 90 | 0.416666667 | 0 |
| 3 | 0 | 120 | 0.555555556 | 0 |
| | | 216 | 1 | 0.888889 |

The second stage of the game has three separate analyses based on the number of points established in the first stage of the game. The "Occurrences" for each row in Table 2 (the fourth column) are calculated in the same manner as shown for the first stage and will not be elaborated on further. The first column of Table 2 states the number of points alive at the start of the second stage. This table has three separate analyses based on whether one, two or three points were alive at the start of the second stage.

The second column shows the combination being enumerated. The three possible points are called "A", "B" and "C". "x" indicates a die that matches no point. The "Comb. Column" shows the makeup of the dice for that line of the table. For example, AAA is three dice matching point "A". The BBA is two dice matching point "B" and one die matching point "A", and this can occur in any order. The third column indicates the amount paid for the specified combination. This is based on the second stage paytable line of 1, 1, 2, 6 (e.g., FIG. 3) awarding one coin for matching one or two points, two coins for matching three points in a non-"Bunco" combination and six coins for all three dice matching the same point ("Bunco"). The fourth column indicates the number of occurrences of the specified combination out of the possible two hundred and sixteen combinations. The fifth column is the probability of that occurrence and is the quotient of the occurrences and the two hundred and sixteen possible combinations. The sixth column is called "Probability of Start Condition". This is the probability of starting the second stage with the number of points shown in the first column. This number is taken directly from Table 1.

The seventh column is the probability of the specified "Result" occurring, which is the product of the fifth and sixth columns. This result is due to the need for the probability of the sixth column to start the stage with the number of points specified in the first column, as well as the need for the probability of the combination, which is given in the fifth column.

The eighth column is the expected value contribution from this combination which is computed as the product of the "Pay" value times the seventh column "Probability of this Result". The sum of all values in the eighth column provides the expected return which is 92.28%.

The ninth column is the number of points still alive after the roll. This is represented by the number of unique capitalized letters in the second column combination.

The last four columns are used to determine the probability of the number of points alive at the end of the stage. The seventh column "Probability of This Result" value is copied to the column that corresponds to the ninth column "Points Alive" number. For example, for AAA there is one point alive which results in the 0.00013 value to be copied from the seventh column to the eleventh column, which is the column that calculates the "Probability that Points Left =1".

The bolded numbers at the bottom of the last four columns of Table 2 tally the probability of ending the second round with the number of Points specified at the head of the column. For example, of the games that play a second stage (which is all games in this embodiment), 24.31% will finish the second stage with two points active.

TABLE 2

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 1 | AAA | 6 | 1 | 0.00462963 | 0.02777778 | 0.000129 | 0.000772 | 1 | | 0.00013 | | |
| 1 | AAx | 1 | 15 | 0.06944444 | 0.02777778 | 0.001929 | 0.001929 | 1 | | 0.00193 | | |
| 1 | Axx | 1 | 75 | 0.34722222 | 0.02777778 | 0.009645 | 0.009645 | 1 | | 0.00965 | | |
| 1 | xxx | 0 | 125 | 0.5787037 | 0.02777778 | 0.016075 | 0 | 0 | 0.01608 | | | |
| | | | 216 | 1 | | | | | | | | |
| 2 | AAA | 6 | 1 | 0.00462963 | 0.41666667 | 0.001929 | 0.011574 | 1 | | 0.00193 | | |
| 2 | BBB | 6 | 1 | 0.00462963 | 0.41666667 | 0.001929 | 0.011574 | 1 | | 0.00193 | | |
| 2 | AAB | 2 | 3 | 0.01388889 | 0.41666667 | 0.005787 | 0.011574 | 2 | | | 0.00579 | |
| 2 | BBA | 2 | 3 | 0.01388889 | 0.41666667 | 0.005787 | 0.011574 | 2 | | | 0.00579 | |
| 2 | AAx | 1 | 12 | 0.05555556 | 0.41666667 | 0.023148 | 0.023148 | 1 | | 0.02315 | | |
| 2 | BBx | 1 | 12 | 0.05555556 | 0.41666667 | 0.023148 | 0.023148 | 1 | | 0.02315 | | |
| 2 | ABx | 1 | 24 | 0.11111111 | 0.41666667 | 0.046296 | 0.046296 | 2 | | | 0.0463 | |
| 2 | Axx | 1 | 48 | 0.22222222 | 0.41666667 | 0.092593 | 0.092593 | 1 | | 0.09259 | | |
| 2 | Bxx | 1 | 48 | 0.22222222 | 0.41666667 | 0.092593 | 0.092593 | 1 | | 0.09259 | | |
| 2 | xxx | 0 | 64 | 0.2962963 | 0.41666667 | 0.123457 | 0 | 0 | 0.12346 | | | |
| | | | 216 | 1 | | | | | | | | |
| 3 | AAA | 6 | 1 | 0.00462963 | 0.55555556 | 0.002572 | 0.015432 | 1 | | 0.00257 | | |
| 3 | BBB | 6 | 1 | 0.00462963 | 0.55555556 | 0.002572 | 0.015432 | 1 | | 0.00257 | | |
| 3 | CCC | 6 | 1 | 0.00462963 | 0.55555556 | 0.002572 | 0.015432 | 1 | | 0.00257 | | |
| 3 | AAB | 2 | 3 | 0.01388889 | 0.55555556 | 0.007716 | 0.015432 | 2 | | | 0.00772 | |
| 3 | AAC | 2 | 3 | 0.01388889 | 0.55555556 | 0.007716 | 0.015432 | 2 | | | 0.00772 | |
| 3 | BBA | 2 | 3 | 0.01388889 | 0.55555556 | 0.007716 | 0.015432 | 2 | | | 0.00772 | |
| 3 | BBC | 2 | 3 | 0.01388889 | 0.55555556 | 0.007716 | 0.015432 | 2 | | | 0.00772 | |
| 3 | CCA | 2 | 3 | 0.01388889 | 0.55555556 | 0.007716 | 0.015432 | 2 | | | 0.00772 | |

TABLE 2-continued

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 3 | CCB | 2 | 3 | 0.01388889 | 0.55555556 | 0.007716 | 0.015432 | 2 | | | 0.00772 | |
| 3 | ABC | 2 | 6 | 0.02777778 | 0.55555556 | 0.015432 | 0.030864 | 3 | | | | 0.01543 |
| 3 | ABx | 1 | 18 | 0.08333333 | 0.55555556 | 0.046296 | 0.046296 | 2 | | | 0.0463 | |
| 3 | ACx | 1 | 18 | 0.08333333 | 0.55555556 | 0.046296 | 0.046296 | 2 | | | 0.0463 | |
| 3 | BCx | 1 | 18 | 0.83333333 | 0.55555556 | 0.046296 | 0.046296 | 2 | | | 0.0463 | |
| 3 | AAx | 1 | 9 | 0.04166667 | 0.55555556 | 0.023148 | 0.023148 | 1 | | 0.02315 | | |
| 3 | BBx | 1 | 9 | 0.04166667 | 0.55555556 | 0.023148 | 0.023148 | 1 | | 0.02315 | | |
| 3 | CCx | 1 | 9 | 0.04166667 | 0.55555556 | 0.023148 | 0.023148 | 1 | | 0.02315 | | |
| 3 | Axx | 1 | 27 | 0.125 | 0.55555556 | 0.069444 | 0.069444 | 1 | | 0.06944 | | |
| 3 | Bxx | 1 | 27 | 0.125 | 0.55555556 | 0.069444 | 0.069444 | 1 | | 0.06944 | | |
| 3 | Cxx | 1 | 27 | 0.125 | 0.55555556 | 0.069444 | 0.069444 | 1 | | 0.06944 | | |
| 3 | xxx | 0 | 27 | 0.125 | 0.55555556 | 0.069444 | 0 | 0 | 0.06944 | | | |
| | | | 216 | 1 | | | | | | | | |
| | | | | | EV of second Stage: | | 0.92284 | | | | | |
| | | | | | Prob. Of Start Cond. For Next Stage | | | | 0.20898 | 0.53254 | 0.24306 | 0.01543 |
| | | | | | Total of 4 probability values above | | | | | | | 1 |

Table 3 provides a similar analysis for the third stage of the game. The first two columns are the same. The third column has been modified to reflect the 2-2-5-14 (e.g., FIG. 4) paytable values for the third stage. The fourth column is the same as Table 2.

The fifth column uses the "Probability of Start Condition" for the specified number of points taken from the bottom of Table 2. Those numbers at the bottom of Table 2 show the probability of ending the second stage with zero, one, two or three points. The values in the rest of the columns are calculated in the same manner as was described for Table 2.

Looking at the sum of the "EV" column, it is clear that the expected return for the third stage of the game is 90.24%. The right four columns are used to compute the probability of zero, one, two or three points remain alive after the third stage. Note that the sum of these probability values does not total 1.0, but rather 0.79102. The additional component is the 0.20898 found at the bottom of Table 2 under "Probability that Points Left=0". This represents games that ended after two stages and thus are not reflected in the stage three ending breakdown. In the same manner, the 0.3821 probability of ending the game in the third stage will not be included in the stage four ending breakdown.

The analysis for stages four through seven is done in a manner identical to stage three. The comparable tables for these stages are therefore not shown.

TABLE 3

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 1 | AAA | 14 | 1 | 0.00462963 | 0.532536 | 0.0024654 | 0.0345162 | 1 | | 0.0025 | | |
| 1 | AAx | 2 | 15 | 0.06944444 | 0.532536 | 0.0369817 | 0.0739633 | 1 | | 0.037 | | |
| 1 | Axx | 2 | 75 | 0.34722222 | 0.532536 | 0.1849083 | 0.3698167 | 1 | | 0.1849 | | |
| 1 | xxx | 0 | 125 | 0.5787037 | 0.532536 | 0.3081806 | 0 | 0 | 0.3082 | | | |
| | | | 216 | 1 | | | | | | | | |
| 2 | AAA | 14 | 1 | 0.00462963 | 0.2430556 | 0.0011253 | 0.0157536 | 1 | | 0.0011 | | |
| 2 | BBB | 14 | 1 | 0.00462963 | 0.2430556 | 0.0011253 | 0.0157536 | 1 | | 0.0011 | | |
| 2 | AAB | 5 | 3 | 0.01388889 | 0.2430556 | 0.0033758 | 0.0168789 | 2 | | | 0.0034 | |
| 2 | BBA | 5 | 3 | 0.01388889 | 0.2430556 | 0.0033758 | 0.0168789 | 2 | | | 0.0034 | |
| 2 | AAx | 2 | 12 | 0.05555556 | 0.2430556 | 0.0135031 | 0.0270062 | 1 | | 0.0135 | | |
| 2 | BBx | 2 | 12 | 0.05555556 | 0.2430556 | 0.0135031 | 0.0270062 | 1 | | 0.0135 | | |
| 2 | ABx | 2 | 24 | 0.11111111 | 0.2430556 | 0.0270062 | 0.0540123 | 2 | | | 0.027 | |
| 2 | Axx | 2 | 48 | 0.22222222 | 0.2430556 | 0.0540123 | 0.1080247 | 1 | | 0.054 | | |
| 2 | Bxx | 2 | 48 | 0.22222222 | 0.2430556 | 0.0540123 | 0.1080247 | 1 | | 0.054 | | |
| 2 | xxx | 0 | 64 | 0.2962963 | 0.2430556 | 0.0720165 | 0 | 0 | 0.072 | | | |
| | | | 216 | 1 | | | | | | | | |
| 3 | AAA | 14 | 1 | 0.00462963 | 0.0154321 | 7.144E−05 | 0.0010002 | 1 | | 7E−05 | | |
| 3 | BBB | 14 | 1 | 0.00462963 | 0.0154321 | 7.144E−05 | 0.0010002 | 1 | | 7E−05 | | |
| 3 | CCC | 14 | 1 | 0.00462963 | 0.0154321 | 7.144E−05 | 0.0010002 | 1 | | 7E−05 | | |
| 3 | AAB | 5 | 3 | 0.01388889 | 0.0154321 | 0.0002143 | 0.0010717 | 2 | | | 0.0002 | |
| 3 | AAC | 5 | 3 | 0.01388889 | 0.0154321 | 0.0002143 | 0.0010717 | 2 | | | 0.0002 | |
| 3 | BBA | 5 | 3 | 0.01388889 | 0.0154321 | 0.0002143 | 0.0010717 | 2 | | | 0.0002 | |
| 3 | BBC | 5 | 3 | 0.01388889 | 0.0154321 | 0.0002143 | 0.0010717 | 2 | | | 0.0002 | |
| 3 | CCA | 5 | 3 | 0.01388889 | 0.0154321 | 0.0002143 | 0.0010717 | 2 | | | 0.0002 | |
| 3 | CCB | 5 | 3 | 0.01388889 | 0.0154321 | 0.0002143 | 0.0010717 | 2 | | | 0.0002 | |
| 3 | ABC | 5 | 6 | 0.02777778 | 0.0154321 | 0.0004287 | 0.0021433 | 3 | | | | 0.00043 |
| 3 | ABx | 2 | 18 | 0.08333333 | 0.0154321 | 0.001286 | 0.002572 | 2 | | | 0.0013 | |

TABLE 3-continued

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 3 | ACx | 2 | 18 | 0.08333333 | 0.0154321 | 0.001286 | 0.002572 | 2 | | | 0.0013 | |
| 3 | BCx | 2 | 18 | 0.08333333 | 0.0154321 | 0.001286 | 0.002572 | 2 | | | 0.0013 | |
| 3 | AAx | 2 | 9 | 0.04166667 | 0.0154321 | 0.000643 | 0.001286 | 1 | | 0.0006 | | |
| 3 | BBx | 2 | 9 | 0.04166667 | 0.0154321 | 0.000643 | 0.001286 | 1 | | 0.0006 | | |
| 3 | CCx | 2 | 9 | 0.04166667 | 0.0154321 | 0.000643 | 0.001286 | 1 | | 0.0006 | | |
| 3 | Axx | 2 | 27 | 0.125 | 0.0154321 | 0.001929 | 0.003858 | 1 | | 0.0019 | | |
| 3 | Bxx | 2 | 27 | 0.125 | 0.0154321 | 0.001929 | 0.003858 | 1 | | 0.0019 | | |
| 3 | Cxx | 2 | 27 | 0.125 | 0.0154321 | 0.001929 | 0.003858 | 1 | | 0.0019 | | |
| 3 | xxx | 0 | 27 | 0.125 | 0.0154321 | 0.001929 | 0 | 0 | 0.0019 | | | |
| | | | 216 | 1 | | | | | | | | |
| | | | | | EV of third Stage: | | 0.9023574 | | | | | |
| | | | | | Prob. Of Start Cond. For Next Stage | | | | 0.3821 | 0.3696 | 0.0389 | 0.00043 |
| | | | | | Total of 4 probability values above | | | | | | | 0.79102 |

The analysis provided thus far does not include the bonuses for two "Buncos" and three "Buncos" occurring in the same game. The probability of getting a second or third "Bunco" in a game must be analyzed on a stage by stage basis, with the expected value of such awards added to the EV of the stage in which the bonus occurs.

A double "Bunco" award is given on a particular stage when the second "Bunco" in a game is achieved in that stage. It is not possible to get a double "Bunco" in the first stage. In the second stage, the only way to achieve a double "Bunco" bonus is to roll a "Bunco" on each of the first two stages. On the third stage, one could get "Bunco" on the first and third stage, or the second and third stage (the first and second stage is the case noted above of getting a double "Bunco" on the second stage). The shorthand xBB is used to indicate no "Bunco" on the first stage followed by "Bunco" on the second and third stages, while similarly BxB indicates "Bunco" on the first and third stages with no "Bunco" on the second stage.

Table 4 shows the combinations that will result in a double "Bunco" on the seventh stage. Note that all combinations must have the second "Bunco" occur as the seventh stage because if the second "Bunco" occurred earlier then it would be attributed to the earlier stage.

TABLE 4

| |
|---|
| BxxxxxB |
| xBxxxxB |
| xxBxxxB |
| xxxBxxB |
| xxxxBxB |
| xxxxxBB |

Working through the cases in Table 4, it is found that as a result of symmetry, the probability of each of these components to a seventh level double "Bunco" is identical. Likewise, there are five ways of identical probability to achieve a sixth level double "Bunco" bonus and the two ways mentioned above to achieve a third level double "Bunco" bonus have identical probability.

In order to compute the probability of the required components, there is a need to use three values that were computed earlier. In Table 1, the probability of a "Bunco" on the first roll is shown to be 0.027777778. The "x" components in the first line of Table 4 is the probability of staying alive in a game that has established one point, by rolling anything but a "Bunco". This is found by taking the second and third lines of Table 2 (AAx and Axx) and adding the probability of those rolls (fourth column), which results in a total of 0.416666667. Finally, there is the probability of rolling a "Bunco" while one point is alive. This is shown in the first line of Table 2 (AAA) as 0.00462963. Using these values, one may construct the double "Bunco" probability table of Table 5.

The first column of Table 5 shows the game "Stage" for which the probability of double "Bunco" is being computed. The second column is the "Number of Forms" a double "Bunco" may take on that stage (such as the six forms shown for the seventh stage in Table 4). The third column shows the "Sample Form" being computed for the stage. The fourth through tenth columns are the probability components matching the respective letters in the third column forms. The eleventh column is the "Probability" of getting a double "Bunco" on that level which is the product of the second column form count and all probability components ("Comp." 1 through 7).

TABLE 5

| Stage | Number of Forms | Sample Form | Comp. 1 | Comp. 2 | Comp. 3 | Comp. 4 | Comp. 5 | Comp. 6 | Comp. 7 | Double Bunco Probability |
|---|---|---|---|---|---|---|---|---|---|---|
| 1 | 0 | | | | | | | | | 0 |
| 2 | 1 | BB | 0.027778 | 0.00463 | | | | | | 0.000128601 |
| 3 | 2 | BxB | 0.027778 | 0.416667 | 0.00463 | | | | | 0.000107167 |
| 4 | 3 | BxxB | 0.027778 | 0.416667 | 0.416667 | 0.00463 | | | | 6.69796E−05 |
| 5 | 4 | BxxxB | 0.027778 | 0.416667 | 0.416667 | 0.416667 | 0.00463 | | | 3.72109E−05 |
| 6 | 5 | BxxxxB | 0.027778 | 0.416667 | 0.416667 | 0.416667 | 0.416667 | 0.00463 | | 1.93807E−05 |
| 7 | 6 | BxxxxxB | 0.027778 | 0.416667 | 0.416667 | 0.416667 | 0.416667 | 0.416667 | 0.00463 | 9.69033E−06 |

The analysis for the "Triple Bunco Bonus" is similar to the "Double Bunco Bonus." Table 6 shows all of the possible forms of a seventh level "Triple Bunco Bonus."

TABLE 6

| |
|---|
| BBxxxxB |
| BxBxxxB |
| BxxBxxB |
| BxxxBxB |
| BxxxxBB |
| xBBxxxB |
| xBxBxxB |
| xBxxBxB |
| xBxxxBB |
| xxBBxxB |
| xxBxBxB |
| xxBxxBB |
| xxxBBxB |
| xxxBxBB |
| xxxxBBB |

Using the same symmetry that was used for the double "Bunco" calculation, one arrives at Table 7.

TABLE 7

| Stage | Number of Forms | Sample Form | Comp. 1 | Comp. 2 | Comp. 3 | Comp. 4 | Comp. 5 | Comp. 6 | Comp. 7 | Triple Bunco Probability |
|---|---|---|---|---|---|---|---|---|---|---|
| 1 | 0 | | | | | | | | | 0 |
| 2 | 0 | | | | | | | | | 0 |
| 3 | 1 | BBB | 0.027778 | 0.00463 | 0.00463 | | | | | 5.95374E−07 |
| 4 | 3 | BBxB | 0.027778 | 0.00463 | 0.416667 | 0.00463 | | | | 7.44218E−07 |
| 5 | 6 | BBxxB | 0.027778 | 0.00463 | 0.416667 | 0.416667 | 0.00463 | | | 6.20181E−07 |
| 6 | 10 | BBxxxB | 0.027778 | 0.00463 | 0.416667 | 0.416667 | 0.416667 | 0.00463 | | 4.30682E−07 |
| 7 | 15 | BBxxxxB | 0.027778 | 0.00463 | 0.416667 | 0.416667 | 0.416667 | 0.416667 | 0.00463 | 2.69176E−07 |

Table 8 shows the expected return from the double "Bunco" and triple "Bunco" awards. The first column shows the game "Stage". The second column shows the "75" coin pay for the "Double Bunco Bonus". The third column shows the "Double Bunco Probability" computed in Table 5 for each stage. The fourth column computes the expected return" (EV) for double "Buncos" on the given stage by multiplying the "Pay" (second column) times the "Probability" (third column). The fifth through seventh columns compute the triple "Bunco" expected return in the same manner as was used for "Double Bunco" in the second through fourth columns.

TABLE 8

| Stage | Double Bunco Pay | Double Bunco Prob. | Double Bunco EV | Triple Bunco Pay | Triple Bunco Prob. | Triple Bunco EV |
|---|---|---|---|---|---|---|
| 1 | 75 | 0 | 0 | 2500 | 0 | 0 |
| 2 | 75 | 0.000129 | 0.009645 | 2500 | 0 | 0 |
| 3 | 75 | 0.000107 | 0.008038 | 2500 | 5.95E−07 | 0.001488 |
| 4 | 75 | 6.7E−05 | 0.005023 | 2500 | 7.44E−07 | 0.001861 |
| 5 | 75 | 3.72E−05 | 0.002791 | 2500 | 6.2E−07 | 0.00155 |
| 6 | 75 | 1.94E−05 | 0.001454 | 2500 | 4.31E−07 | 0.001077 |
| 7 | 75 | 9.69E−06 | 0.000727 | 2500 | 2.69E−07 | 0.000673 |

Finally, the overall EV of each stage and the overall EV of multi-stage games is shown in Table 9. The first column indicates the "Stage" number. The second column shows the expected return for the base game stage which was generated for the first three stages in Table 1, Table 2, and Table 3. The third and fourth column show the "Double" and "Triple Bunco" bonus EV components generated in Table 8. The fifth column is the total EV for the stage, which is created by adding the EV components in the second, third and fourth columns. The sixth column is the EV of an entire multi-stage game that bet on the number of stages in the first column. This is the average of the fifth column in the current row and all rows above (i.e., the average EV of all stages in the multi-stage game). The expected return of the entire game when a player plays all seven stages is 0.927423292 or 92.74%.

TABLE 9

| Stage | Base Game EV | Double Bunco EV | Triple Bunco EV | Total EV For Stage | EV of Game Playing this many stages |
|---|---|---|---|---|---|
| 1 | 0.888889 | 0 | 0 | 0.888889 | 0.888888889 |
| 2 | 0.92284 | 0.009645 | 0 | 0.932485 | 0.910686728 |
| 3 | 0.902357 | 0.008038 | 0.001488 | 0.911883 | 0.911085629 |
| 4 | 0.921469 | 0.005023 | 0.001861 | 0.928353 | 0.915402545 |

TABLE 9-continued

| Stage | Base Game EV | Double Bunco EV | Triple Bunco EV | Total EV For Stage | EV of Game Playing this many stages |
|---|---|---|---|---|---|
| 5 | 0.953178 | 0.002791 | 0.00155 | 0.957519 | 0.923825811 |
| 6 | 0.937292 | 0.001454 | 0.001077 | 0.939822 | 0.92649184 |
| 7 | 0.931612 | 0.000727 | 0.000673 | 0.933012 | 0.927423292 |

Another embodiment of the invention includes a Bunco game similar to the above mentioned embodiment with the addition of a Bonus Award symbol on certain sides of each of the dice at different stages of the Bunco game for a possible roll showing a side of each die along with the Bonus Award symbol. If the player makes a roll in one of the stages that utilize these dice and all three Bonus Award symbols appear, then a Bonus game will be played at the conclusion of the base Bunco game. The Bonus Award symbols can be placed on the dice in a random fashion prior to each roll or the Bonus Award symbols can be placed to correspond to particularly good or bad rolls, or any other number of ways. This embodiment also incorporates a "special" roll or "Free Ride" as discussed below.

One form of this Bonus game is a circular path with seven spaces that the player moves around based upon a roll of a die. A credit value is associated with each space of the Bonus game. The further the player goes around the trail, the higher the credit values. However, the further the player goes around the trail, one or more Game Over symbols is assigned to the seven spaces. If a Game Over symbol is landed on by the player, the player only receives a consolation award of five credits. The Player can decide before any roll of the die if he or she wants to quit the bonus game and take the credit value associated with the space the player is on.

One form of the "special" roll or Free Ride is a roll where all three dice show matching numbers, but not any of the Bunco Point or Points. As a not limiting example, if the Bunco Points were one and two, a roll of three fives does not match any of the Bunco Points. However it would match the conditions of the Free Ride roll. In this example without the Free Ride feature, the roll of three fives would end the game and earn no additional points. The reason for a Free Ride is that such a roll looks like a good roll, but the looks do not matter in Bunco. With the incorporation of the Free Ride, the player could advance to the next stage, instead of ending the game. It should be noted the advancement to the next stage or level of the game is condition upon the player previously wagering upon the next stage or level of the game.

Figure 8:
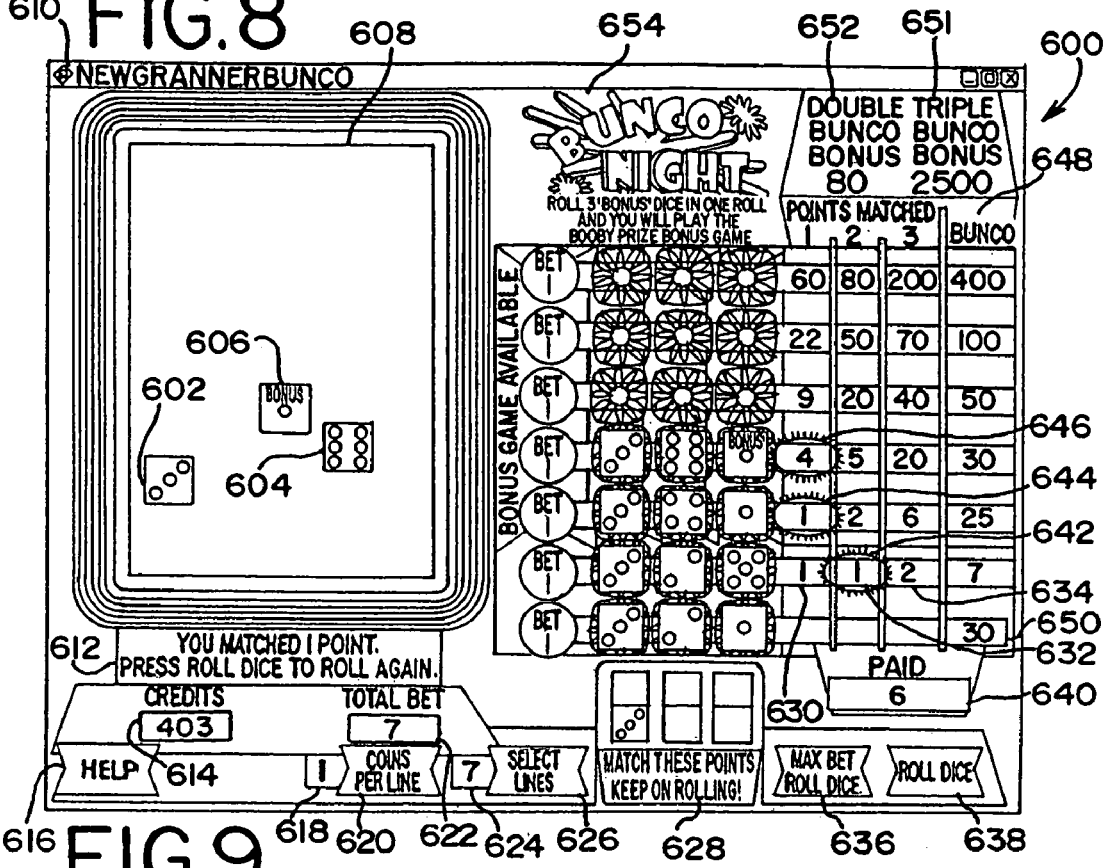
FIGS. 8 and 9 show various views of game displays of one embodiment of the invention.

In this embodiment, the game 600 displays three dice 602, 604, and 606 in a dice throw area 608, all of which is physically displayed on a screen or video monitor 610 of a gaming machine as shown in FIG. 8. Each of the three dice 602, 604, and 606 can be envisioned having six sides, with each die displaying only one of its six sides, just as traditional dice. Each of the six sides of each die reveals one to six dots or pips, respectively. The first side displays a single pip, side two displays two pips, and so on. The sides of each die are arranged such that the sum of the pips of opposing sides total to equal seven pips. In this embodiment, first die 602 is revealing the third side with three pips. The second die 604 is revealing the sixth side with six pips. The third die 606 is revealing the first side with one pip along with a "Bonus" award symbol.

FIG. 8 reveals the video monitor 610 displaying a message area 612, a "Credits" meter 614, a "Help" button 616, a "Coins Per Line" meter 618, a "Coins Per Line" button 620, a "Total Bet" meter 622, a "Select Lines" meter 624, a "Select Lines" button 626, a current point area message 628, a "Max Bet Roll Dice "button 636, a" Roll Dice" button 638, a "Paid" meter 640, a Paytable 648, and a "Bunco Game" message 654.

Figure 9:
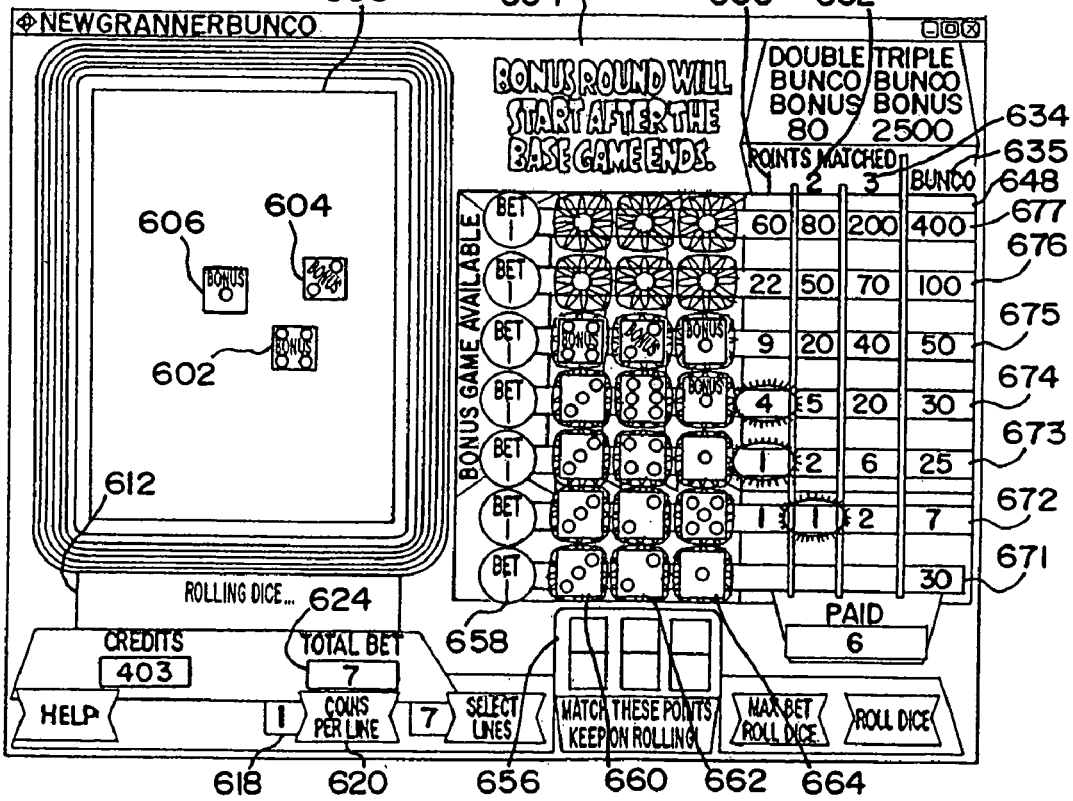

Revealed in FIGS. 8 and FIG. 9 in the video monitor 610 displaying the Paytable 648 that has three columns 630, 632 and 634 indicating possible payouts for each roll or round in a series of seven possible rolls of the game 600, as well as a "Bunco" column 635, a "Double Bunco Bonus" meter 652, and a "Triple Bunco Bonus" meter 651. The Paytable 648 has seven rows 671, 672, 673, 674, 675, 676, and 677. Each of the seven rows of the Paytable 648 corresponds to a result from each possible roll completed in the series with seven possible rolls of the game 600. Also shown are win circles 642, 644, and 646 to indicate any amount won in a roll of the game. Also displayed are a "Bet" column 658, a "Current Point" display 656, a "First Die" column 660, a "Second Die" column 662, and a "Third Die" column 664.

FIG. 8 represents the results of a fourth roll in a game and can be used to describe how the game is played with some reference to FIG. 9. The player operates the gaming machine by pressing or actuating buttons, through the use of a touchscreen display, some pointing device, or through the use of corresponding mechanical pushbutton switches. The player can repeatedly press the "Select Lines" button 626 in FIG. 8 to select one to seven lines. One may also press the "Max Bet Roll Dice" button 636 to select all seven lines with a maximum preset number of coins per line, usually five, to have a total wager of thirty-five credits. The player may repeatedly actuate the "Coins Per Line" button 620 to select the number of coins or credits to wager upon per roll. The total bet is the product of the number of the "Select Lines" meter 624 and the number of the "Coins Per Line" meter 618, and is shown in the "Total Bet" meter 622. Here, the player has chosen to wager one coin per line to have a total wager of 7 credits.

The game 600 is initiated by actuating the "Roll Dice" button 638. The message area 612 displays messages and directions for the player to follow. The gaming machine will use a Random Number Generator (RNG) to select a value for each of the three dice 602, 604, and 606. In a first round of the game, the player received a roll having three pips on the first die 602, two pips on the second die 604, and one pip on the third die 606. Representations of each of the three dice 602, 604, and 606 are displayed in columns 660, 662, and 664 that correspond to the results of the first roll in row 671. Because all three dice become the current points, each is displayed in a highlighted manner on line 671.

At this point in the game, the results of the first roll are also displayed in the "Current Point" meter 656. These are the current points that the player must match in each of the successive rolls in order to keep playing this hand of the game 600. Also, the player earns any winnings by matching the values of the three dice 602, 604, and 606 to the current point or points.

In this embodiment of the game 600, the player can only "win" on the first roll by having the values of all three dice 602, 604, and 606 that match each other and become the current point. If this occurs, the player has achieved a Bunco and would win thirty credits on the first roll. In this embodiment, the player can only achieve a Bunco in the first roll by having all three dice 602, 604, and 606 revealing the same value since a current point is not previously set. If a player achieves a Bunco, award sounds and special graphic are initiated. Here, it is evident that the player did not get a Bunco, therefore play continues to a second roll.

In the second roll, the player received a roll having three pips on the first die 602, two pips on the second die 604, and five pips on the third die 606. Representations of each of the three dice 602, 604, and 606 are then displayed in the second row 672 in columns 660, 662, and 664 that correspond to the results of the second roll in row 672. For any dice matching the current points, the representations are displayed in a highlighted manner. Because the value of the first die 602 equaled three in this roll and the value of the second die 604 equaled two, the player has matched two of the current points that were determined in the first roll. A win circle 642 is placed about the value of 1 in the Paytable 648 that corresponds to matching two current points in the second roll. So far, the player has wagered a total of seven credits and only earned one credit back. Play continues to a third roll, since the player "got" a three and a two on the second roll again.

The player only matched two the three possible current points in the second roll, therefore the current point that was not "matched" (one) is removed from the "Current Point" display 656.

In the third roll, the player received a resulting roll having three pips on the first die 602, four pips on the second die 604, and one pip on the third die 606. Again, representations of each of the three dice 602, 604, and 606 are then displayed in the Paytable 648 in the third row 673 in columns 660, 662, and 664 that correspond to the results of the third roll. Here, only the first die 602 having a three in this roll matches the current point, so only the first die 602 is highlighted in the row 673. Therefore, the current point of two is removed from the "Current Point" display 656. A win circle 644 is placed about the value of 1 in the Paytable 648 for matching one current point. Play now continues to a fourth roll.

In the fourth roll, the player received a roll having three pips on the first die 602, six pips on the second die 604, and one pip with a "Bonus" award symbol on the third die 606. Again, representations of each of the three dice 602, 604, and 606 are then displayed in the Paytable 648 in the fourth row 674 in columns 660, 662, and 664 that correspond to the results of the fourth roll. Again, only the first die 602 having three pips matches the current point, so only the first die is highlighted in the row 674. However, because the player has progressed to this level, matching only one current point is worth more each successive roll. A win circle 646 is placed about the value of 4 in the Paytable 648 for matching one current point in column 660. The message area 612 also informs the player of the status of the game and any directions as is done at all moments while playing the game 600. FIG. 8 also shows the "Bunco Game" message 654 that informs the player that a bonus game can be played if a roll reveals each die has a "Bonus" award symbol. Play now continues to a fifth roll.

The fifth roll of this hand of the game 600 is shown in FIG. 9. Here, the dice 602, 604, and 606 are shown in the dice throw area 608, as well as in row 675 of the Paytable 648. In this roll, the player received a roll having four pips with a "Bonus" award symbol on the first die 602, two pips with a "Bonus" award symbol on the second die 604, and one pip with a "Bonus" award symbol on the third die 606. Since all three dice have the "Bonus" award symbol, the player has earned an opportunity to play a bonus game after completion of this hand of the game 600. The "Bunco Game" message 654 also informs the player that a bonus game has been earned. Comparing each of the three dice 602, 604, and 606 to the fourth row 674 of the Paytable 648 reveal that the player has not matched any, or in this case, the one remaining current point. This is visually expressed by having no highlighted die in the row 675.

In this embodiment, the game is over since the player did not match any current points, even though the player wagered upon subsequent rolls, i.e. rolls six and seven as depicted in the "Bet" column 658 and the sixth and seventh rows 676 and 677.

In a variation of the game, if all three dice 602, 604, and 606 reveal sides that do not match any current points but match each other, then a "free ride" is earned. This only occurs if the player has placed a wager upon subsequent rounds of the game. In this type of embodiment, the player would not add to their winnings, but would get to play out additional rounds or rolls that were bet upon. Alternatively, a payout award could be given with the "free ride" without departing from the invention.

Returning back to the embodiment of FIGS. 8 and 9, the game is over with a bonus game yet to be played. So far, the player has won six credits from a seven-credit wager. Because this hand of the Bunco game 600 is over, the gaming machine will initiate the bonus game 700 that was earned in the fifth roll (e.g. FIG. 10) as is indicated in the "Bunco Game" message 654.

Figure 10:
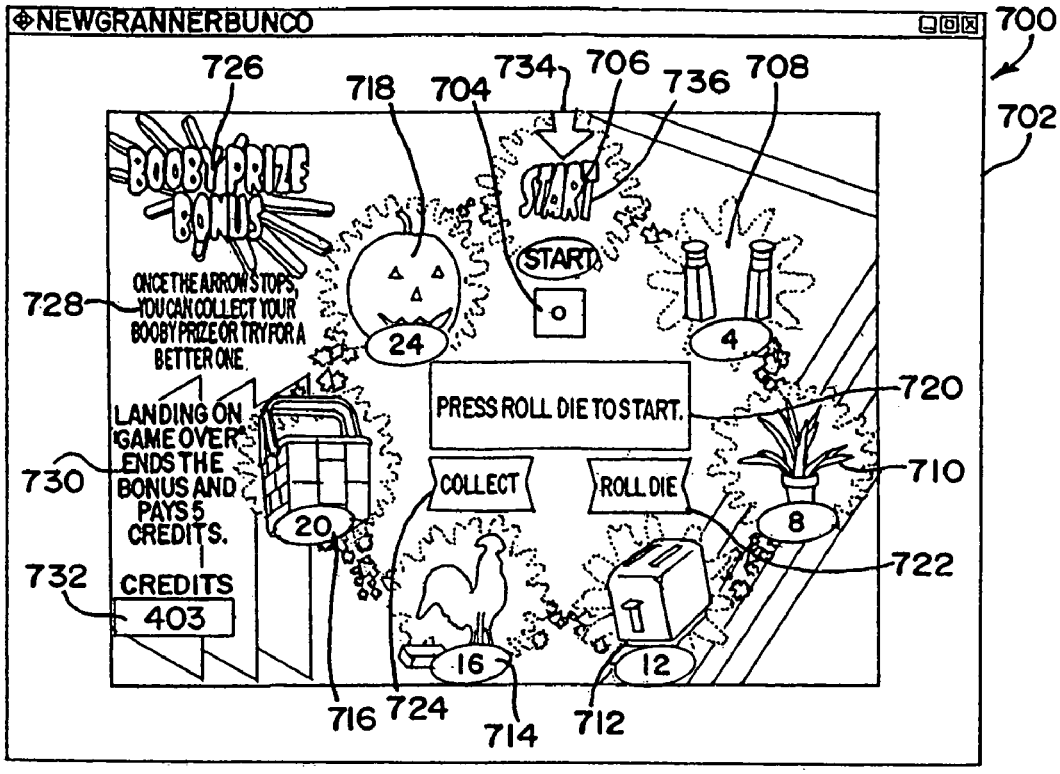
FIGS. 10 through 16 show various views of game displays of another embodiment of the invention.

FIG. 10 illustrates the bonus game 700 entitled "Booby Prize Bonus" game 726 that is physically displayed on the screen or video monitor 702 of the gaming machine. The bonus game 700 here has seven spaces in a circular trail similar to that of a conventional board game. We have chosen to use a board game illustration such that a playing piece or cursor 734 cannot lap the board game in one roll of a die 704. However, any number of spaces could be used without departing from the invention.

Each space is assigned different symbols and credit values. The player begins the bonus game 700 on the first space 706 as indicated by the cursor 734. The first space temporarily has a START symbol 736 and the word "START" shown as its credit value. The second space 708 has a salt and pepper shaker symbol and a credit value of four, the third space 710 has a flower pot symbol and a credit value of eight, the fourth space 712 has a toaster symbol and a credit value of twelve, the fifth space 714 has a rooster symbol and a credit value of sixteen, the sixth space 716 has a picnic basket symbol and a credit value of twenty, the seventh space 718 has a pumpkin symbol and a credit value of twenty-four. The credit values in this embodiment are assigned higher values for the further a player is able to progress around the spaces. However, any method of assigning the credit values can be utilized without departing from the invention. Also shown in FIG. 10 is a "Credits" meter 732, a "Game Ending" message 730, a "Direction" message 728, an "Instruction" message 720, the die 704, a "Roll Die" button 722, and a "Collect" button 724.

In FIG. 10, the "Instruction" message 720 indicates "Press Roll Die to Start", thus informing the player to actuate the "Roll Die" button 722 to start the bonus game. The "Roll Die" button 722 being displayed in a highlighted manner also informs the player of the need to actuate the "Roll Die" button 722.

Figure 11:
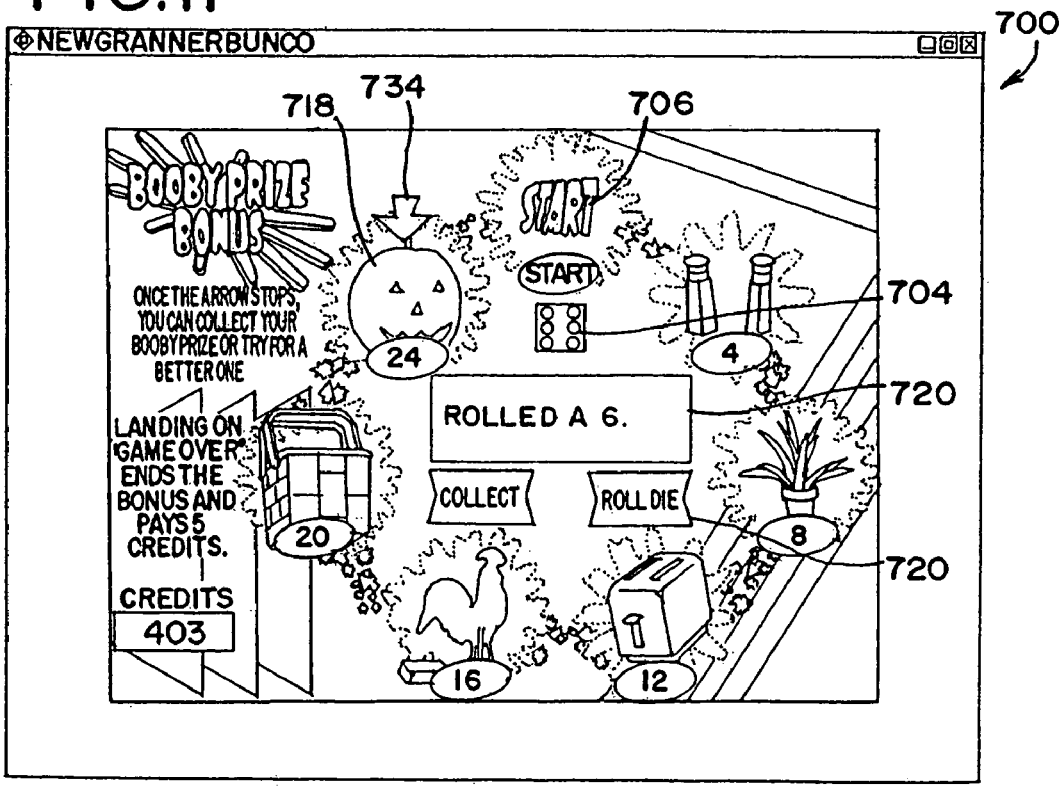

FIG. 11 reveals the status of the game after the player has actuated the "Roll Die" button 722. When the player actuated the "Roll Die" button 722, a CPU in the gaming machine initiated a RNG to pick a number to be shown on the die 704 wherein the value of the number is from one to six, inclusive. The die 704 in this embodiment is similar to the three dice used in the previous embodiment of the invention as shown in FIGS. 8 and 9. The die 704 is now shown in a tumbling action and stops to reveal the sixth side with six pips. The "Instruction" message 720 is updated to indicate that a six was rolled. The cursor 734 is illustrated to move six spaces in a clockwise direction on the video monitor 702 to "land" on the seventh space 718 with the pumpkin symbol and the credit value of twenty-four.

Figure 12:
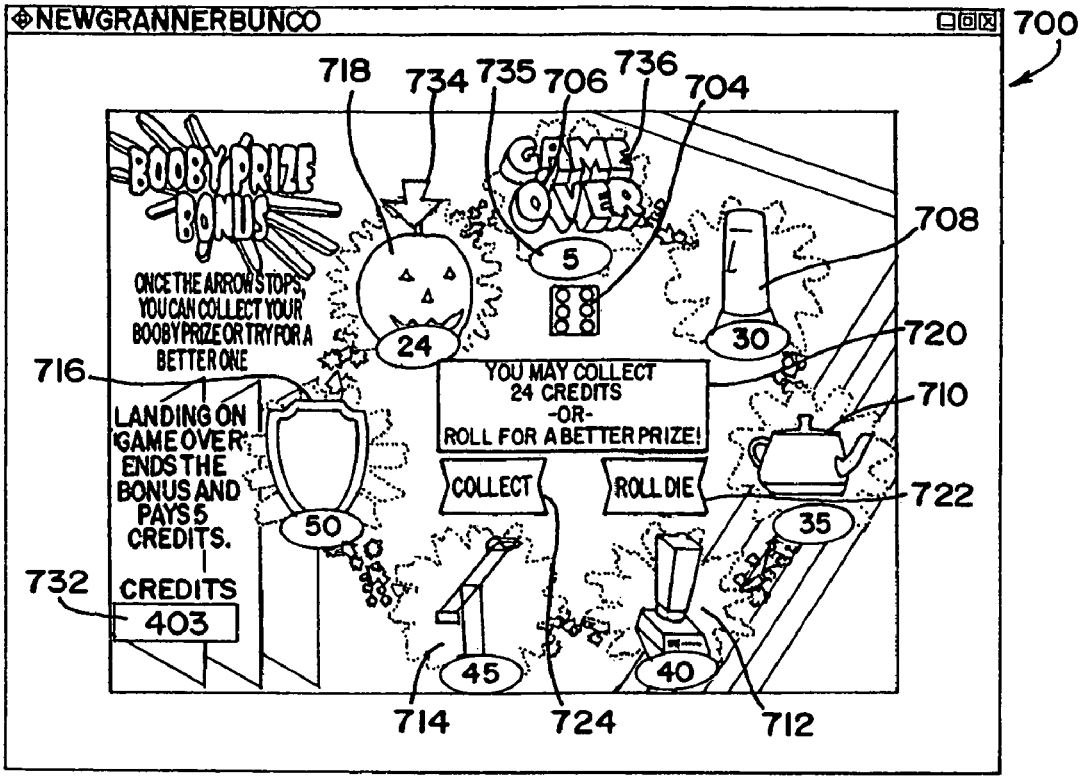

FIG. 12 reveals the status of the game after the cursor 734 has been moved. At this point, some of the spaces are changed to reflect new symbols and more attractive credit values. The first space is updated to reflect a Game Over symbol 736 with a consolation prize worth five credits. The second space 708 now has an idol statue symbol and a credit value of thirty, the third space 710 has a tea pot symbol and a credit value of thirty-five, the fourth space 712 has a blender symbol and a credit value of forty, the fifth space 714 has a lamp symbol and a credit value of forty-five, the sixth space 716 has an award plaque symbol and a credit value of fifty, the seventh space 718 still has a pumpkin symbol and the credit value of twenty-four. Again, the further into the game one progresses, the higher the associated credit values become. The possibility of high payouts or winnings is offset by the possibility that a player may land on a Game Over symbol and receive only five credits.

The "Instruction" message 720 is updated to inform the player to either actuate the "Collect" button 724 which will allow the player to collect the credit value of 24 and end the bonus game 700 or to actuate the "Roll Die" button 722 to continue playing the bonus game 700 with the risk of getting the consolation prize of five credits. In this case, the player chose to continue playing the bonus game 700.

Figure 13:
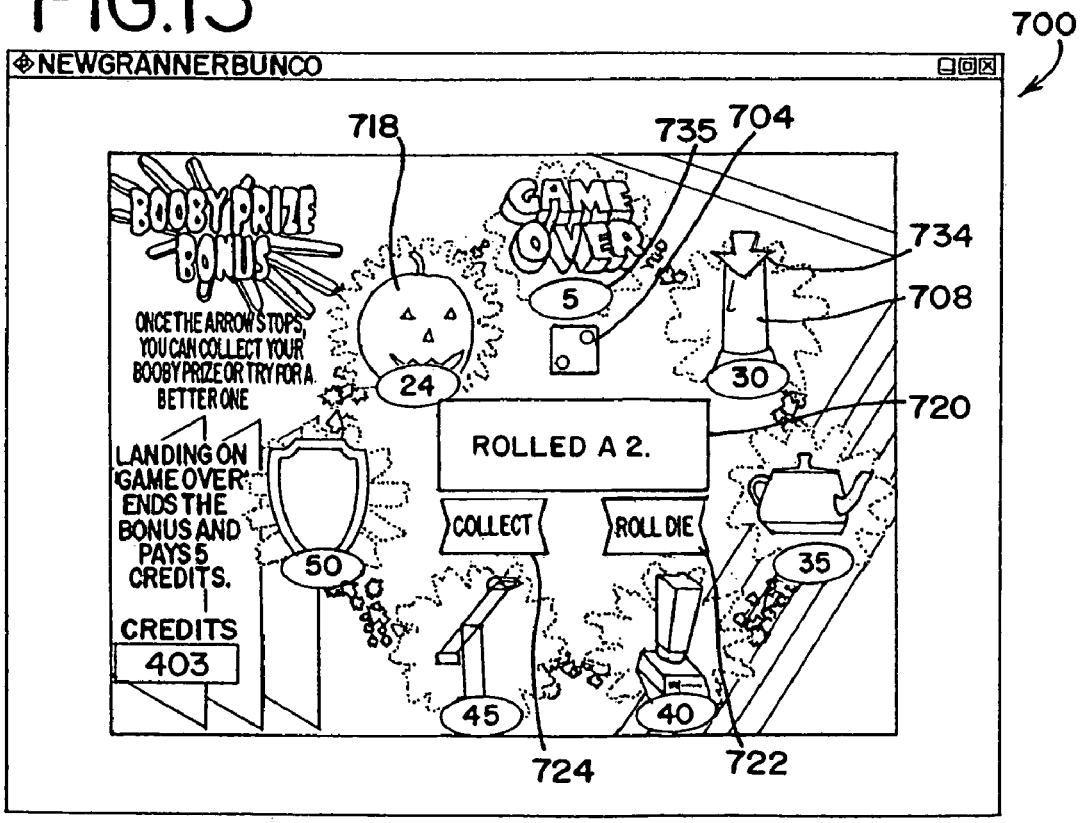

FIG. 13 reveals the status of the bonus game 700 after the player has actuated the "Roll Die" button 722. Here, the player rolled a two as shown on the die 704 and the "Instruction" message 720. The cursor 734 is illustrated to move two spaces in the clockwise direction to "land" on the second space 708 with the statue symbol and the credit value of thirty.

Figure 14:
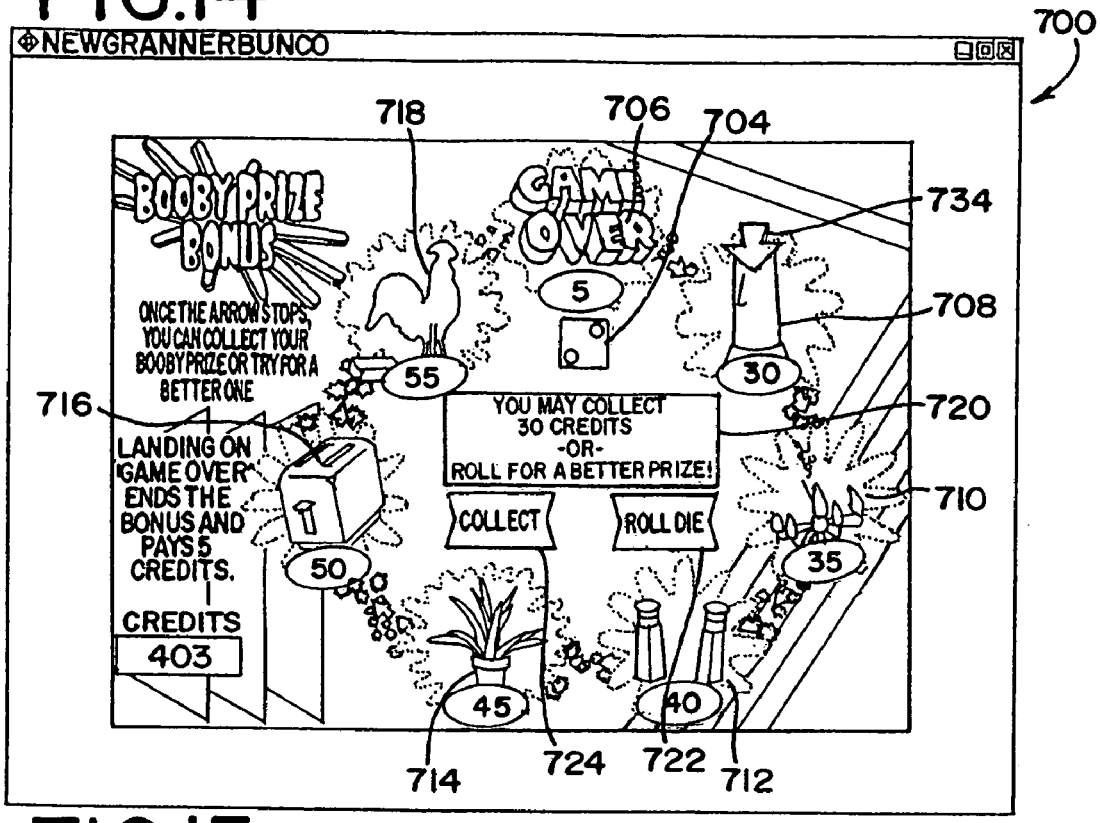

FIG. 14 reveals the status of the bonus game 700 after the cursor 734 has been moved. Since the player previously rolled a two and moved two spaces, the player can only progress two spaces further around the board game as compared to spaces prior to the move. Based on this premise, one would think that the seventh and first spaces 718 and 706 should be updated with new symbols and credit values. Accordingly, the seventh space 718 is updated to have a rooster symbol and a credit value of fifty-five. However, in this embodiment, once a space is assigned a Game Over symbol with a credit value of five, the space will remain so until the cursor moves past it or the end of the bonus game 700.

In this embodiment, the other spaces have non-changed credit values, but the symbols change for added excitement. However it is envisioned that other symbol and credit value assignments for each space of the game can be completed without departing from the invention. As shown in FIG. 14, the third space 710 now has a chandelier symbol, the fourth space 712 has the salt and pepper shaker symbol, the fifth space 714 has the flower pot symbol, and the sixth space 716 has the toaster award.

The "Instruction" message 720 is again updated to inform the player to either actuate the "Collect" button 724 to collect the credit value of 30 and end the bonus game 700 or actuate the "Roll Die" button 722 and roll again. Here, the player chose to roll again.

Figure 15:
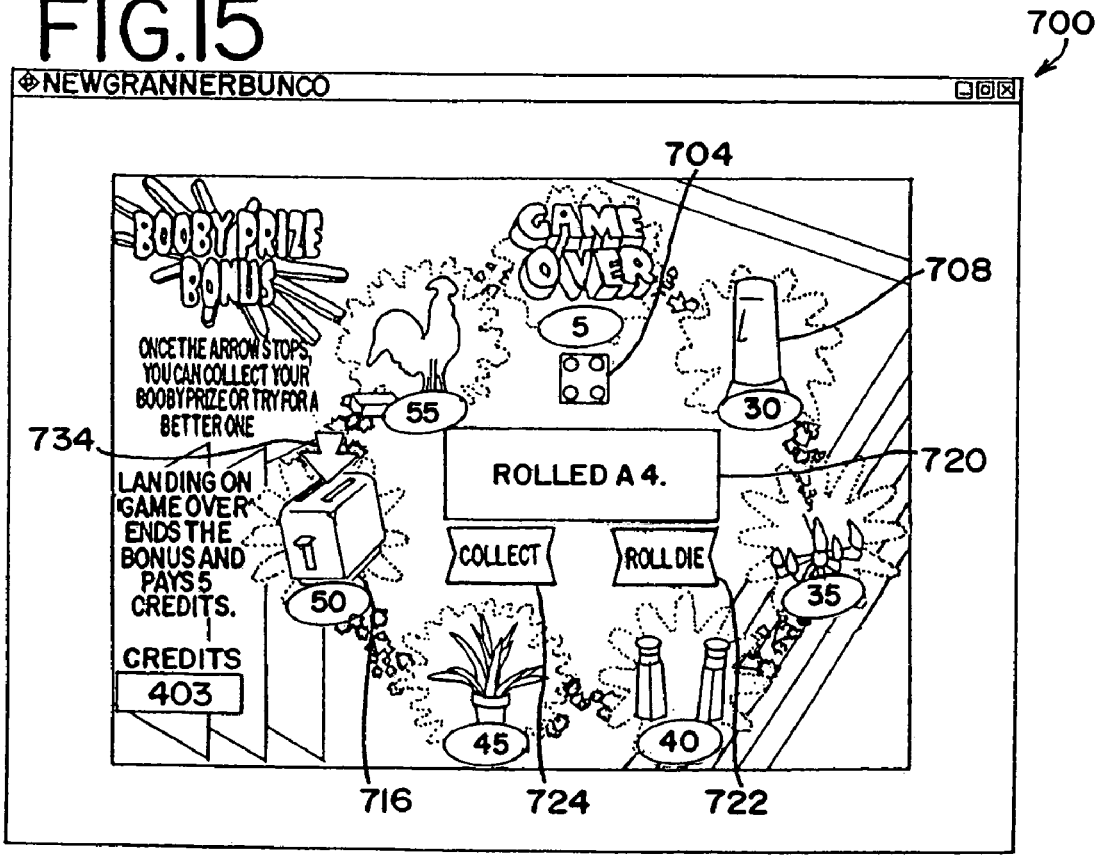

FIG. 15 reveals the status after the player rolled the die 704. The player rolled a four as shown on the die 704 and in the "Instruction" message 720. The cursor 734 is illustrated to move four spaces to the sixth space 716 with the toaster symbol and the credit value of fifty.

Figure 16:
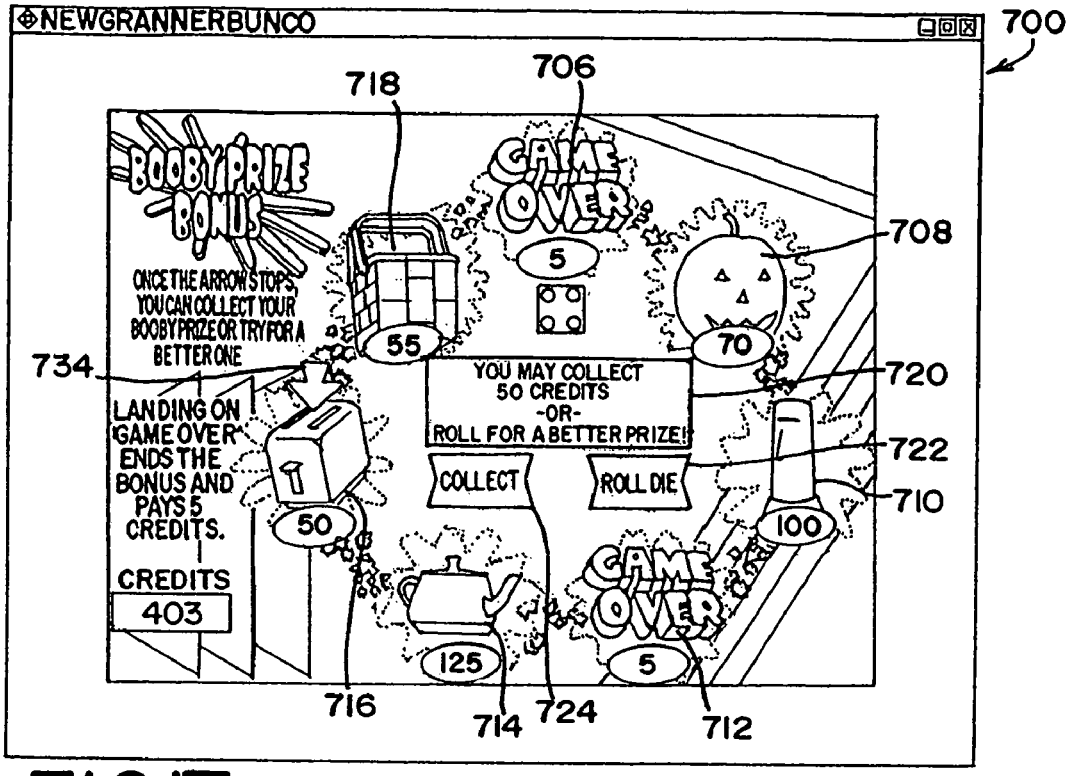

FIG. 16 reveals the status after the cursor 734 has been moved to the sixth space 716. Again, some of the spaces are changed to reflect new symbols and credit values for progressing further around the board game. The Game Over symbol 736 with a consolation prize worth five credits remains associated with the first space. The second space 708 now has the pumpkin symbol and a credit value of seventy. The third space 710 has the idol statue symbol with a credit value of one hundred credits. The fourth space 712 has a second Game Over symbol 736 with a consolation prize worth five credits. The fifth space 714 is assigned the teapot symbol and a credit value of one hundred and twenty five.

Again the "Instruction" message 720 informs the player to either actuate the "Collect" button 724 or the "Roll Die" button 722. Here, the player chooses to take the fifty credits and end the bonus game 700. Had the player chosen to continue playing the bonus game 700, the credit values would continue to increase in a non-linear growth of higher and higher values. At the same time more and more Game Over or "end" symbols appear among the seven spaces to add greater risk for the possibility of larger awards.

In other embodiments, a trail or path can be used with logic other than the increasing risk/reward logic without departing from the invention. In still other embodiments, the symbols associated with each of the spaces could represent a possible prize that could be awarded in lieu of the credit awards. Such possible symbols and prizes could be a deck of casino cards, a player's club jacket, a gaming machine, a new car, and so forth.

It should be noted that in this embodiment, if the bonus game 700 is initiated two or more times on different rolls of a single hand of a base game, then the credit values associated with the spaces in the bonus game are all multiplied by the number of times the bonus game has been initiated. The game could run the bonus round multiple times or handle multiple initiations in another manner without departing from the invention.

Figure 17:
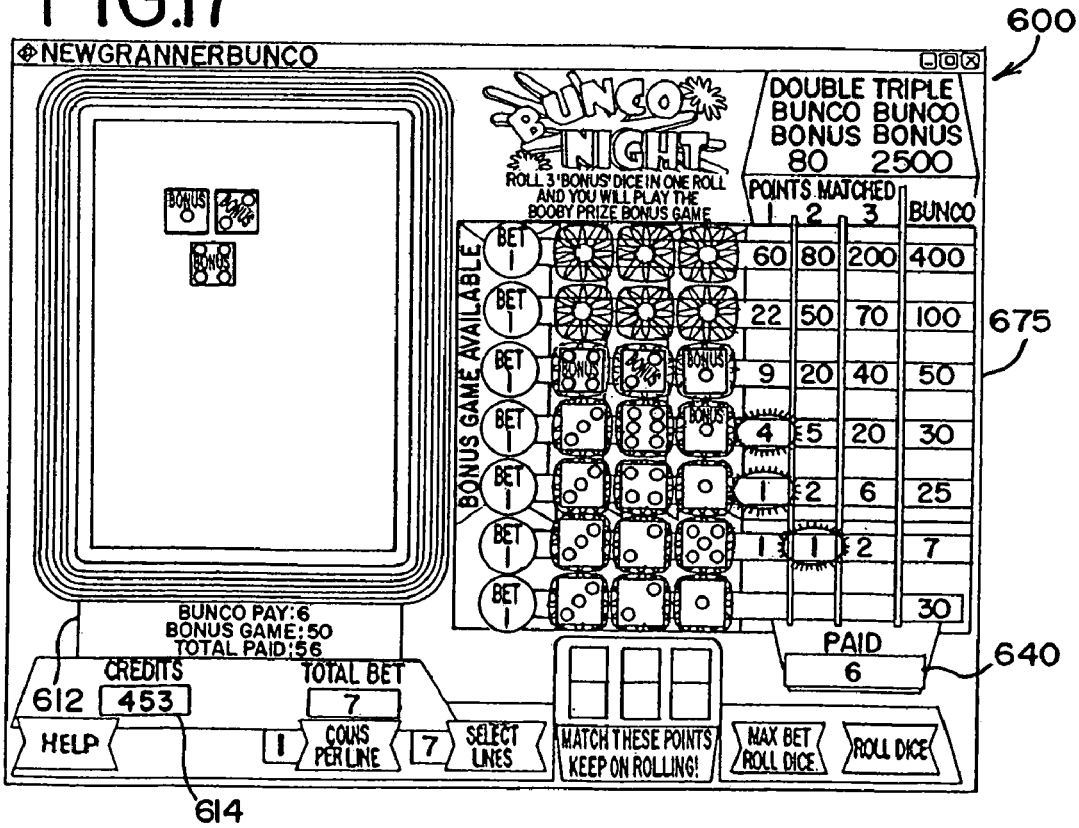
FIG. 17 shows a game display of one embodiment of the invention similar to that of FIGS. 8 and 9.

Once the bonus game is terminated, the gaming machine reverts back to the base game that spawned the bonus game. In this case, the gaming machine reverts back to the Bunco game embodiment depicted in FIGS. 8 and 9. The hand of the game played that initiated the bonus game has concluded as shown in FIG. 17. The message area 612 and the paid meter 640 also show that the player won and has been paid six credits from the Bunco game 600 and fifty credits from the bonus game 700 for a total win of fifty-six credits. The unpaid fifty credits are added to the previous number of credits for a total of 453 credits as indicated in the "Credits" meter 614. The gaming machine entices the player to re-bet and continue playing.

Figure 18:
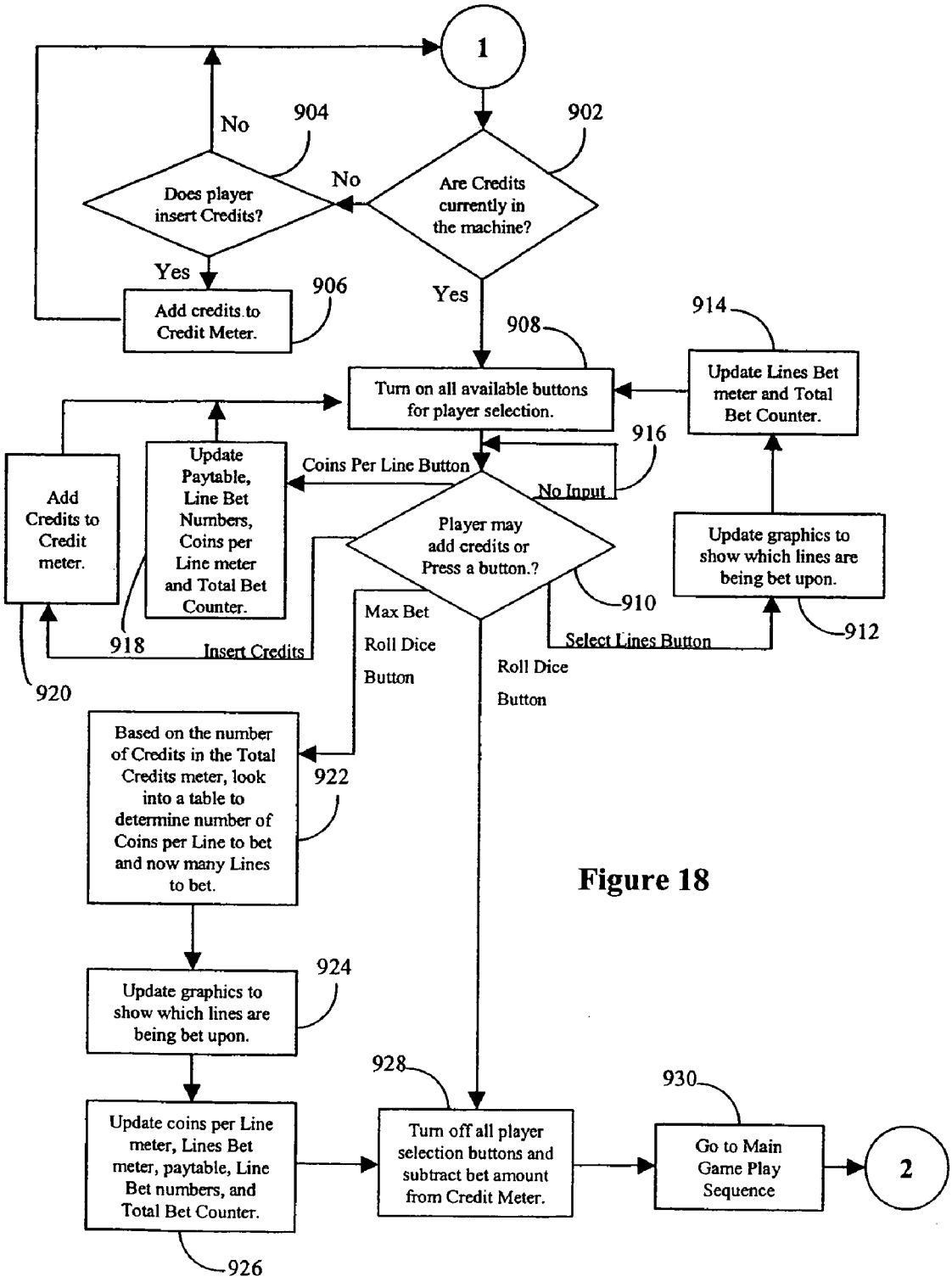
Figure 19:
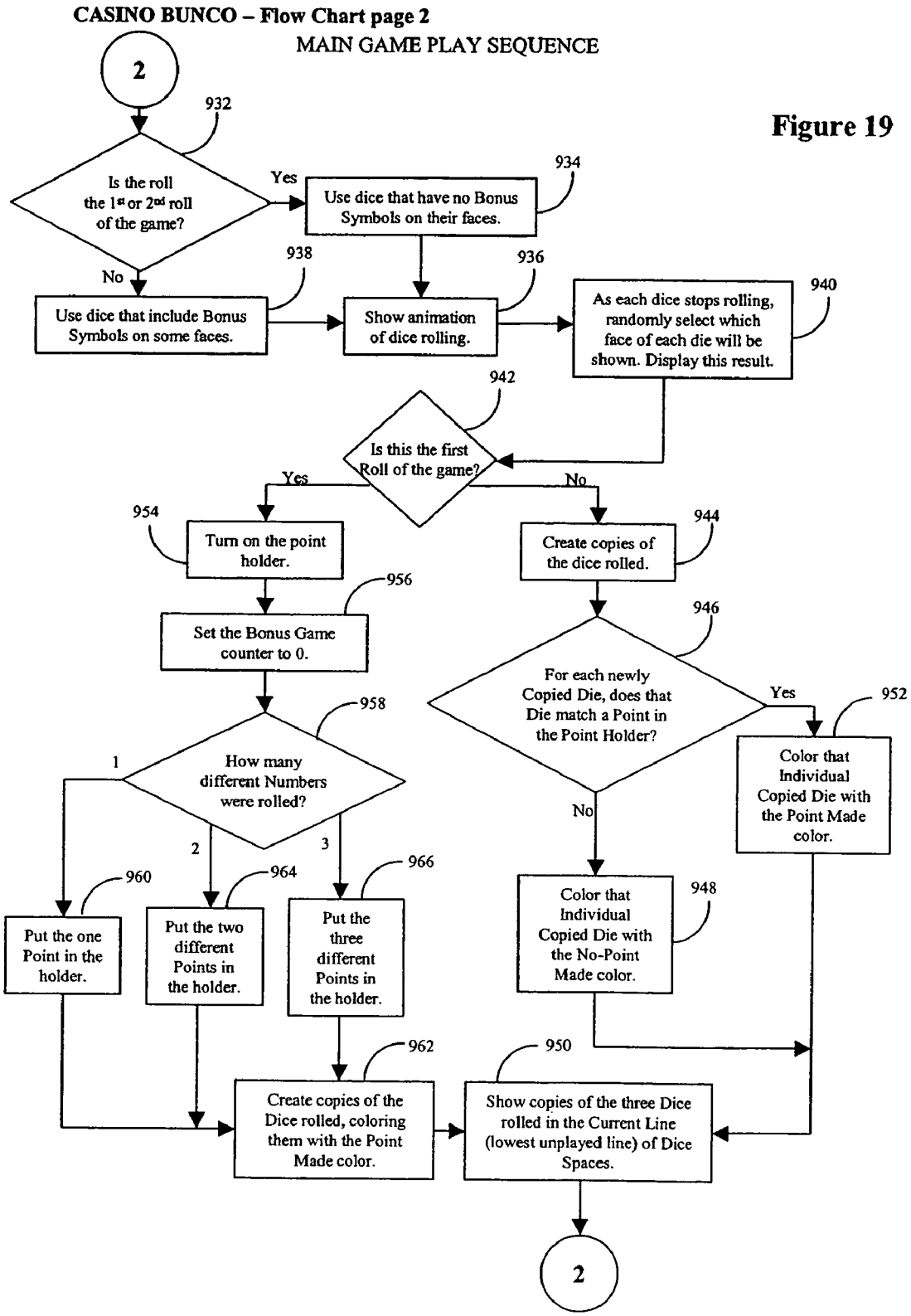

The above-described embodiments of a Bunco type gaming machine (FIGS. 8 to 17) are operationally summarized in the flow charts of FIGS. 18 through 27. FIG. 18 generally describes a starting point in a Bunco type gaming program. As shown in FIG. 18, the first step is shown as step 902, wherein the program verifies if there are any credits in the gaming machine. If no credits have been registered, then the program determines if a player has entered any coins or credits in step 904. If no coins or credits have been entered, the program loops back to complete step 902 again. If coins or credits have been entered, the program registers a corresponding number of credits on the gaming machine in step 906 and again loops back to complete step 902. Back in step 902, if there are coins or credits in the machine, the program turns on or activates all available player selection buttons in step 908

The player may actuate the "Select Lines" button from step 910. If so, the program updates the graphics in the Paytable in step 912. Then, the program updates the wager per line and the total amount bet in step 914, after which the program returns to complete step 908 again.

If the player does not provide any input into the gaming machine, the program loops back to complete step 910 again.

The player can also actuate the "Coins Per Line" button from step 910, causing the coins-per-line setting to be changed, as indicated on the "Coins Per Line" meter, as well as updating the value of the "Total Bet" meter, and the Paytable, all of which occurs in step 918. Once again, the program returns to complete step 908, again.

If the player chooses to add more credits, the credits are added and registered on the "Credits" meter as appropriate for the amount of coins or credits entered at step 920. The program then loops back to complete step 908.

The player has the option of skipping all of the lines and coins-per-line selections and actuate the "Max Bet Roll Dice" button. If the player does so, in step 922, the program will determine the number of coins per line to bet, as well as how many lines can be bet upon based upon the number of the credits the player has available in the machine. In step 924, the program updates all graphics to show the bet that will be made. All of the meters and counters are then updated in step 926. In step 928, the program turns off or de-activates the player selection buttons and subtracts the appropriate amount for the bet that was placed. Back in step 910, if the player actuates the "Roll Dice" button, the program proceeds directly to step 928.

After step 928, the program goes to the Main Game Play sequence in step 930. The Main Game Play sequence first determines in step 932 if the current roll is a first or a second roll of this particular hand of game being played. If this roll is the first or the second roll, then dice representation having no bonus award value are utilized in step 934. Next, an animation of dice being rolled is initiated in step 936. Back in step 932, if this roll is not a first or a second roll of the hand, representations of dice are selected to be used that have random bonus award values in step 938, and play proceeds to step 936 as before.

After step 936, the program stops each die on a random side of the die and displays the resulting three dice faces or sides in step 940. Next, the program determines if the roll that was just completed is the first roll of the game in step 942. If not, copies of the dice representation are then made in step 944. Then, it is determined in step 946 if any of the copies of the dice representations match a point in a point holder. If not, non-matching copies are colored with a no-point color in step 948. If any of the dice representations do match the point in the point holder, these dice are colored with a point-made color in step 952. After completion of either step 948 or step 952, the program continues on to step 950, where copies of the dice representation are then displayed in a roll history area in the appropriate row.

Back in step 942, if the roll being completed is the first roll of the game, the program turns on the point holder in step 954. Next, the program sets the bonus game counter to zero in step 956. Next, the program determines how many different numbers were rolled or are displayed in step 958. If three different numbers were rolled, the program displays all three different numbers in the point holder in step 966. If two different numbers were rolled, the program displays the two different numbers in the point holder in step 964. If only one number is displayed on all three dice, the program displays only the one number in the point holder in step 960. After completion of step 966, step 964, or step 960, the program creates copies of the three dice that were rolled and colors each with the point made color in step 962. After step 962 is complete the program continues to step 950 and continues on from there.

Figure 20:
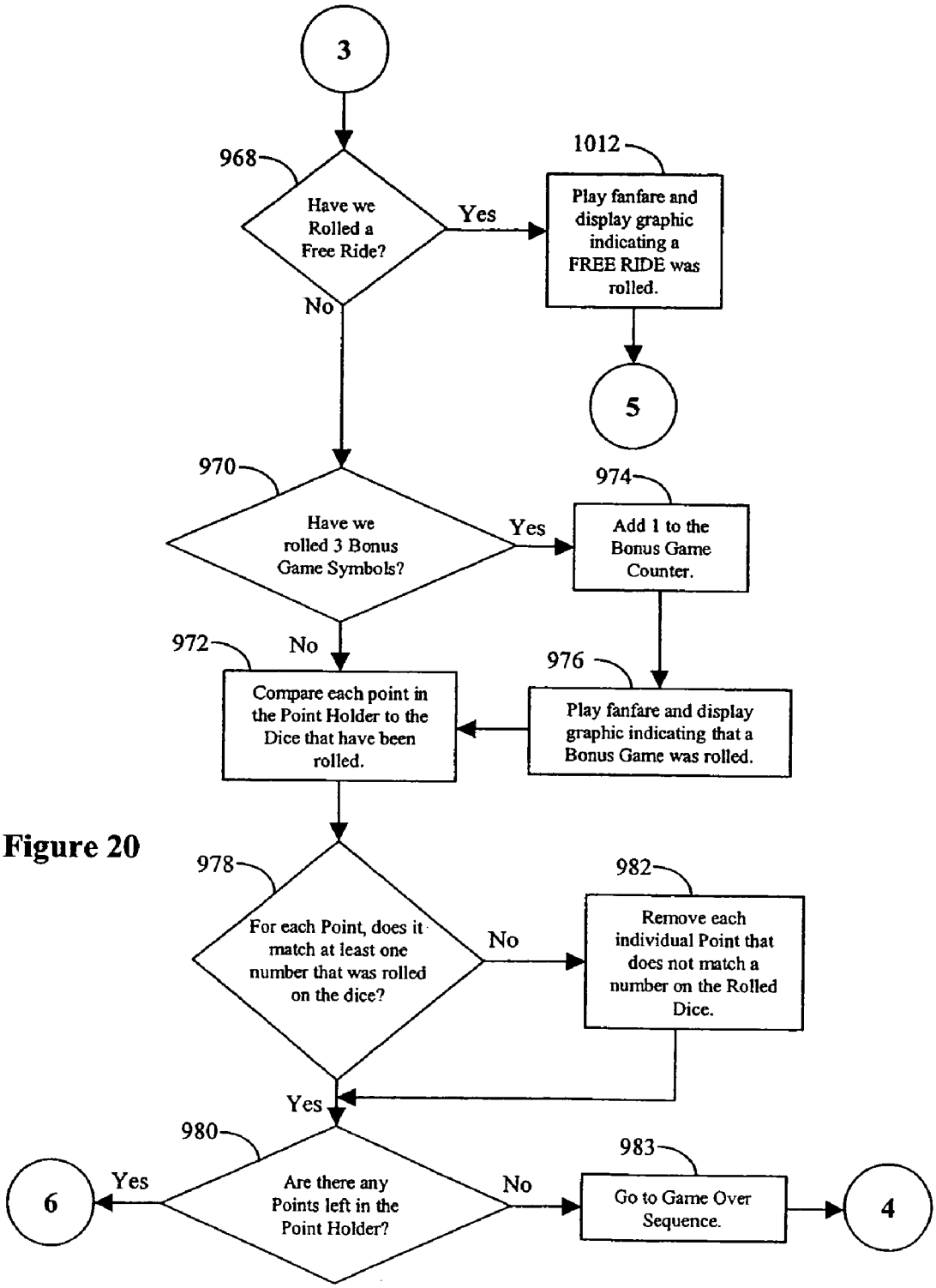
Figure 21:
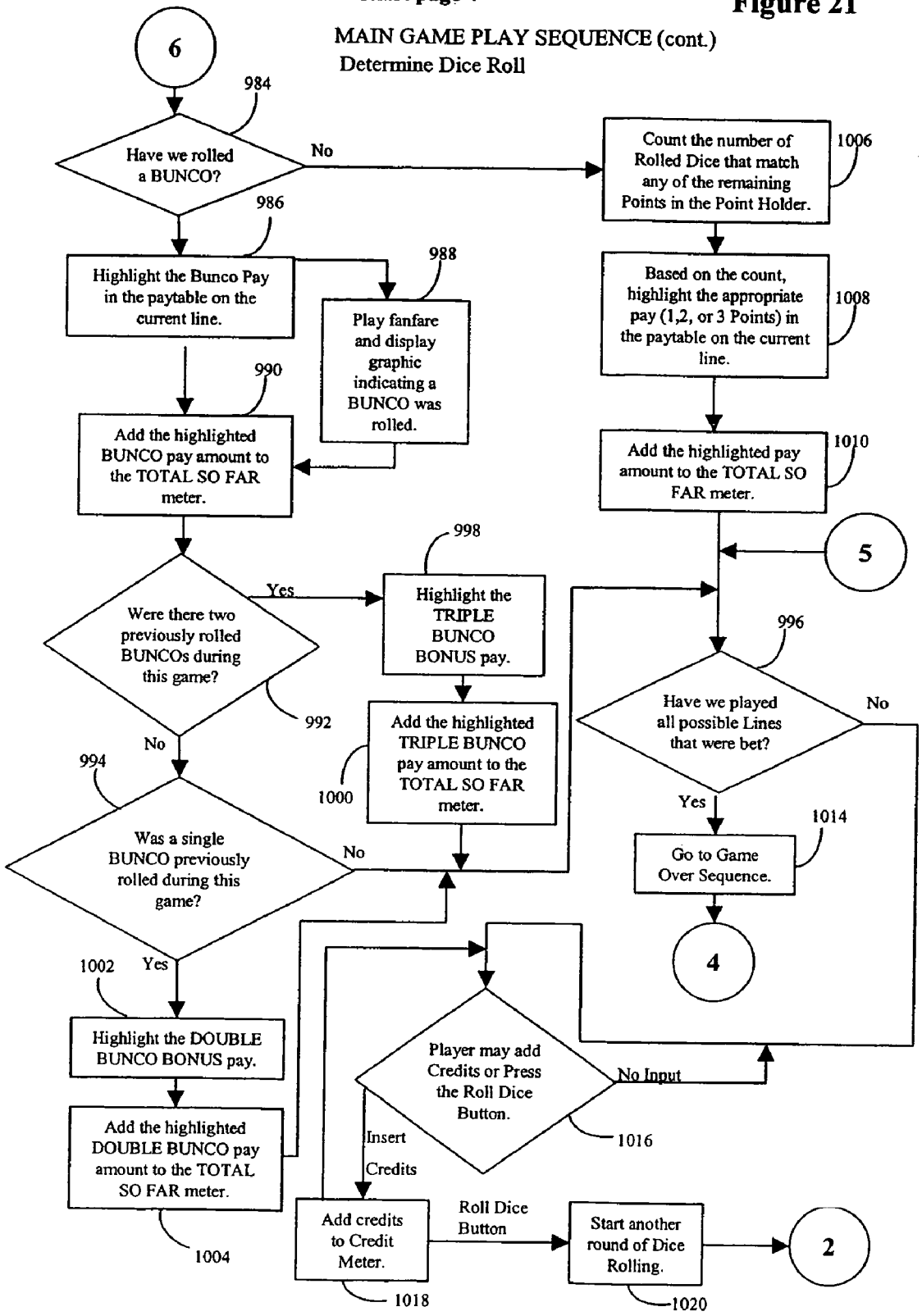

After step 950 is completed, the program determines if a FREE RIDE was rolled in step 968 (see FIG. 20). If not, the program determines if all three dice are displaying a Bonus Game symbol in step 970. If not, the program proceeds to step 972 and compares the number of each die to the number or numbers of the point holder. Back in step 970, if all three dice are displaying the Bonus Game symbol, then the program adds a value of one to a bonus game counter in step 974. Next, the program initiates sound and light alarms to excite the player of the fabulous achievement, and then the program proceeds to step 972.

After step 972, the program determines if each point in the point holder matches a number on one of the dice in step 978. If not, then the particular point is removed from the point holder in step 982. After step 982 or step 978, the program determines if any points remain in the point holder in step 980. If not, the program proceeds to a Game Over sequence in step 983. If points are remaining in the point holder, then the program goes to step 984 and determines if a Bunco has been rolled (see FIG. 21).

If a Bunco was rolled, an appropriate Bunco Pay element is highlighted in the Paytable in step 986. Next, the program initiates sound and light alarms to excite the player about the Bunco win in step 988, and then the program proceeds to step 990. In step 990, the value of the appropriate Bunco Pay element is added to a Total So Far meter. Then the program determines if there have been two previous Bunco rolls in the game being played in step 992. If not, the program determines if there has been one previous Bunco roll in the game being played in step 994. If not, the program proceeds to step 996 and determines if all possible rows or lines that were bet upon have been played.

Returning to step 992, if the program determines there have been two previous Bunco rolls in the game being played, the program highlights a Triple Bunco Bonus Pay in step 998. Next in step 1000, the value of the Triple Bunco Bonus Pay is added to a Total So Far meter. The program then proceeds to step 996 as before.

Returning to step 994, if the program determines there has been a single previous Bunco roll in the game being played, the program highlights a Double Bunco Pay in step 1002. Next in step 1004, the value of the Double Bunco Bonus Pay is added to a Total So Far meter. The program then proceeds to step 996 as before.

Now returning back to step 984, if no Bunco was rolled, the program goes to step 1006 and counts the number of the rolled dice that match any of the remaining points in the point holder. Next in step 1008, the program highlights an appropriate pay amount in the Paytable. In step 1010, the highlighted pay amount is added to the Total So Far meter. After completion of step 1010, the program goes to step 996 and continues on from that point.

Back in step 968 of FIG. 20, if a FREE RIDE was rolled, the program initiates sound and light alarms to excite the player about the FREE RIDE in step 1012. After completion of step 1012, the program goes to step 996 and continues on from that point.

As mentioned before, the program determines if all possible rows or lines that were bet upon have been played. If so, the program goes to step 1014 and proceeds to a Game Over sequence. If not, the program determines in any credits were added or if the Roll Dice button was actuated in step 1016. If credits were added, then the appropriate number of credits is added to the Credits meter in step 1018 and the program loops back to complete step 1016 again. If the Roll Dice button was actuated, the program goes to step 1020 and the program starts another round or roll of the dice by returning to complete step 932 again (see FIG. 19). If neither the Roll Dice button was actuated nor any credits added in step 1016, the program loops back to complete step 1016 again.

Figure 22:
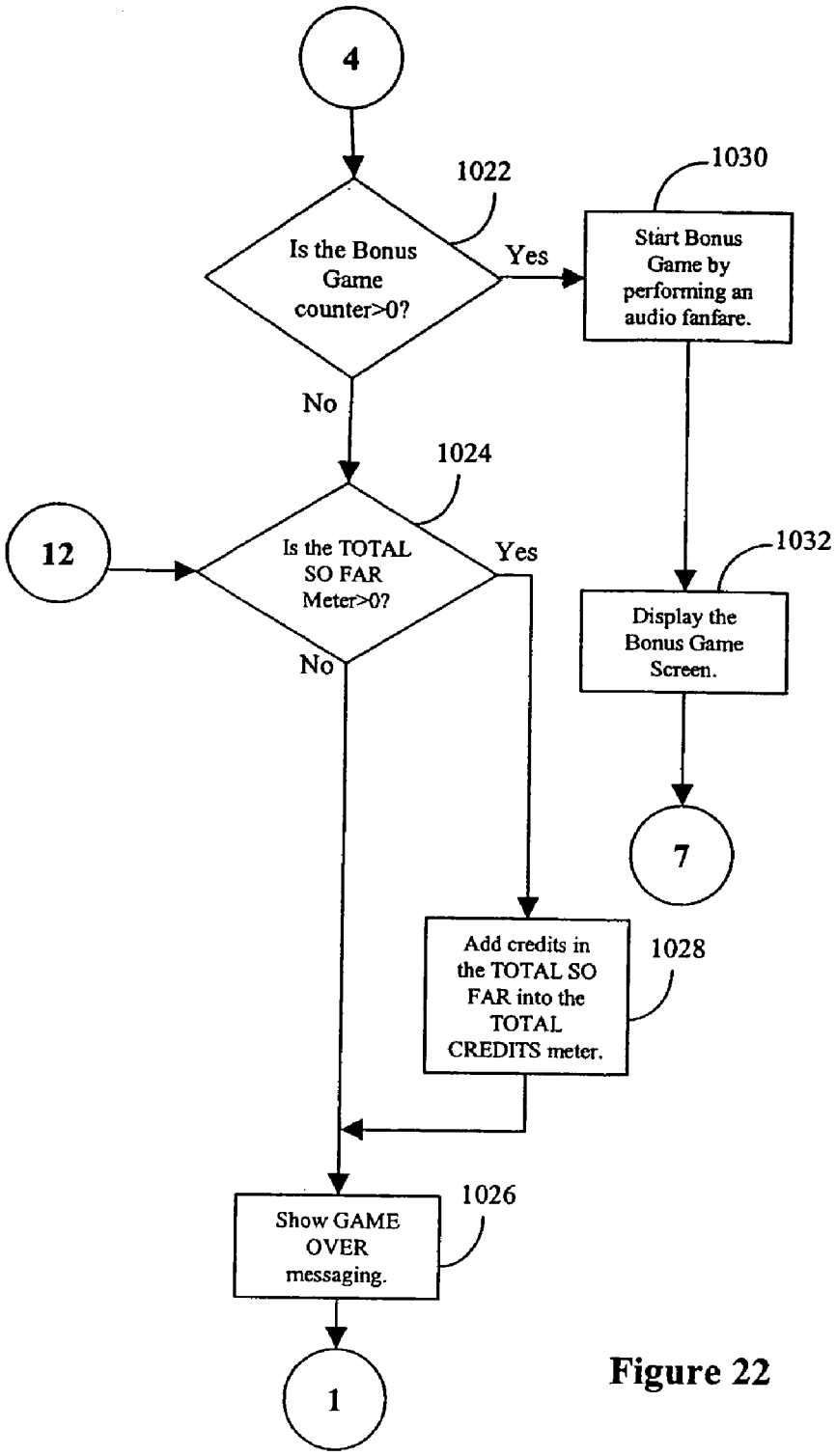

Returning back to step 1014 (see FIG. 21) or step 983 (see FIG. 20), a Game Over sequence was initiated. FIG. 22 illustrates the Game Over sequence. Here, the program first determines if the Bonus Game counter is greater than zero in step 1022. If so, the program starts a Bonus Game with audible and video fanfare in step 1030. Then in step 1032, the Bonus Game screen is displayed.

Back in step 1022, if the Bonus Game counter is not greater than zero, the program determines if the Total So Far meter is greater than zero in step 1024. If not, the program highlights the Game Over message in step 1026 and returns to step 902. If the Total So Far meter is greater than zero back in step 1024, the program adds the value of the Total So Far meter into the Total Credits meter in step 1028 and then the program proceeds to step 1026 and continues on from there.

Back in step 1030 of the main program, the Bonus Game screen is initiated. The Bonus Game is depicted in FIGS. 23 to 27. First, the program calls an Initialize The Bonus Game subroutine, described hereinafter, in step 1034 to initialize the Bonus Game. After returning from the Initialize The Bonus Game subroutine, the program calls an Update The Graphics On The Trail subroutine, described hereinafter, in step 1036 to update the graphics. After the program returns from the Update The Graphics On The Trail subroutine, the program proceeds to step 1038 and determines if a Player Index is equal to one. If not, a Take Win button and a Roll Dice button are activated in step 1040. Next in step 1042, the program determines if the player has actuated either of these buttons. If not, the program returns to complete step 1042 again.

Back in step 1038, if the Player Index is equal to one, the program activates only the Roll Die button and then goes to step 1042. In order to continue on from step 1042, the player must actuate either the Take Win button or the Roll Dice button. If the Take Win button is actuated, the value of a Bonus Win amount is set to the Position Pay value corresponding to the current position in the circle in step 1064. Then in step 1066, the value of the Bonus Win amount is added in a bang up fashion to the Bonus Win meter and the Total Credits meter. The Bonus Win amount is then tallied to the Total Credits meter of the main game in step 1068. In step 1070, the program returns to the Main Game and displays the Main Game screen.

Back in step 1042, if the Roll Die button is actuated, the active buttons are de-activated in step 1046. In step 1048, a roll is made according to a RNG to result in a number between one and six, inclusive. Next in step 1050, the program sets the Player Index to Player Index plus the value of the roll. In step 1052, the program sets the circle position equal to the previous circle position plus the value of the roll. In step 1054, the program checks if the circle position is greater than seven. If so, the circle position is set equal to the circle position minus a value of seven in step 1056. The program continues to step 1058. If the circle position is not greater than seven, the program skips step 1056 and proceeds directly to step 1058. In step 1058, the graphics are updated to show a cursor moving around the trail in a clockwise manner. In step 1060, the cursor stops on an appropriate space, and any items and pay values that are not the selected position are removed. In step 1062, the program determines what the Position Type is set to. If the Position Type is set to an ending value (i.e., a Game Over symbol) or if the Bonus Game is over (i.e. the player has landed on the highest valued space of the Bonus Game), the program proceeds to step 1064, and continues on from there. Otherwise the program returns to complete step 1036.

Figures 23, 24:
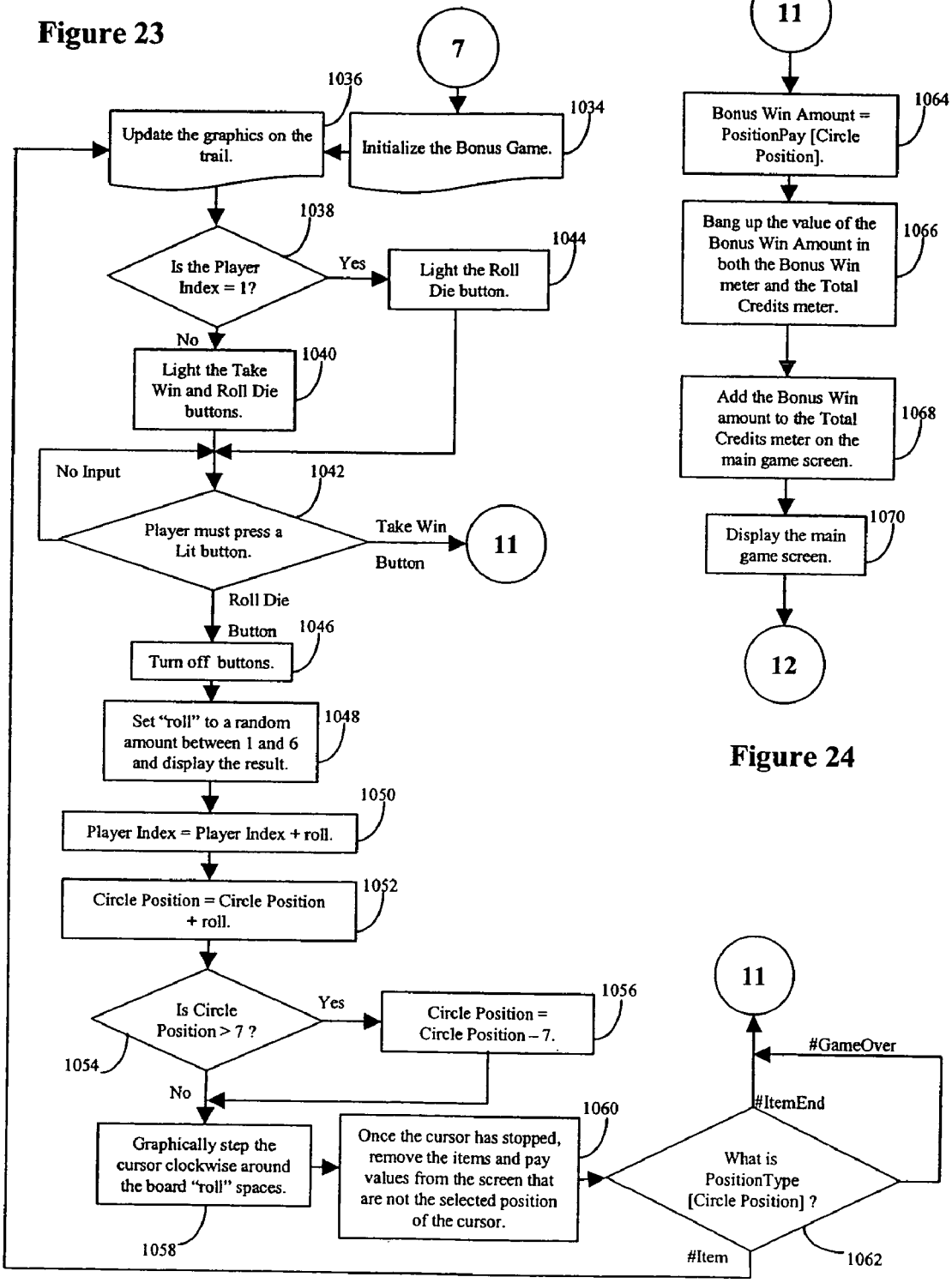

FIG. 25 illustrates the steps of the Initialize Bonus Game subroutine of step 1034 of the Bonus Game sequence in FIG. 23. First, step 1102 describes that this subroutine is an expanded description of the Bonus Game initialization process. In step 1104, the value of the Total Credits meter of the Main Game is copied to the Total Credits meter on the Bonus Game screen. Next in step 1106 and 1108, the Bonus Win is set to zero and the Player Index is set to 1. Next in step 1110, the circle position is set to one. The cursor is displayed on the screen or monitor in a position that corresponds to a Circle Position of one in step 1112. Also, the Position Type is set to a #Start Type in step 1114. A Start graphic image is displayed for the Circle Position of one in step 1116. In step 1118, the Start graphics is displayed for the Position Pay at location 1. After completion of step 1118, the program returns to the Bonus Game sequence to complete step 1036.

Figures 26, 27:
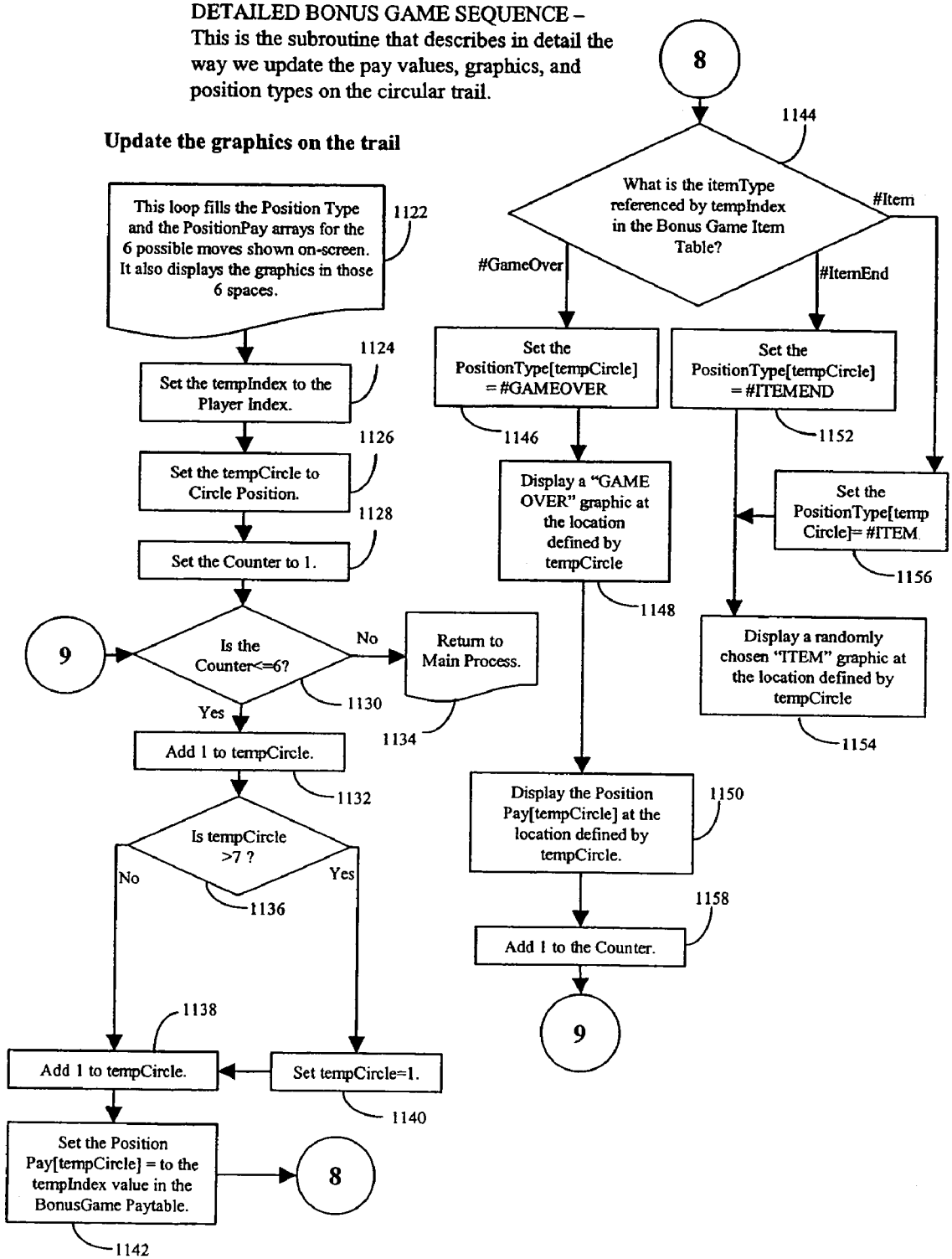

FIGS. 26 and 27 illustrate steps of the Update Graphics on the Trail subroutine of step 1036 of the Bonus Game sequence in FIG. 23. In step 1122, this subroutine is described as filling the Position Type and the Position Pay arrays as well as displaying the graphics for the possible six open spaces on the monitor of the gaming machine. In step 1124, the Temp Index is set to the Player Index. Next in step 1126 and 1128, the Temp Circle value is set to the Circle Position and the Counter is set to one. The program now determines if the Counter is less than or equal to six in step 1130. If not, then in step 1134, the program returns to the Bonus Game sequence to complete step 1038 (See FIG. 23). Otherwise, a value of one is added to the Temp Circle value in step 1132. In step 1136, the program determines if the Temp Circle value is greater than seven. If so, the Temp Circle value is reset to a value of one in step 1140. If the Temp Circle Value is not greater than seven or after completion of step 1140, the program adds one to the Temp Index in step 1138. Then, in step 1142, the Position Pay array at the "Temp Circle" position is set to the Temp Index value.

The next step is illustrated in step 1144 of FIG. 26. Here, it is determined what the Item Type is referenced to by the Temp Index in the Bonus Game Item Table. If Item Type is Game Over, the program sets the Position Type of the screen location indicated by "Temp Circle" to Game Over in step 1146. Then, in step 1148, a Game Over graphic is displayed on the trail at this position. In step 1150, the Position Pay for this location is displayed at the location defined by Temp Circle.

Back in step 1144, if Item Type is Item End, the program sets the Position Type of the screen location indicated by "Temp Circle" to Item End in step 1152. Then, in step 1154, the program displays a randomly chosen item graphic to be displayed at the location defined by Temp Circle. After step 1154 is completed, the program goes on to complete step 1150.

Again back in step 1144, if Item Type is simply Item, the program sets the Position Type of the screen location indicated by "Temp Circle" to Item in step 1156. After completion of step 1156, the program goes to step 1154 and continues on from there.

After step 1150 is completed as discussed previously, a value of one is added to the Counter in step 1158. When this is complete, the program loops back to complete step 1130 again to move to the next screen position. The circular looping back to 1130 is repeated until the Counter has a value of greater than six in step 1130. As discussed earlier, when this occurs, the program returns to the Bonus Game sequence to complete step 1038 (See FIG. 23).

Analysis of Free Ride Variation

In the Free Ride variation, recognition is given when the roll of 3 dice all match each other but do not match an active point. While the rules for the classic Bunco parlor game vary, it is common for the player to be allowed to keep rolling when after 3 dice all match each other but not the current point. Some variations of these rules give a small score award when this happens.

The game as disclosed in the Ser. No. 09/709,922 application may be modified to incorporate a similar feature. In the Bunco embodiments in that application, when the player rolls 3 matching dice that do not match any active point, there is no pay and the game is over.

A new embodiment defines 3 matching dice that do not match any points as a "free ride". If there are higher levels for which a wager has been received, then, when the players rolls 3 matching dice that do not match a point, a sound and special graphic are displayed. The player receives no payout award but is given a free ride to the next stage of the game. Alternatively, a payout award could be given with the free ride without departing from the invention.

The following analysis shows how to add the Free Ride feature to the multi-stage game analyzed using Tables 1-9. This version does not incorporate the Bonus Game. With this modification, the construction of the paytables would be done in a similar manner with probability tables for rolls 2-7 modified. Specifically, Table 2 (Table 22 from the Ser. No. 09/709,922 application) for the $2^{nd}$ stage of the game would be modified to become Table 10 as shown below. In the $2^{nd}$ column marked "Comb." there is an additional row labeled "NNN" in each of the 3 sections of the table. This row represents rolling 3 matching numbers that do not match any active points. Thus in the occurrence column for the NNN row with 1 point active there are 5 occurrences (1 for each of the numbers not matching the single point). For the NNN row with 2 points active there are 4 occurrences and for the NNN row with 3 points active there are 3 occurrences.

The pay in column 3 for NNN is zero for this embodiment where there is no pay when the free ride is earned. In an embodiment where Free Ride also gives a pay value, the corresponding value would be placed in this column.

The $5^{th}$, $6^{th}$, $7^{th}$ and $8^{th}$ columns are computed in the same manner as the other rows.

The $9^{th}$ column (Points alive after roll) for the "NNN" rows is the same number of points that were alive at the start of the roll. In this embodiment the points that were available at the start of a free ride roll all remain available at the end of the roll. Other ways of handling this may be used without departing from the invention. For example, the rules could be defined such that after a Free Ride there is always 1 point available, that point being the number on all 3 dice on the free ride roll.

The "Probability of this Result" in Column 7 is copied to the right side column (11, 12 or 13) based on the number of points remaining for the NNN roll.

By comparing Table 10 below to Table 2 (Table 22 of the Ser. No. 09/709,922 application) you can see the results of incorporating this Free Ride rule. The return on this $2^{nd}$ stage is unchanged at 0.92284. This is as expected. In this embodiment there is always a $2^{nd}$ stage roll when the $2^{nd}$ stage is wagered upon ($1^{st}$ roll establishes 1, 2 or 3 points and pays for Bunco but never ends the game). The Free Ride feature while paying 0 moves some game ending rolls (which pay 0) to game continuing rolls (which also pay 0). On the bottom of the table where it is labeled "Probability of Start Condition for Next Stage" there is a difference in the $2^{nd}$ stage results. The probability of ending the $2^{nd}$ stage with 0 points active (game over) has been reduced from 0.2090 to 0.1929. Correspondingly, the probability of ending the $2^{nd}$ stage with 1, 2 or 3 points have each increased probability. This is due to the free rides changing game ending moves to game continuing moves.

TABLE 10

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 1 | AAA | 6 | 1 | 0.00462963 | 0.027777778 | 0.0001286 | 0 0007716 | 1 | | 0.0001286 | | |
| 1 | AAx | 1 | 15 | 0.069444444 | 0.027777778 | 0 00192901 | 0 001929 | 1 | | 0.001929 | | |
| 1 | Axx | 1 | 75 | 0.347222222 | 0.027777778 | 0.00964506 | 0.0096451 | 1 | | 0.0096451 | | |
| 1 | NNN | 0 | 5 | 0.023148148 | 0.027777778 | 0 000643 | 0 | 1 | | 0 000643 | | |
| 1 | xxx | 0 | 120 | 0.555555556 | 0.027777778 | 0.0154321 | 0 | 0 | 0.015432 | | | |
| | | | 216 | 1 | | | | | | | | |
| 2 | AAA | 6 | 1 | 0.00462963 | 0 416666667 | 0.00192901 | 0.0115741 | 1 | | 0.001929 | | |
| 2 | BBB | 6 | 1 | 0.00462963 | 0.416666667 | 0.00192901 | 0.0115741 | 1 | | 0.001929 | | |
| 2 | AAB | 2 | 3 | 0.013888889 | 0.416666667 | 0.00578704 | 0.0115741 | 2 | | | 0.005787 | |
| 2 | BBA | 2 | 3 | 0.013888889 | 0.416666667 | 0.00578704 | 0.0115741 | 2 | | | 0.005787 | |
| 2 | AAx | 1 | 12 | 0.055555556 | 0.416666667 | 0 02314815 | 0.0231481 | 1 | | 0.0231481 | | |
| 2 | BBx | 1 | 12 | 0.055555556 | 0.416666667 | 0.02314815 | 0.0231481 | 1 | | 0.0231481 | | |
| 2 | ABx | 1 | 24 | 0.111111111 | 0.416666667 | 0 0462963 | 0.0462963 | 2 | | | 0.0462963 | |
| 2 | Axx | 1 | 48 | 0.222222222 | 0.416666667 | 0.09259259 | 0.0925926 | 1 | | 0.0925926 | | |
| 2 | Bxx | 1 | 48 | 0.222222222 | 0.416666667 | 0.09259259 | 0.0925926 | 1 | | 0.0925926 | | |
| 2 | NNN | 0 | 4 | 0.018518519 | 0 416666667 | 0 00771605 | 0 | 2 | | | 0.007716 | |
| 2 | xxx | 0 | 60 | 0 277777778 | 0 416666667 | 0 11574074 | 0 | 0 | 0 115741 | | | |
| | | | 216 | 1 | | | | | | | | |
| 3 | AAA | 6 | 1 | 0.00462963 | 0 555555556 | 0 00257202 | 0 0154321 | 1 | | 0.002572 | | |
| 3 | BBB | 6 | 1 | 0.00462963 | 0.555555556 | 0.00257202 | 0.0154321 | 1 | | 0 002572 | | |
| 3 | CCC | 6 | 1 | 0 00462963 | 0.555555556 | 0.00257202 | 0.0154321 | 1 | | 0.002572 | | |
| 3 | AAB | 2 | 3 | 0.013888889 | 0 555555556 | 0.00771605 | 0 0154321 | 2 | | | 0 007716 | |
| 3 | AAC | 2 | 3 | 0.013888889 | 0.555555556 | 0.00771605 | 0.0154321 | 2 | | | 0.007716 | |
| 3 | BBA | 2 | 3 | 0 013888889 | 0 555555556 | 0.00771605 | 0.0154321 | 2 | | | 0 007716 | |
| 3 | BBC | 2 | 3 | 0.013888889 | 0.555555556 | 0.00771605 | 0.0154321 | 2 | | | 0.007716 | |
| 3 | CCA | 2 | 3 | 0.013888889 | 0.555555556 | 0.00771605 | 0.0154321 | 2 | | | 0.007716 | |

TABLE 10-continued

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 3 | CCB | 2 | 3 | 0.013888889 | 0.555555556 | 0 00771605 | 0 0154321 | 2 | | | 0.007716 | |
| 3 | ABC | 2 | 6 | 0.027777778 | 0.555555556 | 0.0154321 | 0 0308642 | 3 | | | | 0 0154321 |
| 3 | ABx | 1 | 18 | 0.083333333 | 0.555555556 | 0.0462963 | 0.0462963 | 2 | | | 0.0462963 | |
| 3 | ACx | 1 | 18 | 0.083333333 | 0555555556 | 0.0462963 | 0 0462963 | 2 | | | 0 0462963 | |
| 3 | BCx | 1 | 18 | 0.083333333 | 0.555555556 | 0.0462963 | 0.0462963 | 2 | | | 0 0462963 | |
| 3 | AAx | 1 | 9 | 0.041666667 | 0.555555556 | 0 02314815 | 0 0231481 | 1 | | 0.0231481 | | |
| 3 | BBx | 1 | 9 | 0.041666667 | 0.555555556 | 0.02314815 | 0.0231481 | 1 | | 0.0231481 | | |
| 3 | CCx | 1 | 9 | 0 041666667 | 0.555555556 | 0.02314815 | 0.0231481 | 1 | | 0.0231481 | | |
| 3 | Axx | 1 | 27 | 0 125 | 0 555555556 | 0.06944444 | 0.0694444 | 1 | | 0.0694444 | | |
| 3 | Bxx | 1 | 27 | 0 125 | 0.555555556 | 0.06944444 | 0 0694444 | 1 | | 0.0694444 | | |
| 3 | Cxx | 1 | 27 | 0 125 | 0 555555556 | 0.06944444 | 0 0694444 | 1 | | 0.0694444 | | |
| 3 | NNN | 0 | 3 | 0.013888889 | 0 555555556 | 0 00771605 | 0 | 3 | | | | 0.007716 |
| 3 | xxx | 0 | 24 | 0.111111111 | 0.555555556 | 0.0617284 | 0 | 0 | 0.061728 | | | |
| | | | 216 | 1 | | | | | | | | |
| | | | | | EV of 2nd Stage: | | 0.92284 | | | | | |
| | | | | | Prob. Of Start Cond. For Next Stage | | | | 0.1929 | 0.53318 | 0.25077 | 0.02315 |
| | | | | | Total of 4 probability values above | | | | | | | 1 |

Table 3 (Table 23 from the Ser. No. 09/709,922 application) for the $3^{rd}$ stage of the game would be modified to become Table 11 as shown below. The insertion of the 3 NNN rows is done in the same manner as described above.

As a result of the Free Rides from the $2^{nd}$ stage, the EV of the $3^{rd}$ stage shown at the bottom of Table 11 is now 0.932656 where it was only 0.902357 before the Free Ride feature was introduced. The increase in expected value for this stage, as a result of $2^{nd}$ stage free rides, occurred in this table because the column 6 "Probability of Start Condition" (of 1, 2 or 3 points on the $3^{rd}$ stage) is taken from those increased values at the bottom of Table 10.

At the bottom of Table 11, it can be seen that the probability of ending a game on the $3^{rd}$ stage with no active points has dropped from 0.3821 to 0.3684. As on the $2^{nd}$ stage, the probabilities of ending with 1, 2 or 3 points have each increased.

As in the Ser. No. 09/709,922 application embodiment, the other stages are computed in the same manner, after which the EV's from the respective stages are combined in the same manner shown in Table 9 (Table 29 of the Ser. No. 09/709,922 application). Once the Free Ride feature is added, the probabilities of Double Bunco and Triple Bunco at each stage will change. Unfortunately the symmetry that made Table 5 and 7 (Table 25 and Table 27 in the Ser. No. 09/709,922 application) so easy to create goes away with this Free Ride feature. However, one skilled in the art can expand each sample form as is done in Tables 4 and 6 (Tables 24 and 26 from the Ser. No. 09/709,922 application) and compute the probability.

TABLE 11

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 1 | AAA | 14 | 1 | 0.00462963 | 0.533179012 | 0.00246842 | 0.0345579 | 1 | | 0.002468 | | |
| 1 | AAX | 2 | 15 | 0.069444444 | 0.533179012 | 0.03702632 | 0.07405264 | 1 | | 0.037026 | | |
| 1 | Axx | 2 | 75 | 0.347222222 | 0 533179012 | 0.1851316 | 0.3702632 | 1 | | 0.185132 | | |
| 1 | NNN | 0 | 5 | 0.023148148 | 0 533179012 | 0 01234211 | 0 | 1 | | 0.012342 | | |
| 1 | xxx | 0 | 120 | 0 555555556 | 0.533179012 | 0.29621056 | 0 | 0 | 0.296211 | | | |
| | | | 216 | 1 | | | | | | | | |
| 2 | AAA | 14 | 1 | 0 00462963 | 0 250771605 | 0 00116098 | 0.01625372 | 1 | | 0.001161 | | |
| 2 | BBB | 14 | 1 | 0 00462963 | 0 250771605 | 0.00116098 | 0.01625372 | 1 | | 0.001161 | | |
| 2 | AAB | 5 | 3 | 0.013888889 | 0.250771605 | 0.00348294 | 0.01741469 | 2 | | | 0.003483 | |
| 2 | BBA | 5 | 3 | 0.013888889 | 0.250771605 | 0.00348294 | 0.01741469 | 2 | | | 0 003483 | |
| 2 | AAx | 2 | 12 | 0.055555556 | 0.250771605 | 0.01393176 | 0.02786351 | 1 | | 0.013932 | | |
| 2 | BBx | 2 | 12 | 0.055555556 | 0.250771605 | 0.01393176 | 0.02786351 | 1 | | 0.013932 | | |
| 2 | ABx | 2 | 24 | 0.111111111 | 0.250771605 | 0.02786351 | 0.05572702 | 2 | | | 0.027864 | |
| 2 | Axx | 2 | 48 | 0.222222222 | 0.250771605 | 0.05572702 | 0.11145405 | 1 | | 0 055727 | | |
| 2 | Bxx | 2 | 48 | 0.222222222 | 0 250771605 | 0.05572702 | 0 11145405 | 1 | | 0 055727 | | |
| 2 | NNN | 0 | 4 | 0 018518519 | 0 250771605 | 0.00464392 | 0 | 2 | | | 0.004644 | |
| 2 | xxx | 0 | 60 | 0 277777778 | 0 250771605 | 0.06965878 | 0 | 0 | 0.069659 | | | |
| | | | 216 | 1 | | | | | | | | |
| 3 | AAA | 14 | 1 | 0 00462963 | 0 023148148 | 0.00010717 | 0 00150034 | 1 | | | | |
| 3 | BBB | 14 | 1 | 0.00462963 | 0.023148148 | 0.00010717 | 0.00150034 | 1 | | 0.000107 | | |
| 3 | CCC | 14 | 1 | 0.00462963 | 0.023148148 | 0.00010717 | 0.00150034 | 1 | | 0.000107 | | |
| 3 | AAB | 5 | 3 | 0.013888889 | 0.023148148 | 0.0003215 | 0.00160751 | 2 | | | 0.000322 | |
| 3 | AAC | 5 | 3 | 0.013888889 | 0.023148148 | 0.0003215 | 0.00160751 | 2 | | | 0 000322 | |
| 3 | BBA | 5 | 3 | 0.013888889 | 0.023148148 | 0.0003215 | 0.00160751 | 2 | | | 0.000322 | |

TABLE 11-continued

| Points Alive at Round Start | Comb. | Pay | Occur. | Probability of Occurrence | Probability of Start Condition | Prob. Of This Result | EV | Points Alive After Roll | Prob. That Points Left = 0 | Prob. That Points Left = 1 | Prob. That Points Left = 2 | Prob. That Points Left = 3 |
|---|---|---|---|---|---|---|---|---|---|---|---|---|
| 3 | BBC | 5 | 3 | 0.013888889 | 0.023148148 | 0.0003215 | 0.00160751 | 2 | | | 0.000322 | |
| 3 | CCA | 5 | 3 | 0.013888889 | 0.023148148 | 0.0003215 | 0.00160751 | 2 | | | 0 000322 | |
| 3 | CCB | 5 | 3 | 0.013888889 | 0 023148148 | 0.0003215 | 0.00160751 | 2 | | | 0.000322 | |
| 3 | ABC | 5 | 6 | 0.027777778 | 0.023148148 | 0.000643 | 0.00321502 | 3 | | | | 0 000643 |
| 3 | ABx | 2 | 18 | 0 083333333 | 0.023148148 | 0.00192901 | 0.00385802 | 2 | | | 0.001929 | |
| 3 | ACx | 2 | 18 | 0.083333333 | 0.023148148 | 0.00192901 | 0.00385802 | 2 | | | 0.001929 | |
| 3 | BCx | 2 | 18 | 0.083333333 | 0.023148148 | 0.00192901 | 0.00385802 | 2 | | | 0.001929 | |
| 3 | AAx | 2 | 9 | 0.041666667 | 0.023148148 | 0 00096451 | 0.00192901 | 1 | | 0.000965 | | |
| 3 | BBx | 2 | 9 | 0.041666667 | 0.023148148 | 0.00096451 | 0.00192901 | 1 | | 0 000965 | | |
| 3 | CCx | 2 | 9 | 0.041666667 | 0.023148148 | 0 00096451 | 0.00192901 | 1 | | 0.000965 | | |
| 3 | Axx | 2 | 27 | 0.125 | 0.023148148 | 0.00289352 | 0.00578704 | 1 | | 0.002894 | | |
| 3 | Bxx | 2 | 27 | 0.125 | 0.023148148 | 0 00269352 | 0.00578704 | 1 | | 0.002894 | | |
| 3 | Cxx | 2 | 27 | 0.125 | 0.023148148 | 0.00289352 | 0.00578704 | 1 | | 0 002894 | | |
| 3 | NNN | 0 | 3 | 0 013888889 | 0.023148148 | 0 0003215 | 0 | 3 | | | | 0 000322 |
| 3 | xxx | 0 | 24 | 0.111111111 | 0 023148148 | 0.00257202 | 0 | 0 | 0.002572 | | | |
| | | | 216 | 1 | | | | | | | | |
| | | | | | EV of 3rd Stage: | | 0.932656 | | | | | |
| | | | | | Prob. Of Start Cond. For Next Stage | | | | 0.3684 | 0.3905 | 0.0472 | 0.00096 |
| | | | | | Total of 4 probability values above | | | | | | | 0.8071 |

Table 12 shows the revised Table 9 (Table 29 from the Ser. No. 09/709,922 application) incorporating the modified EV values that resulted from introducing the Free Ride feature. The resulting 7 stage game has an Expected Value that has now grown (as expected) to 1.027195 which means that on average in the long run the 7 stage game will return more money than is wagered.

TABLE 12

| Stage | Base Game EV | Double Bunco EV | Triple Bunco EV | Total EV For Stage | EV of Game Playing this many stages |
|---|---|---|---|---|---|
| 1 | 0.888889 | 0 | 0 | 0.888889 | 0.888889 |
| 2 | 0.922840 | 0.009645 | 0 | 0.932485 | 0.910687 |
| 3 | 0.932656 | 0.008261 | 0.001488 | 0.942405 | 0.921260 |
| 4 | 1.002388 | 0.005370 | 0.001929 | 1.009687 | 0.943366 |
| 5 | 1.091862 | 0.003121 | 0.001677 | 1.096660 | 0.974025 |
| 6 | 1.130410 | 0.001706 | 0.001219 | 1.133335 | 1.000577 |
| 7 | 1.185212 | 0.000897 | 0.000799 | 1.186908 | 1.027195 |

To bring the return into the typical 85-95% range of popular casino equipment the paytable values need to be modified. The paytable in Table 13 reflects one possible substitution of paytable values that could be used to bring the expected return back into an acceptable range. Other values could be used without departing from the invention.

TABLE 13

| Stage | Match 1 Point | Match 2 Points | Match 3 Points | BUNCO |
|---|---|---|---|---|
| 1 | 0 | 0 | 0 | 31 |
| 2 | 1 | 1 | 2 | 6 |
| 3 | 2 | 2 | 5 | 12 |
| 4 | 4 | 6 | 14 | 20 |
| 5 | 8 | 19 | 30 | 35 |
| 6 | 20 | 35 | 60 | 70 |
| 7 | 45 | 70 | 200 | 300 |

When the Table 13 paytable values are substituted, the expected return of the 7 stages of the game become the values shown in Table 14.

TABLE 14

| Stage | Base Game EV | Double Bunco EV | Triple Bunco EV | Total EV For Stage | EV of Game Playing this many stages |
|---|---|---|---|---|---|
| 1 | 0.861111 | 0 | 0 | 0.861111 | 0.861111 |
| 2 | 0.922840 | 0.009645 | 0 | 0.932485 | 0.896798 |
| 3 | 0.922432 | 0.008261 | 0.001488 | 0.932182 | 0.908592 |
| 4 | 0.920520 | 0.005370 | 0.001929 | 0.927819 | 0.913399 |
| 5 | 0.924662 | 0.003121 | 0.001677 | 0.929460 | 0.916611 |
| 6 | 0.931292 | 0.001706 | 0.001219 | 0.934217 | 0.919546 |
| 7 | 0.933808 | 0.000897 | 0.000799 | 0.935504 | 0.921825 |

Analysis of the Bonus Game

An embodiment shown above incorporates a Bonus game. There are many possible ways in which a bonus game could be initiated from a base game result. For example, a bonus game could occur on any Bunco. Alternatively, a bonus game could occur when 2 consecutive rolls yield the identical result. The embodiment shown here attaches a secondary symbol to certain sides of certain dice and initiates a bonus round any time on the $3^{rd}$ stage or later that all 3 dice show a face that include the special secondary bonus round symbol. In this embodiment the secondary symbols are always shown with the same die face (number) and thus the probability of selecting these symbols is limited to "n in 6" dice odds. The secondary symbol could be calculated off of an independent weighted table and then shown with the die face without departing from the invention.

Table 15 has the data on which the bonus game is based. The board position labeled "start" is designated as space '1' in the $1^{st}$ column of Table 15. The player moves clockwise (around the screen) to higher numbered spaces. There are a total of 39 spaces in the trail. The trail is constructed such that the player's game will always end when landing in any of the last 6 spaces, either landing on a "game over" space or winning the top award of 5000 credits. At the beginning of each move that the player may make, the board is updated so that the next 6 squares in the clockwise direction of the board contain the next 6 values in Table 15 so while it appears that the player is traveling around a circle, it is really a linear trail of 39 possible spaces being shown 7 positions at a time on a circular path.

This bonus game has a skill element. There are certain squares where you will get the highest expected value for stopping. Other squares offer the highest expected value for continuing. Table 15 is constructed to show the amount that will be paid on average using the optimal strategy. Deviations made by the player will, in the long run reduce the expected return of this bonus round.

The $2^{nd}$ column of Table 15 shows the payment amount for the space on the board. The amounts are all increasing except that all "Game Over" squares have a value of 5 credits. The $3^{rd}$ column indicates whether the square is a "Game over" square. "Y" indicates the square is a "Game over" square, "N" indicates it is a normal credit value square.

The $4^{th}$ and $5^{th}$ columns are used to determine the optimal expected return for rolling the dice from a game square. As stated before, the last 6 squares (rows 34-39) automatically end the game so the "Best EV" for these squares is fixed at the value of the squares, which is shown in the Best EV column 5. Now, the rest of these 2 columns is created by starting in row 33 and working toward the beginning of the table. The "Roll EV" column 4 value is the expected value for going ahead and rolling the dice from that square. It is computed as the average "Best EV" of the next 6 squares. For row 33, the Roll EV value is the average of the Best EV values for rows 34 through 39. This result is (5+5+5000+5+5+5)/6=837.5. Now, for row 33 the "Best EV" value is the greater of the column 2 "Pay Amount" and the Column 4 "Roll EV" value. In the case of row 33 this is 1000. The column 6 "Strategy" value is set to "collect" if the Pay Amount is larger and to "Roll Die" if the Roll EV is higher. This is the optimal strategy whenever landing in this square.

Moving up to row 32, this is a "Game Over" square. It has a Best EV of 5 (column 5) and a Strategy of "End" since there is no choice for the player landing in this square.

Row 31 computes Roll EV of (5+1000+5+5+5000+5)/6=1003.3333. Since this value is higher than the column 2 value for stopping in this space, the 1003.3333 is placed in the Best EV column 5 and "Roll Die" is placed in Column 6.

This process is continued for all rows from 30 up through row 1.

Column 7 is the "Land On Probability". This is the probability of landing on this square in a bonus game. It is based on the optimum strategy determined in column 6. The probability of landing on the start square is 1 as each game starts on this square. For each square below row 1 the land on probability is based on the 6 rows above it. For each of the 6 rows above it, if the strategy column for that row says "Roll Die" then 1/6 of that row's "Land on Probability" is accumulated. The total is placed in the current row's Land on Probability. The 1/6 is used because that is the probability of rolling from that square above to the current square (1 of the 6 die numbers will get you from the square above to the current square). For row 2 the Land on Probability is 1/6=0.166667. For row 3 the Land on Probability is 1/6+0.166667/6=0.1944444. For row 18, the Land on Probabilities from rows 12-17 are examined and values from rows 12, 13 and 16 are used since these rows have "Roll Die" as their strategy (square 18 cannot be hit from squares 14, 15 or 17 since the game would end on any of these squares). This results in 0.22627/6+0.21252/6+0.15026/6=0.09818.

Column 8 shows the probability of ending a game on each square. Using optimum strategy the game may end in any square with a strategy of "End" or "Collect". In these rows the "Land on Probability" is copied to the "Ending Probability" column. All "Roll Die" rows get 0 in the "Ending Probability" column since a player using optimum strategy will always continue to a different square from these squares.

The sum of all of the Ending Probability elements is 1.0 as expected, defining all possible ending positions.

The final column is the Expected Value (EV) of each square. It is the $2^{nd}$ column pay amount times the $8^{th}$ column Ending Probability. The sum of all Expected value components comes to 39.6527, which is the expected value of the entire bonus game. Players playing the bonus game optimally will win 39.6527 credits on average.

TABLE 15

| SPACE | PAY AMT | GAME OVER? | ROLL EV | BEST EV | STRATEGY | LAND ON PROBABILITY | ENDING PROBABILITY | EXPECTED VALUE |
|---|---|---|---|---|---|---|---|---|
| 1 | | N | 39.6527 | 39.6527 | ROLL DIE | 1 | 0 | 0 0000 |
| 2 | 4 | N | 34.7023 | 34.7023 | ROLL DIE | 0.166666667 | 0 | 0 0000 |
| 3 | 8 | N | 36.3881 | 36.3881 | ROLL DIE | 0 194444444 | 0 | 0 0000 |
| 4 | 12 | N | 38.3585 | 38.3585 | ROLL DIE | 0 226851852 | 0 | 0 0000 |
| 5 | 16 | N | 41.0642 | 41.0642 | ROLL DIE | 0 264660494 | 0 | 0 0000 |
| 6 | 20 | N | 42.3160 | 42.3160 | ROLL DIE | 0.308770576 | 0 | 0 0000 |
| 7 | 24 | N | 45.0870 | 45.0870 | ROLL DIE | 0 360232339 | 0 | 0 0000 |
| 8 | 5 | Y | | 5 | END | 0.253604395 | 0.253604395 | 1 2680 |
| 9 | 30 | N | 46.5031 | 46.5031 | ROLL DIE | 0.225826618 | 0 | 0 0000 |
| 10 | 35 | N | 50.1809 | 50.1809 | ROLL DIE | 0.23105698 | 0 | 0 0000 |
| 11 | 40 | N | 57.2979 | 57.2979 | ROLL DIE | 0 231757834 | 0 | 0 0000 |
| 12 | 45 | N | 49.8268 | 49.8268 | ROLL DIE | 0.226274058 | 0 | 0 0000 |
| 13 | 50 | N | 61.7131 | 61.7131 | ROLL DIE | 0 212524638 | 0 | 0.0000 |
| 14 | 55 | N | 53.3798 | 55 | COLLECT | 0.187906688 | 0.187906688 | 10 3349 |
| 15 | 5 | Y | | 5 | END | 0.187906688 | 0.187906688 | 0.9395 |
| 16 | 70 | N | 72.2477 | 72.2477 | ROLL DIE | 0.150268918 | 0 | 0 0000 |
| 17 | 100 | N | 96.3604 | 100 | COLLECT | 0 136804241 | 0.136804241 | 13.6804 |
| 18 | 5 | Y | | 5 | END | 0 098177936 | 0.098177936 | 0 4909 |
| 19 | 125 | N | 133.0311 | 133.0311 | ROLL DIE | 0.060465593 | 0 | 0 0000 |
| 20 | 5 | Y | | 5 | END | 0 035122419 | 0.035122419 | 0.1756 |
| 21 | 150 | N | 185.4552 | 185.4552 | ROLL DIE | 0.035122419 | 0 | 0.0000 |
| 22 | 5 | Y | | 5 | END | 0 040976155 | 0.040976155 | 0 2049 |
| 23 | 200 | N | 244.6759 | 244 6759 | ROLL DIE | 0 015931335 | 0 | 0.0000 |
| 24 | 5 | Y | | 5 | END | 0 018586558 | 0 018586558 | 0.0929 |
| 25 | 250 | N | 353.0556 | 353.0556 | ROLL DIE | 0.018586558 | 0 | 0.0000 |
| 26 | 5 | Y | | 5 | END | 0.011606719 | 0.011606719 | 0.0580 |

TABLE 15-continued

| SPACE | PAY AMT | GAME OVER? | ROLL EV | BEST EV | STRATEGY | LAND ON PROBABILITY | ENDING PROBABILITY | EXPECTED VALUE |
|---|---|---|---|---|---|---|---|---|
| 27 | 500 | N | 436.3889 | 500 | COLLECT | 0.011606719 | 0.011606719 | 5.8034 |
| 28 | 5 | Y | | 5 | END | 0.005752982 | 0.005752982 | 0.0288 |
| 29 | 600 | N | 337.2222 | 600 | COLLECT | 0.005752982 | 0.005752982 | 3 4518 |
| 30 | 5 | Y | | 5 | END | 0 00309776 | 0.00309776 | 0 0155 |
| 31 | 750 | N | 1003.3333 | 1003 3333 | ROLL DIE | 0.00309776 | 0 | 0.0000 |
| 32 | 5 | Y | | 5 | END | 0.000516293 | 0.000516293 | 0 0026 |
| 33 | 1000 | N | 837.5000 | 1000 | COLLECT | 0.000516293 | 0.000516293 | 0.5163 |
| 34 | 5 | Y | | 5 | END | 0.000516293 | 0.000516293 | 0 0026 |
| 35 | 5 | Y | | 5 | END | 0 000516293 | 0.000516293 | 0 0026 |
| 36 | 5000 | N | | 5000 | COLLECT | 0.000516293 | 0.000516293 | 2.5815 |
| 37 | 5 | Y | | 5 | END | 0.000516293 | 0.000516293 | 0.0026 |
| 38 | 5 | Y | | 5 | END | 0 | 0 | 0.0000 |
| 39 | 5 | Y | | 5 | END | 0 | 0 | 0.0000 |
| TOTALS | | | | | | | 1 | 39.6527 |

In order to complete the analysis we must determine the EV contribution on each stage of this bonus game. In the example given, 2 of the dice have a secondary bonus symbol on a single face, while the $3^{rd}$ die has 2 faces containing the secondary bonus symbol. This gives 2 possible ways to initiate the bonus game (1×1×2=2) out of the 216 possible rolls of 3 dice. The probability of initiating the bonus game on any roll in the $3^{th}$ stage or higher is 2/216=0.009259.

Table 16 shows the calculation for the probability of initiating a bonus round on each stage. The first column indicates the stage. The next 3 columns indicate the probability of ending that stage with 1, 2 or 3 points active. The numbers in these columns for stage 1 come from Table 1 (Table 21 of the Ser. No. 09/709,922 application). The numbers in these columns for stage 2 come from the bottom of Table 10. The numbers in these columns for stage 3 come from the bottom of Table 11. The numbers for the other stages are taken from the similar tables to Table 10 and Table 11 that aren't shown.

The $5^{th}$ column of Table 16 is the probability of rolling the bonus initiator which is the 2/216 constant described above.

The $6^{th}$ column is the product of the $5^{th}$ column with the sum of columns 2, 3 and 4 from the line above. The sum of columns 2, 3, 4 of the line above is the probability that the game will actually roll the stage for the current line. For example, the probability of actually rolling the dice for stage 3 is the sum of columns 2, 3 and 4 for stage 2 (0.533179+0.250772+0.023148)=0.807099. The Probability of getting a bonus round initiator in stage 3 is 0.807099*0.009259=0.007473.

The $7^{th}$ column is the Expected Pay from the bonus round which was computed above. The $8^{th}$ column is the EV contribution by level of the bonus round which is the product of the $6^{th}$ and $7^{th}$ columns.

Finally, the EV of the bonus game is worked into the overall EV of the game in the manner used in Table 9 (Table 29 of the Ser. No. 09/709,922 application) to combine the EV components.

Betting Modification

Another variation of the game is based on a modification in the betting structure. In the previously described games, a bet of 1 credit is required per stage. This bet may then be scaled by up to an arbitrary 5 credits per stage. In this modification, 1 credit is required to be bet for each die on each stage. This modification has the advantage of requiring a higher minimum bet to wager on all of the possible stages. It also has the advantage of providing more granularity in paytable design. The introduction of the bet per die concept also raises a few problems, including how to handle bets on only 1, 2 or 3 dice as well as other bets that don't include entire stages.

One way to implement the wagering on total possible dice would be to use the previously described model where each level has an independent return and the expected returns for the levels are combined in the manner of Table 9 (Table 29 of the Ser. No. 09/709,922 application). Each stage that received the 3 credit bet (for all 3 dice) could have pay values of 3 times those shown in the previous examples. The Bonus game and Double and Triple Bunco Bonuses could also be tripled. In this embodiment all that is left to do to convert the bet-per-stage game into the bet-per-die game is to handle the cases where the last one or two dice bet are not part of a complete level (i.e. the total number of dice bet is not a multiple of 3). The handling of these "odd dice" is different on the $1^{st}$ stage than on later stages. On the $1^{st}$ stage, when only one die is wagered upon, there is nothing within the roll to match up (such as in the previously described

TABLE 16

| Stage | 1 point Remains | 2 points Remain | 3 points Remain | Prob. Bonus Roll | Prob. Bonus Round | Pay | Bonus Round EV |
|---|---|---|---|---|---|---|---|
| 1 | 0.027778 | 0.416667 | 0.555556 | | | | |
| 2 | 0.533179 | 0.250772 | 0.023148 | | | | |
| 3 | 0.390504 | 0.047189 | 0.000965 | 0.009259 | 0.007473 | 39.65268 | 0.29633 |
| 4 | 0.200706 | 0.007749 | 4.01878E−05 | 0.009259 | 0.004062 | 39.65268 | 0.16106 |
| 5 | 0.093600 | 0.001233 | 1.67449E−06 | 0.009259 | 0.001931 | 39.65268 | 0.07655 |
| 6 | 0.042298 | 0.000195 | 6.97704E−08 | 0.009259 | 0.000878 | 39.65268 | 0.03482 |
| 7 | 0.018909 | 3.07E−05 | 2.9071E−09 | 0.009259 | 0.000393 | 39.65268 | 0.01560 |

game where 3 matching dice on the $1^{st}$ stage pays for a Bunco). A solution for this is to require the player to match the number "6" to get paid when 1 die is rolled. The number to be matched could be different, could change each game or be selected by the player without departing from the invention. The number to be matched could be multiple numbers such as a range of numbers if a higher hit rate is desired. For 2 dice rolled there are more options. While the preferred choice is to pay for 1 or 2 sixes rolled, the pay could be made only when the 2 rolled dice showed matching numbers among other possibilities.

Table 17 shows the simple computation of the 1 die game where the player is required to match a six to get paid. The probability is 1/6=0.1666667, the probability of rolling a 6. The pay of 5 times the probability results in an expected value of 0.833333.

TABLE 17

| Result | Probability | Pay | EV |
|---|---|---|---|
| 1 six | 0.166666667 | 5 | 0.833333 |
| 0 sixes | 0.833333333 | 0 | 0 |

Table 18 shows the simple computation of the 2 dice game where the player is required to match 1 or 2 sixes to get paid.

TABLE 18

| Result | Probability | Pay | EV |
|---|---|---|---|
| 2 sixes | 0.027777778 | 10 | 0.277778 |
| 1 six | 0.277777778 | 2 | 0.555556 |
| 0 sixes | 0.694444444 | 0 | 0 |
| | 1 | | 0.833333 |

On higher levels, the "odd dice" are only paid for matching active points as is required on the $2^{nd}$ level and higher when 3 dice are rolled on the highest wagered level. The paytable for 1 and 2 matching points when only 1 or 2 dice are rolled on an upper level are modified based on the probability of these results, to arrive at a similar EV as when 3 dice are rolled on the level. The odd dice on level 3 (when 7 or 8 dice are bet upon) will be examined to illustrate this point.

In the Table 14 configuration, the EV of the $3^{rd}$ stage is 0.932182. When 1 or 2 dice are rolled on the $3^{rd}$ stage (for 7 and 8 dice bet upon respectively) it would be desirable to set the return in the vicinity of this number. Table 19 shows the probability of having 1 die match any point on the $3^{rd}$ level. This probability is made up of 3 components where each component is based on the number of points that were active at the end of the $2^{nd}$ roll. The $2^{nd}$ column of table 19 shows the probability of ending the $2^{nd}$ stage with 1, 2 or 3 points. These values are taken from the bottom of Table 10. The $3^{rd}$ column is the probability of 1 die matching the number of points in column 1. The $4^{th}$ column is the probability component (of matching any point with 1 die) for rolling with the column 1 points, and is the product of the $2^{nd}$ and $3^{rd}$ column values. The sum of these 3 probability components yields the probability of matching 1 die to an active point on the $3^{rd}$ stage.

TABLE 19

| | Probability of this many Points at end of Roll 2 | Probability of matching 1 die to any point | Probability Component |
|---|---|---|---|
| 1 Point | 0.533179012 | 0.166666667 | 0.08886317 |
| 2 Points | 0.250771605 | 0.333333333 | 0.08359053 |
| 3 Points | 0.023148148 | 0.5 | 0.01157407 |
| Total Probability of point match: | | | 0.18402778 |

Table 20 shows the EV for 1 die thrown on the $3^{rd}$ stage.

TABLE 20

| Result | Probability | Pay | EV |
|---|---|---|---|
| 1 point match | 0.184027778 | 5 | 0.920139 |
| no point match | 0.815972222 | 0 | 0 |

For the 8 dice bet upon case we use the same technique as above to independently determine the probability for matching 1 or 2 points. Table 21 shows the probability of matching 1 point with 2 dice rolled on the $3^{rd}$ stage. The $1^{st}$ and $2^{nd}$ column are the same as Table 19. The $3^{rd}$ column is now the probability of rolling 1 matching die out of 2 dice rolled. When there is 1 point to match, this probability is 1/6*5/6*2=0.277777778. When there are 2 points to match, this probability is 2/6*4/6*2=0.444444444. When there are 3 points to match, this probability is 3/6*3/6*2=0.5.

TABLE 21

| | Probability of this many Points at end of Roll | Probability of matching 1 die to any 2 point | Probability Component |
|---|---|---|---|
| 1 Point | 0.533179012 | 0.277777778 | 0.14810528 |
| 2 Points | 0.250771605 | 0.444444444 | 0.11145405 |
| 3 Points | 0.023148148 | 0.5 | 0.01157407 |
| Total Probability of point match: | | | 0.2711334 |

Table 22 shows the probability of matching 2 points with 2 dice rolled on the $3^{rd}$ stage. Now the $3^{rd}$ column shows the probability of matching 2 active points with the 2 rolled dice.

TABLE 22

| | Probability of this many Points at end of Roll 2 | Probability of matching 2 dice to active points | Probability Component |
|---|---|---|---|
| 1 Point | 0.533179012 | 0.027777778 | 0.01481053 |
| 2 Points | 0.250771605 | 0.111111111 | 0.02786351 |
| 3 Points | 0.023148148 | 0.25 | 0.00578704 |
| Total Probability of point match: | | | 0.04846108 |

Table 23 now shows the return of the $3^{rd}$ stage in an 8 dice game where only 2 dice are rolled on the $3^{rd}$ stage. Given the probabilities from table 21 and 22 the pay values of 16 for 2 matching points and 4 for matching 1 point are selected to result in a return on this third stage of 0.929955.

TABLE 23

| Result | Probability | Pay | EV |
|---|---|---|---|
| 2 point match | 0.048461077 | 16 | 0.387689 |
| 1 point match | 0.271133402 | 4 | 0.542267 |
| | | | 0.929955 |

Single Bet Embodiments

Another embodiment uses a single bet on the entire game and pays the player based on the entire progress of the game. In this embodiment, the paytable shows pays for the total number of points matched throughout the game. In a first variation of this embodiment the player selects a single number as the point for the game after rolling the first roll. To begin the game the player initiates a bet using the "Coins Per Bet" button. The player may wager from one to an arbitrary five credits on each game. The paytable and Bonus values are scaled by the value of the bet as is well known in the art. The maximum value may take any value without departing from the invention.

The player begins the game by pressing the "Deal" button to obtain a first roll. The player selects a number from the first roll as the point for the game. If there is a duplicate number in the roll, it is to the player's advantage to select that number because the player will own two or three matching dice for that selection. The player completes several rolls up to a predetermined number of rolls as long as at least one die of each roll matches the point. As the player makes a roll, the total number of matches is counted and the corresponding line of matches in a paytable is highlighted to inform the player of any progress in the game. When the player does not match the point in a roll, the game is over. When the game is over, the matches are added up and the player is paid any winnings according to the paytable.

In addition to the pays from the paytable for the total number of points accumulated in the game, the player is able to win a bonus for rolling a Bunco (three numbers matching the current Bunco Point). In this embodiment, rolling a Bunco pays the paytable value, and the Bunco bonus and ends the game. The game could be modified to have the game continue after rolling a Bunco without departing from the invention. The game could also pay the Bonus instead of the paytable value without departing from the invention.

FIG. 28 depicts this embodiment of the invention. The game 800 displays three dice 802, 804, and 806, all of which is physically displayed on a screen or video monitor 810 as shown in FIG. 28. Each of the three dice 802, 804, and 806 can again be envisioned as having six sides, with each die displaying only one of its six sides, just as traditional dice. Again, each of the six sides of each die reveals one to six pips, respectively. The first side displays a single pip, side two displays two pips, and so on. The sides of each die are arranged such that the sum of the pips of opposing sides total to equal seven pips. In this embodiment, first die 802 is revealing the first side with one pip. The second die 804 is revealing the sixth side with six pips. The third die 806 is revealing the first side with one pip.

FIG. 28 also shows the video monitor 810 displaying a message area 812, a "Credits" meter 814, a "Paid" meter 840, a "Bet" meter 824, a "Coins Per Bet" button 820, a "Deal/Submit" button 838, a Paytable 851, a "Bunco Point" indicator 856, and a "3 of a Kind" Paytable 859.

FIG. 28 also shows the video monitor 810 displaying the Paytable 851 that has a column 859 to indicate possible payouts for three of a kind matching the Bunco point. Additionally, three columns 860, 862, 864 represent a history of each roll or round in a series of eight rolls of the game 800. FIG. 28 displays representations of the first roll in the first row of the three columns 860, 862, 864.

The Paytable 851 has ten rows 841, 842, 843, 844, 845, 846, 847, 848, 849, and 850. Each of the ten rows of the Paytable 851 corresponds to a possible result from the possible eight rolls of the game 800.

As shown in FIG. 29, the player picks a Bunco Point after the first roll by any of the well-known methods in the art. Once the player picks the Bunco Point, a representation of that die is displayed in the "Bunco Point" indicator 856. In this roll the player "rolled" two die each showing a single pip. Wisely, the player chooses the Bunco Point to be a die with one pip. Now, the player has collected two Bunco Points, which is indicated by row 842 being highlighted.

Figure 30:
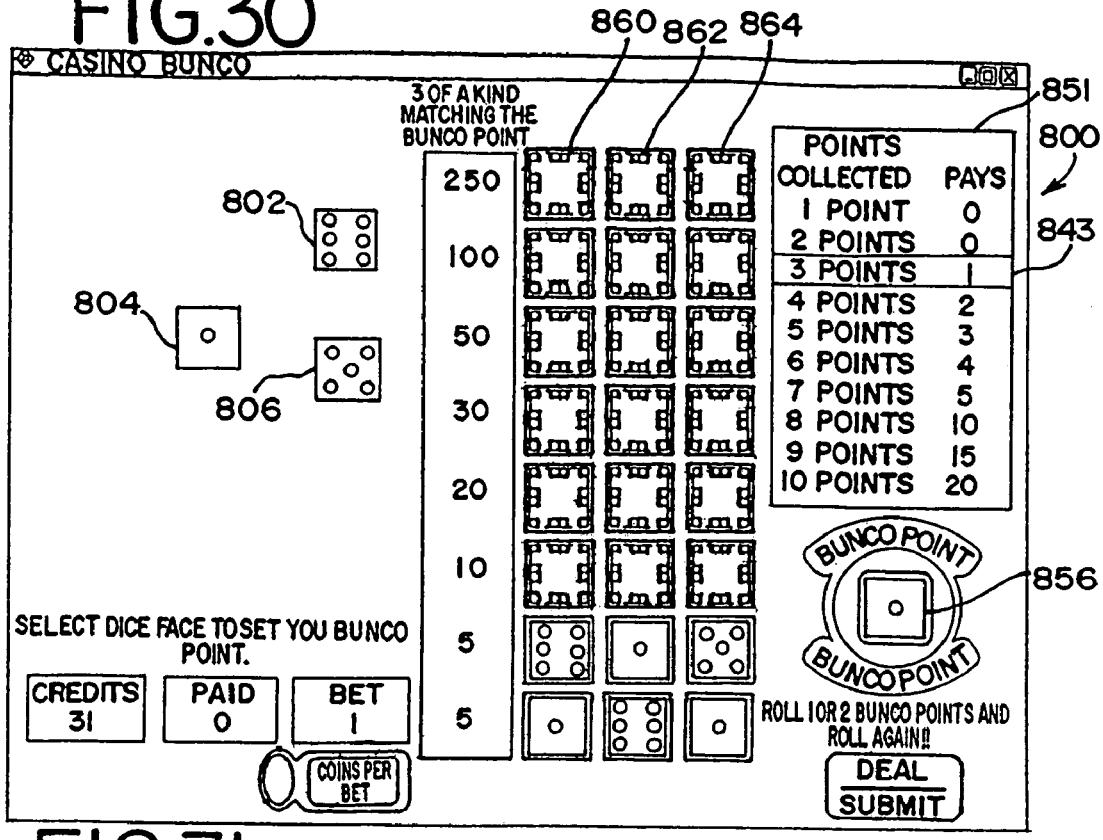

FIG. 30 shows the result of the second roll of this particular game play. In this roll, the player gets a six on the first die 802, a one on the second die 804, and a five on the third die 806. The second row of the three columns 860, 862, 864 represents this roll. Since the player has matched the Bunco Point three times within the two rolls, the player has won one credit as represented by row 843 being highlighted in the Paytable 851.

Figure 31:
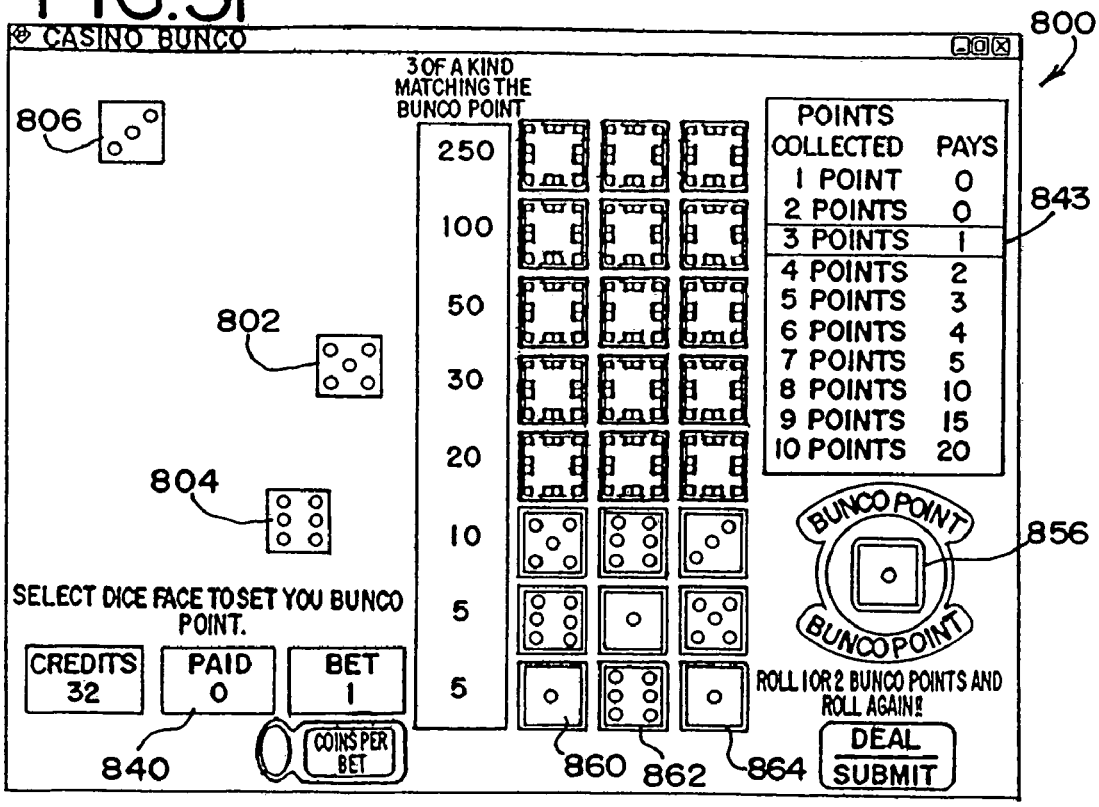

FIG. 31 displays the result of the third roll of this game 800. In this roll, the player gets a five on the first die 802, a six on the second die 804, and a three on the third die 806. The third row of the three columns 860, 862, 864 represents this roll. The player has not increased the number of Bunco Points matched, so the highlighted row 843 of the Paytable does not change and the game is over. It should be noted that the "Paid" meter 840 is updated in FIG. 31 to reflect this one credit win.

The analysis of this embodiment is done in a very similar manner as the other embodiments, where the probability of each roll sequence is laid out on a spreadsheet to determine all possible games with each number of points from 1 to 17 and the number of Buncos earned at each roll number. The many pages of enumerating combinations as was done in Table 10 and Table 11 have been omitted but result in the summary shown in Table 26 indicating that the return on this embodiment is 0.911282905 or 91.13%. Note that while not shown on the paytable in FIGS. 28-31, this embodiment pays for up to 17 points which is the highest number possible when a maximum of 8 rolls are allowed (2 points on each of the first 7 rolls and 3 points on the $8^{th}$ roll).

TABLE 26

| PAYTABLE FOR POINTS COMPLETED | | | | |
|---|---|---|---|---|
| Points Made | pay | probability | EV | 1 in X Games |
| 17 | 500 | 2.16352E-10 | 1.08176E-07 | 4622106472 |
| 16 | 200 | 1.00243E-08 | 2.00486E-06 | 99757693.6 |
| 15 | 100 | 2.10813E-07 | 2.10813E-05 | 4743541.13 |
| 14 | 50 | 2.61335E-06 | 0.000130668 | 382650.049 |
| 13 | 40 | 2.09942E-05 | 0.000839767 | 47632.2364 |
| 12 | 30 | 0.000114185 | 0.00342554 | 8757.74342 |
| 11 | 25 | 0.000431301 | 0.010782527 | 2318.56587 |
| 10 | 20 | 0.001167724 | 0.023354473 | 856.366996 |
| 9 | 15 | 0.002449769 | 0.03674653 | 408.201807 |
| 8 | 10 | 0.004662383 | 0.046623833 | 214.482581 |
| 7 | 5 | 0.009245709 | 0.046228545 | 108.158282 |
| 6 | 4 | 0.018858942 | 0.075435767 | 53.0252447 |
| 5 | 3 | 0.038843501 | 0.116530504 | 25.7443322 |
| 4 | 2 | 0.077351255 | 0.154702509 | 12.9280385 |

TABLE 26-continued

| | | | | |
|---|---|---|---|---|
| 3 | 1 | 0.172590144 | 0.172590144 | 5.79407363 |
| 2 | 0 | 0.352759202 | | 2.83479494 |
| 1 | 0 | 0.321502058 | | 3.1104 |
| | | Total Point EV: | 0.687414002 | |

PAYTABLE FOR BUNCO PAYS

| Level | pay | probability | EV | 1 in X Games |
|---|---|---|---|---|
| 8 | 250 | 2.35529E-05 | 0.005888224 | 42457.6212 |
| 7 | 100 | 5.6527E-05 | 0.005652695 | 17690.6755 |
| 6 | 50 | 0.000135665 | 0.006783234 | 7371.11479 |
| 5 | 30 | 0.000325595 | 0.009767858 | 3071.29783 |
| 4 | 20 | 0.000781429 | 0.015628572 | 1279.70743 |
| 3 | 10 | 0.001875429 | 0.018754287 | 533.211429 |
| 2 | 5 | 0.004501029 | 0.022505144 | 222.171429 |
| 1 | 5 | 0.027777778 | 0.138888889 | 36 |
| | | Total Bunco EV: | 0.22386890 | |
| | | TOTAL EV FOR GAME: | 0.91128290 | |

Another variation of the single bet embodiment uses the multiple point structure shown in the multiple stage embodiments. Specifically, all numbers rolled on the first roll become points to be matched and remain points to be matched as long as they are rolled on subsequent rolls. As in the previous variation, the player is paid based on the total number of points rolled in the entire game. Given that the player always matches 3 points on the first roll and usually has multiple points to roll to stay alive it is likely to get a much higher point count than the previous variation. One way to handle this would be to move the first paying value to a much higher number of matching points. Another method is used in this variation, which requires the bet to be an even number of credits. This allows the lowest pays in the paytable to be ½ the bet amount to allow a greater hit rate and to not make it require such a great number of points to get paid. In this variation the player receives half the bet back once 5 dice match active points. It could be architected higher or lower without departing from the invention. The game could also be constructed allowing any bet and only paying in multiples of this bet.

Figure 32:
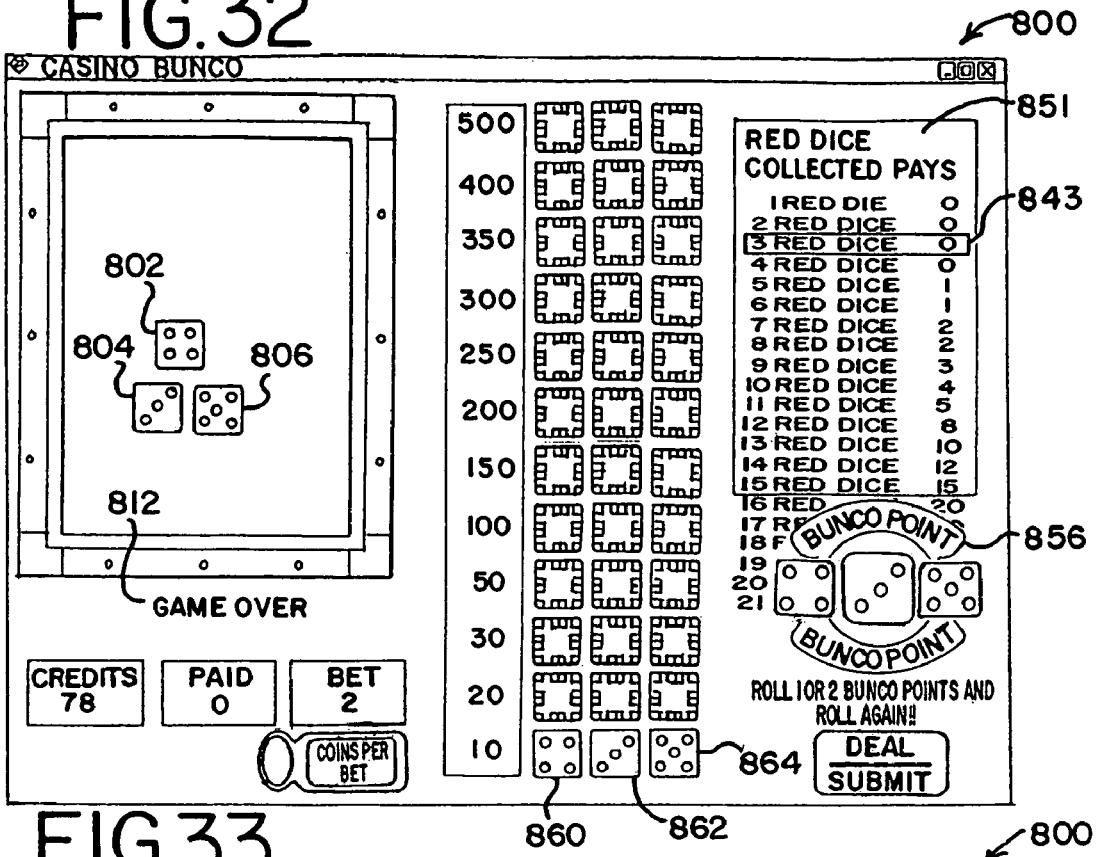
FIGS. 32 through 35 show various views of game displays of another embodiment of the invention.

FIG. 32 displays the result of the first roll of this new embodiment of the invention. In this game 800, the video monitor 810 displays a Paytable 851 with up to twenty-five possible payouts as displayed in the Paytable 851. Of course the probability of this happening or being needed is extremely low. This Paytable 851 can "scroll" further down, if needed, to represent the number of matches and corresponding payout. Instead of picking a single Bunco Point as in the previous embodiment, the game automatically sets up to three Bunco Points 856 that coincide with the values of the three dice 802, 804, 806 from the first roll. Again, representations of the three dice 802, 804, 806 are displayed in the first row of the three columns 860, 862 and 864. As before, the Paytable 851 is updated to highlight a row that corresponds to the number of Bunco Points 856 that has been matched. In this embodiment, the game 800 obviously highlights row 843 of the Paytable 851 since the values of the first roll become the Bunco Points 856.

Figure 33:
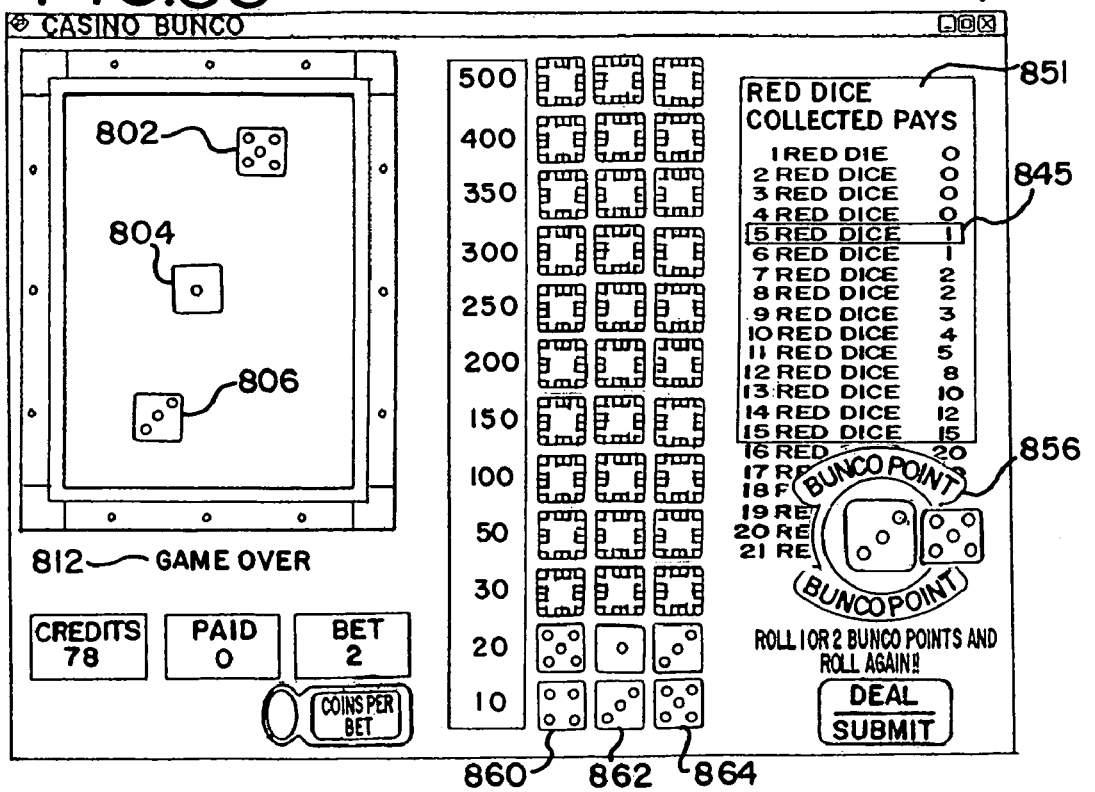

FIG. 33 displays the result of the second roll of this hand of this embodiment. This roll results in the player getting a five on the first die 802, a one on the second die 804, and a three on the third die 806. The second row of the three columns 860, 862, 864 also represents this roll. In this roll, the player matched two of the three Bunco Points 856. The Bunco Point that was not matched disappears from the "Bunco Point" indicator 856 and cannot be used in future rolls to tally additionally matches. The final result of this second roll is a total of five Bunco Points being matched, as is highlighted in line 845 of the Paytable 851.

Figure 34:
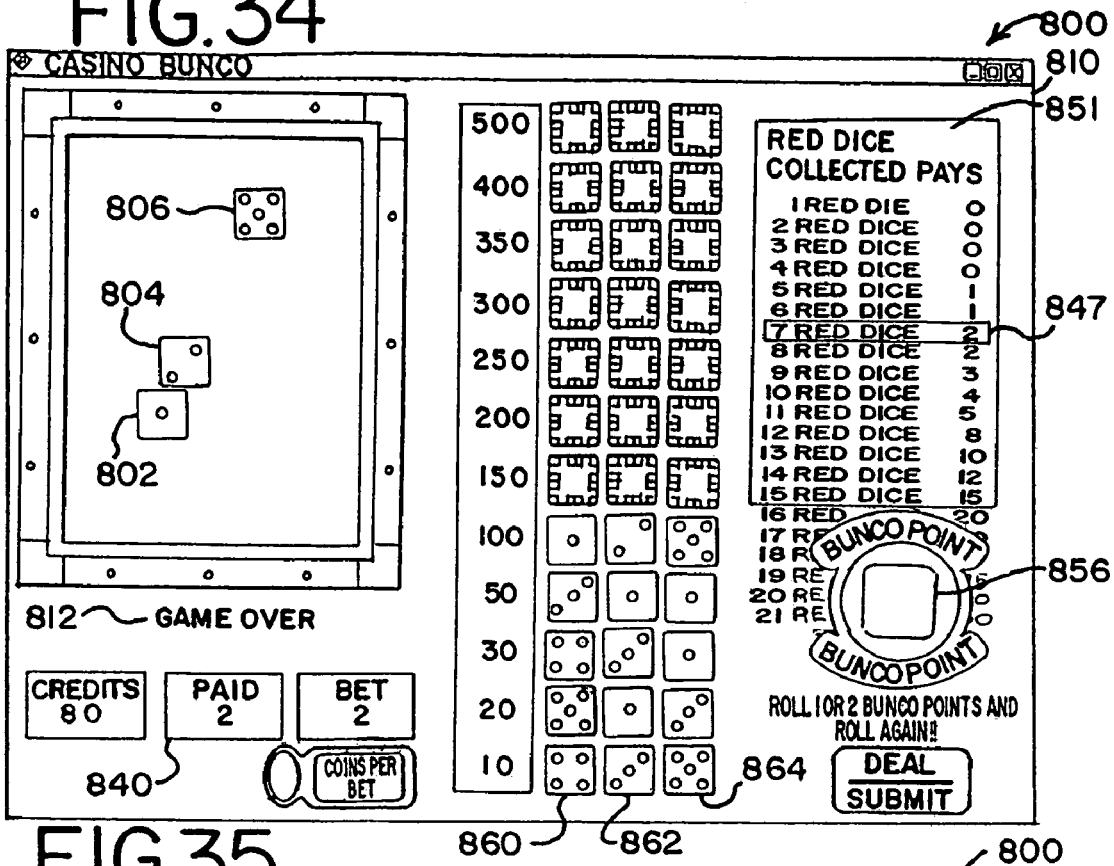

FIG. 34 represents the result of a fifth roll as well as the previous four rolls of the same game. This roll results in the player getting a one on the first die 802, a two on the second die 804, and a five on the third die 806. From viewing the three columns 860, 862, 864 representing a roll history, it can be observed that the player has failed to match any of the Bunco Points and this hand of the game 800 is over as is also shown in the message area 812. This play of this hand results in the player achieving a total of seven matched points for a payout of two credits as shown on line 847 of the Paytable 851.

Figure 35:
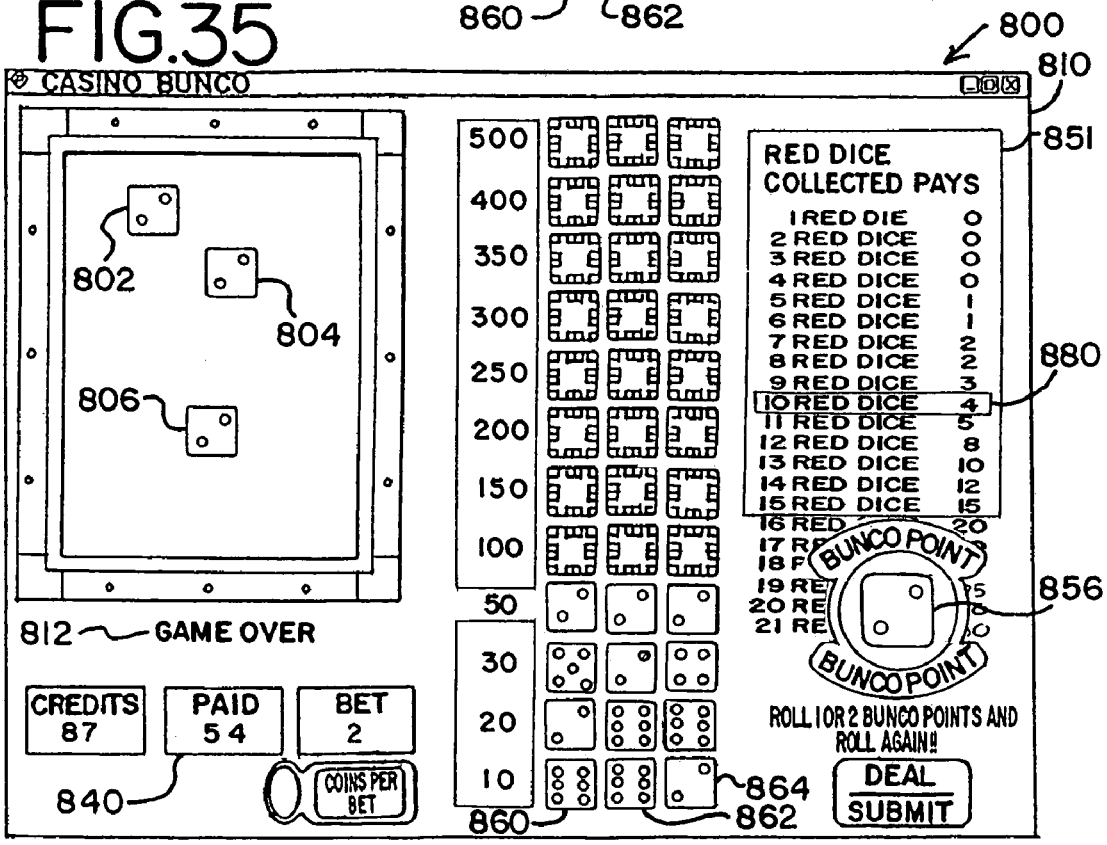

FIG. 35 displays the result of a fourth roll of another game. In this game 800, the video monitor 810 again displays a Paytable 851 with up to twenty-five possible payouts. This Paytable 851 can also "scroll" further down as discussed earlier. In FIG. 35, it can be seen in columns 860, 862, and 864 that the player has matched a total of ten Bunco Points as is illustrated in line 880 of the Paytable 851. Here, the player matched three Bunco Points 856 in the first roll, as is expected. In the second roll, the player again matched three points for a total of six Bunco Points. In the third roll, the player matched only the two once, for a total of seven Bunco Points being matched. In this, the fourth row, the player rolled a three of a kind of two's which adds three more matches onto the previous number of matched Bunco Points 856 to achieve a total of ten matched Bunco Points 856 as is illustrated in the Paytable 851 in line 880 for a win of four credits. Additionally, in this fourth roll, the player achieved a three of a kind that matches the only surviving Bunco Point 856. So said, at this point in this game 800, the match awards the player a win of fifty credits in addition to the four previously earned credits for a total of fifty-four credits being won by the player as is indicated in the "Paid" meter 840. The player has increased his credit value by more than a factor of twenty five, and the game ends as a result of a Bunco award. In another embodiment the game could continue after a Bunco.

Bet Dependent Paytables

In most of the previous examples the paytables on each level are independent of the number of levels played (which is a function of the base bet). That is, the first stage paytable is the same whether 1 stage is all that is wagered upon or any number up to the maximum number of stages. This holds true for each stage.

In the previous example describing wagers based on the number of dice, the pays on the highest level wagered would change depending on whether 1, 2 or 3 dice were rolled on that level to provide a reasonable return, however, like the previous example, all stages on which 3 dice are rolled show the same paytable regardless of the number of stages receiving a wager.

Another embodiment of this invention makes dramatic changes to the entire paytable on all levels as the number of levels wagered upon changes. This modification can be used whether the betting is done based on stages or dice.

This has some dramatic advantages over the scenario where the pays on each level stay the same as more levels are wagered upon. One advantage of changing the entire paytable is that the hit rate of the game (percentage of games where any money is returned) may be varied and controlled as the different stages are added. Using this technique, as more levels are added, money that is awarded on the lower levels at great frequency can be moved into lower frequency pays at the higher levels (or vice versa). This is the technique that is used to modify volatility and balance most games of chance where there isn't a dependency from one pay to the next (via hits on the stages). This technique also has the advantage in this Bunco game of allowing the coveted Bunco pay values to always be quite valuable and to always increase at the higher stages. A look at FIG. 8 shows the Bunco awards for a 7 credit bet are 30, 7, 25, 30, 50, 100, 400 on the 7 stages. This means that until you get up to the $5^{th}$ stage that a Bunco is not more valuable than one achieved on the $1^{st}$ stage. Also, you only get the amount of your wager back for a $2^{nd}$ level Bunco, which may be disappointing.

Table 24 shows a 6 stage paytable that has been constructed using this new technique. This table is based on an 18 credit wager (for 18 dice), Double and Triple Bunco awards of 400 and 8000 respectively and a Bonus Game with an expected value of 113.635. This version summarized in Table 24 also uses the Free Ride feature previously described.

Looking at Table 24 the 0.462963 or 46% return of the $1^{st}$ stage would not work well if the $1^{st}$ stage were played alone with this return. In fact, this version would not be legal in most gaming jurisdictions, which require minimum returns such as 75% or 83%. However, this $1^{st}$ stage is only playable as part of a 6 stage game which has an overall return of over 92.7%. Now, in this 6 stage game the Bunco awards are always of great value (starting at almost 3 time the player's wager and increasing dramatically with increasing stages).

TABLE 24

| stage | 1 point | 2 points | 3 points | BUNCO | Stage EV |
|---|---|---|---|---|---|
| 1 | 0 | 0 | 0 | 50 | 0.462963 |
| 2 | 0 | 4 | 10 | 80 | 0.9773663 |
| 3 | 2 | 4 | 20 | 100 | 0.8720818 |
| 4 | 10 | 25 | 80 | 200 | 1.1932888 |
| 5 | 25 | 50 | 100 | 400 | 1.0921456 |
| 6 | 50 | 100 | 200 | 1000 | 0.9647863 |
| | | | 6 Stage EV | | 0.9271053 |

Table 25 shows a 2 stage paytable that would be used in the same game when only 2 stages were wagered upon. Many of the values used for the first 2 stages in the 6 stage version above have been changed to allow this 2 stage version to have a reasonable return. Also note that 1 point now pays on the $2^{nd}$ stage to give a little better hit rate on this wager that really doesn't have any really high odds payoffs.

TABLE 25

| stage | 1 point | 2 points | 3 points | BUNCO | Stage EV |
|---|---|---|---|---|---|
| 1 | 0 | 0 | 0 | 60 | 0.5555556 |
| 2 | 1 | 4 | 10 | 100 | 1.1897719 |
| | | | 2 Stage EV | | 0.8726638 |

Those skilled in the art can appreciate how to use this technique to make the paytables of Tables 24 and 25 more or less volatile as desired for the particular game and how to apply these techniques to create the paytables for other number of stages wagered upon.

It will additionally be noted that the invention further contemplates a training program for players of these games, particularly in the video game versions. Such training programs are designed to teach players not only the fundamentals of game play, but to optimize game playing strategy, as with visual and aural cues for the player, replay options, and the like. Representative training programs are disclosed in applicants' co-pending patent application Ser. No. 09/539,286, filed Mar. 30, 2000, and that disclosure is hereby incorporated by reference.

Thus, while the invention has been disclosed and described with respect to certain embodiments, those of skill in the art will recognize modifications, changes, other applications and the like which will nonetheless fall within the spirit and ambit of the invention, and the following claims are intended to capture such variations.

What is claimed is:

1. A gaming machine for playing a Bunco-type dice game comprising:

a video display device;

a cpu having a program operating a dice game;

a wager input mechanism which registers a wager placed by a player;

said program establishing a set of differing gameplay dice elements, including a subset of at least one match point at the start of the game, each said match point having a match indicium for potential matching with a subsequent toss of the dice elements;

said program establishing and displaying a random toss of a plurality of dice elements at each stage of play, and determining for each die element tossed at a stage of play whether its randomly selected indicium matches said match indicium of said match point;

said program eliminating from play any match point which is not matched on a toss, and determining whether to continue with a toss on a subsequent stage of play up to a preset maximum number of stages provided that at least one match point remains for each such subsequent stage; and a payout mechanism providing an award according to a predetermined first paytable for each match on a toss.

2. The gaming machine of claim 1 wherein said payout mechanism includes a second paytable provided for a bonus award, said second paytable increasing in bonus award value with each successive stage of play, and including the step of awarding a bonus award if all dice elements on a toss have the same randomly selected indicium which also matches a match indicium.

3. The gaming machine of claim 2 wherein three dice elements are established and displayed as being tossed at each stage of play.

4. The gaming machine of claim 1 wherein said program includes a randomly allocated free advancement feature, and determines a game ending condition if no match is made at a stage of play unless said free advancement feature has been allocated, in which event the game continues to the next stage of play.

5. The gaming machine of claim 1 wherein said program includes a randomly allocated free advancement feature, said program further eliminating from play any match point which is not matched on a toss, and determines whether to continue with a toss on a subsequent stage of play up to a preset maximum number of stages provided that at least one match point remains for each such subsequent stage unless said free advancement feature has been allocated, in which event the game continues to the next stage of play.

6. The gaming machine of claim 1 wherein a plurality of match points are established, each of said plurality of match points having a match indicium selected at random, whereby some or all of said match indicia of said plurality of match points may thereby be the same.

* * * * *